United States Patent [19]

Kumagai et al.

[11] Patent Number: 4,912,926

[45] Date of Patent: Apr. 3, 1990

[54] AIR/FUEL RATIO CONTROL SYSTEM FOR INTERNAL COMBUSTION ENGINE

[75] Inventors: Shiro Kumagai, Kyoto; Reijiro Komagome, Joyo; Yoshiaki Kodama; Tateo Kume, both of Kyoto, all of Japan

[73] Assignee: Mitsubishi Jidosha Kogyo Kabushiki Kaisha, Tokyo, Japan

[21] Appl. No.: 190,259

[22] Filed: May 4, 1988

[30] Foreign Application Priority Data

May 11, 1987 [JP] Japan ..... 62-113982
May 12, 1987 [JP] Japan ..... 62-115229

[51] Int. Cl.[4] ..... F02D 41/14

[52] U.S. Cl. ..... 60/276; 60/285; 123/489

[58] Field of Search ..... 123/440, 489, 589; 60/276, 285

[56] References Cited

U.S. PATENT DOCUMENTS 3,939,654 2/1976 Creps ..... 123/440
4,027,477 6/1977 Storey ..... 123/489
4,235,204 11/1980 Rice ..... 123/489
4,712,373 12/1987 Nagai et al. ..... 123/489

FOREIGN PATENT DOCUMENTS 58-48756 3/1983 Japan ..... 123/489

*Primary Examiner*—Andrew M. Dolinar

[57] ABSTRACT

An air/fuel ratio control system is provided for an internal combustion engine. The system includes first and second oxygen density sensors, an air/fuel ratio control device and a standard-value changing device. The first oxygen density sensor is arranged on an upstream side of a catalytic converter, while the second oxygen density sensor is provided either inside or on a downstream side of the catalytic converter. The air/fuel control device controls the air/fuel ratio of the internal combustion engine on the basis of results of comparison between a detection value from one of the first and second oxygen density sensors and a predetermined standard value. The standard-value changing device changes the standard value on the basis of outputs from the first and second oxygen density sensors.

14 Claims, 65 Drawing Sheets

FIG. 25(a)
FIG. 25(b)
FIG. 25(c)
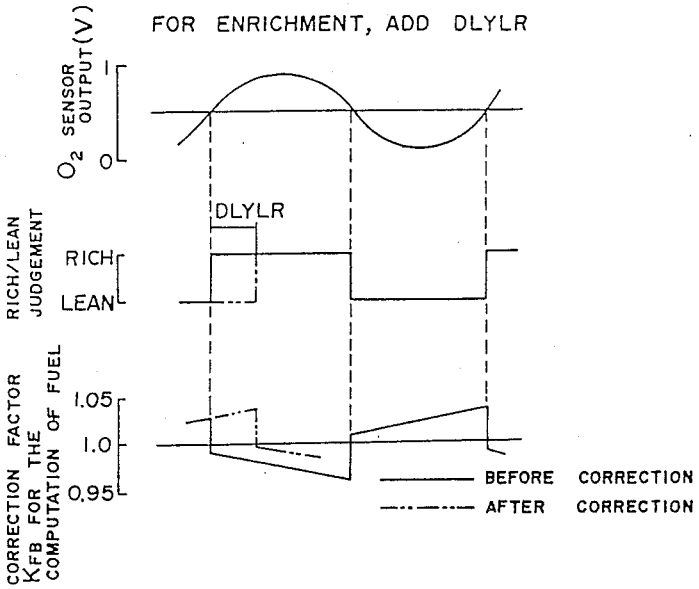
FIG. 26(a)
FIG. 26(b)
FIG. 26(c)
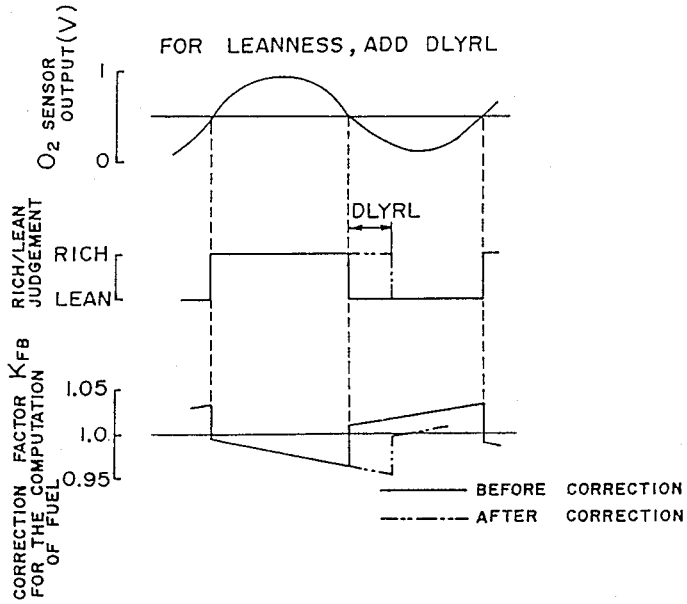

FIG. 27(a)
FIG. 27(b)
FIG. 27(c)
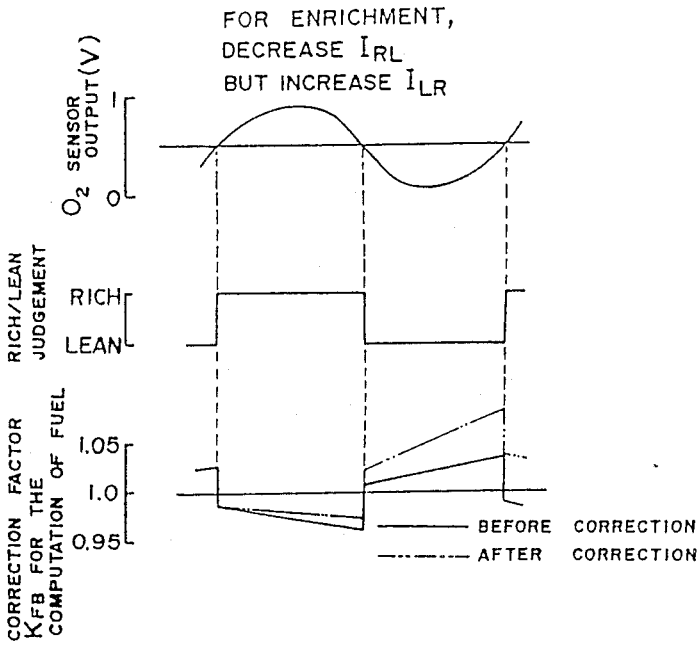
FIG. 28(a)
FIG. 28(b)
FIG. 28(c)
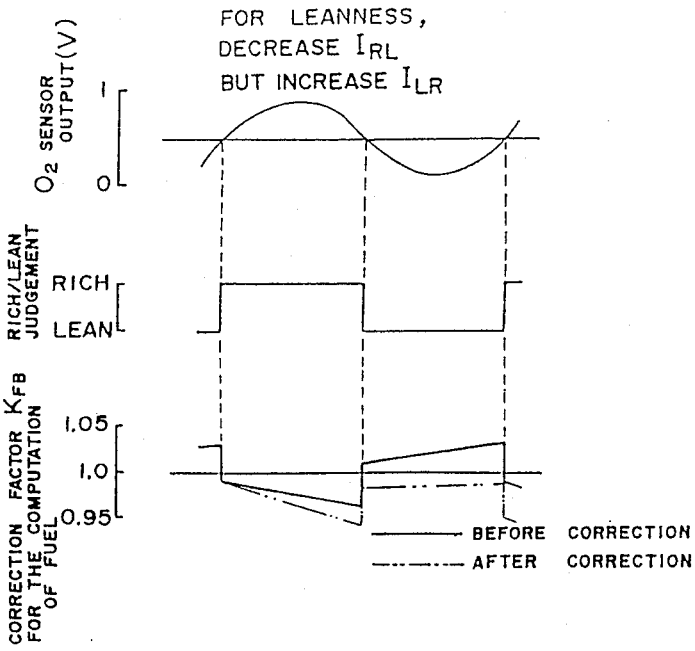

FIG. 29(a)
FIG. 29(b)
FIG. 29(c)
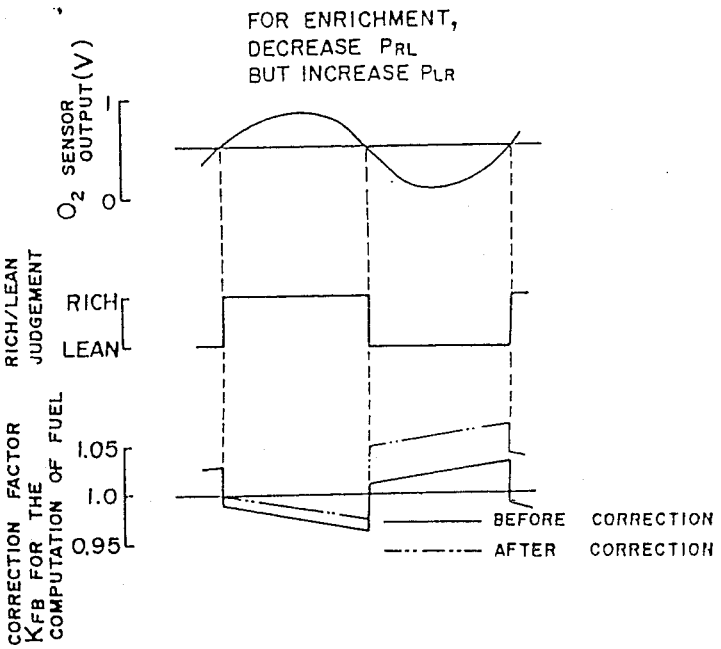
FIG. 30(a)
FIG. 30(b)
FIG. 30(c)
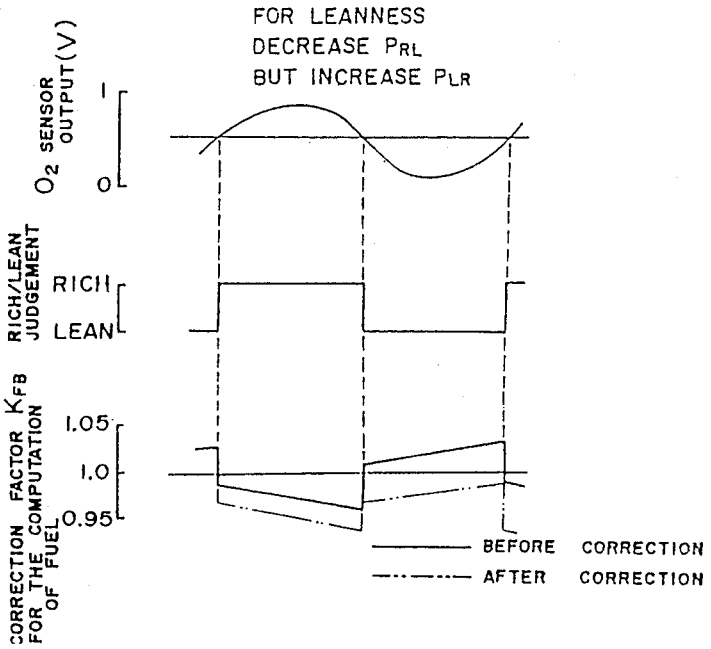

FIG. 46(a)
FIG. 46(b)
FIG. 46(c)
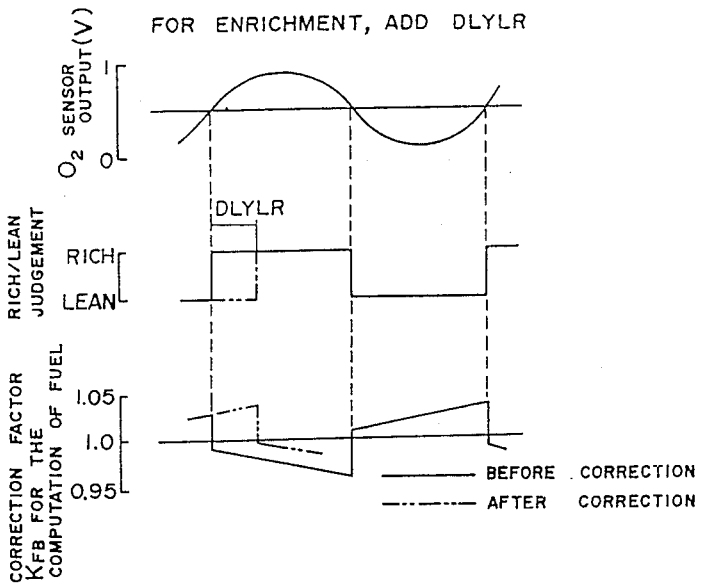
FIG. 47(a)
FIG. 47(b)
FIG. 47(c)
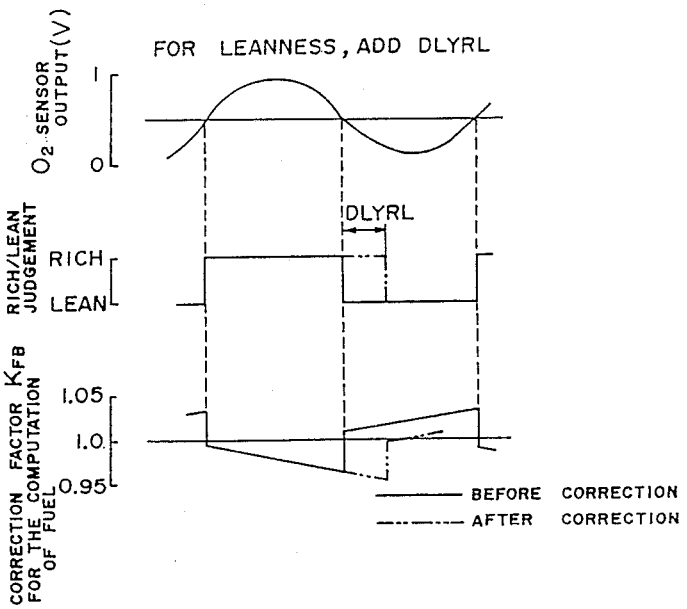

FIG. 48(a)
FIG. 48(b)
FIG. 48(c)
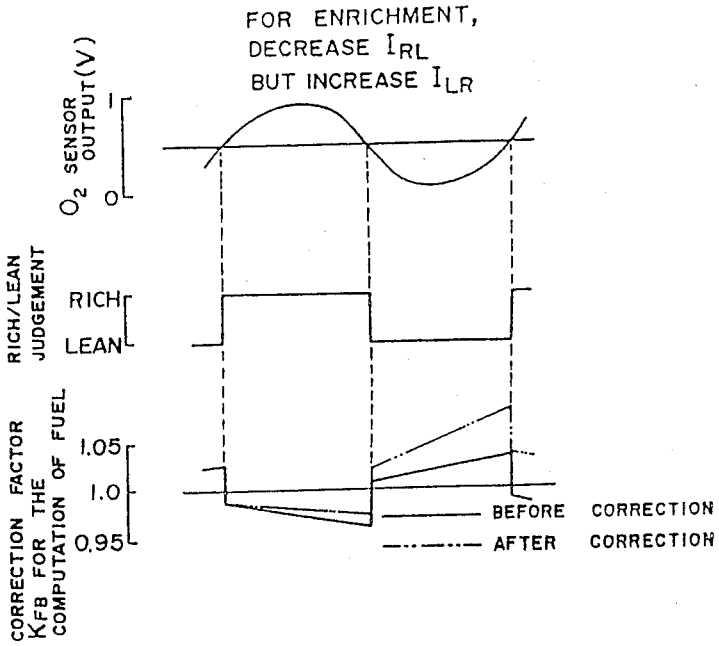
FIG. 49(a)
FIG. 49(b)
FIG. 49(c)
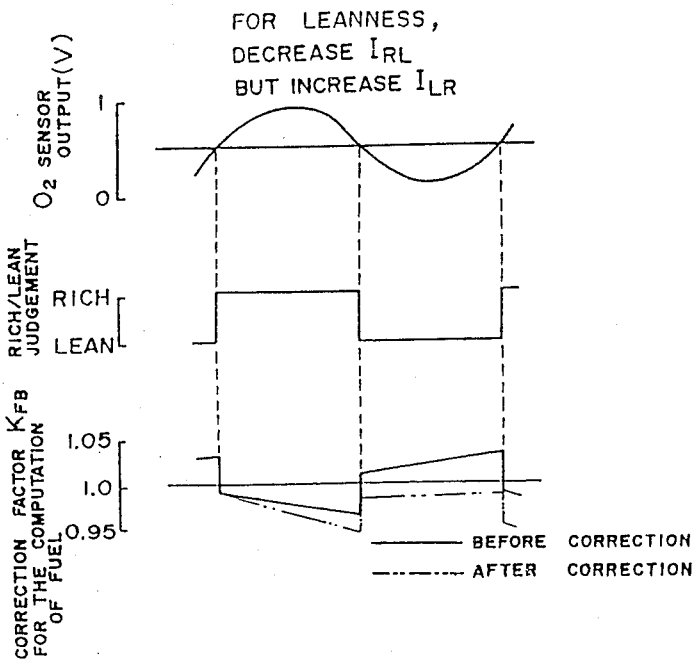

FIG. 50(a)
FIG. 50(b)
FIG. 50(c)
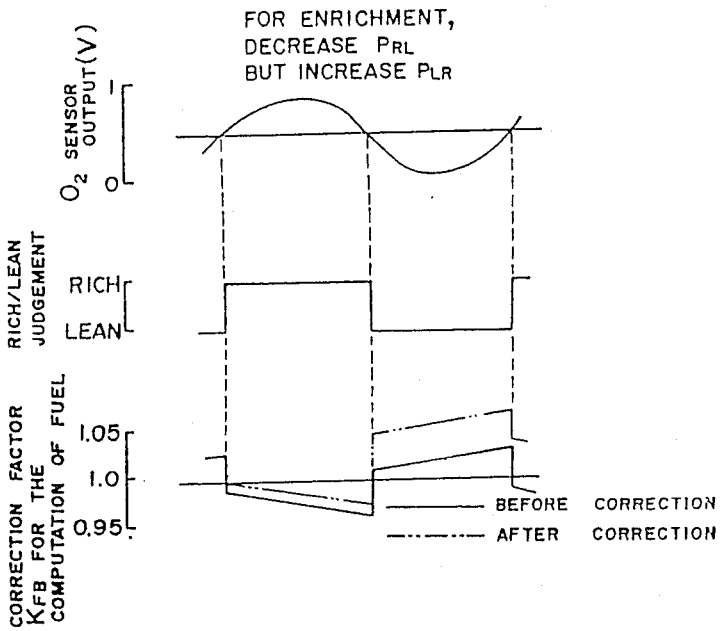
FIG. 51(a)
FIG. 51(b)
FIG. 51(c)
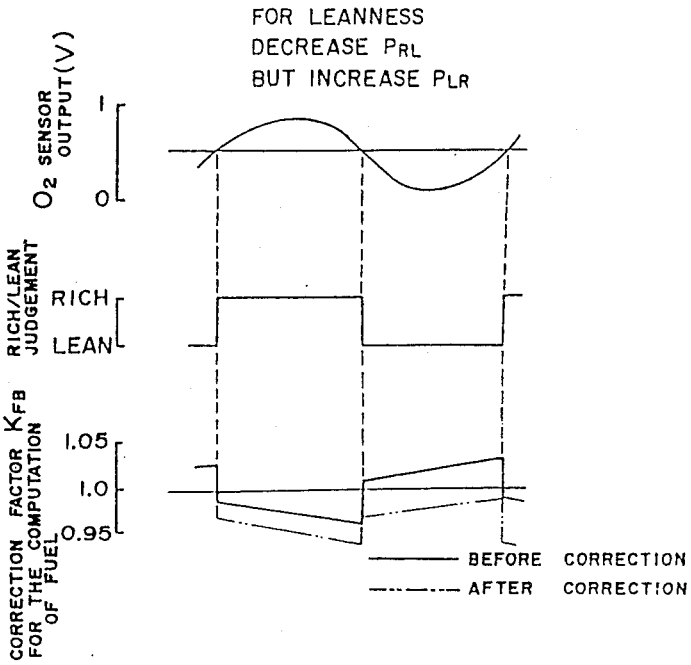

FIG. 52(a)
FIG. 52(b)
FIG. 52(c)
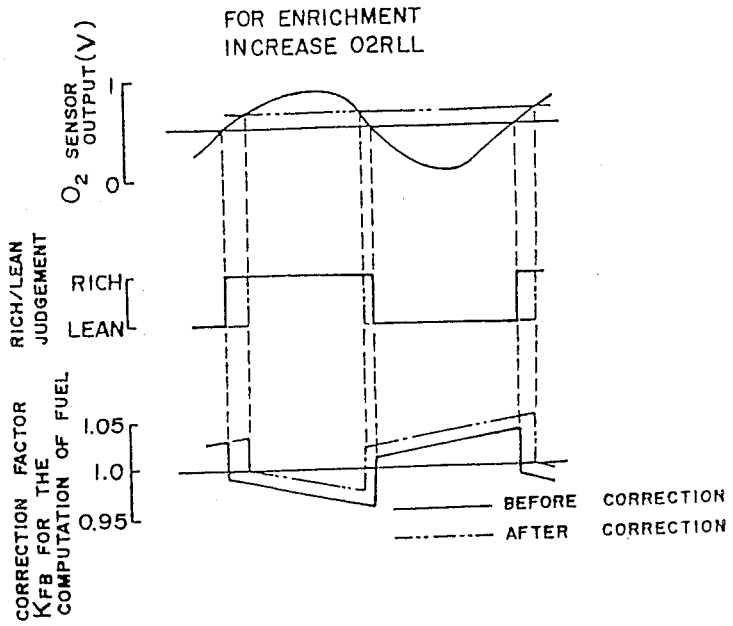
FIG. 53(a)
FIG. 53(b)
FIG. 53(c)
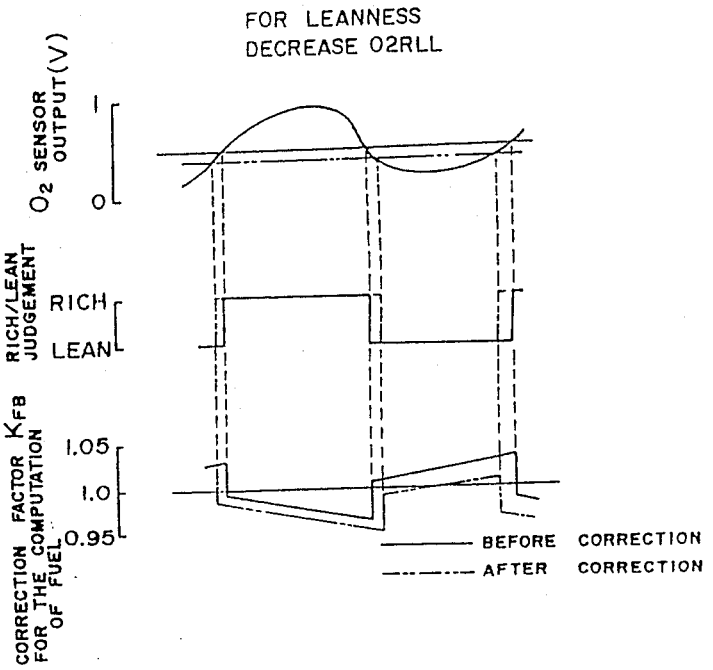

AIR/FUEL RATIO CONTROL SYSTEM FOR INTERNAL COMBUSTION ENGINE

BACKGROUND OF THE INVENTION (1) Field of the Invention

This invention relates to an air/fuel ratio control system for an internal combustion engine, which controls the air/fuel ratio of the internal combustion engine by using, as feedback signals, detection signals from oxygen density sensors (hereinafter called "$O_2$ sensors") arranged in the exhaust system of the internal combustion engine which may hereinafter be called "engine" as needed.

(2) Description of the Related Art

A variety of such air/fuel ratio control systems has heretofore been proposed for internal combustion engines. In air/fuel ratio control systems of the above sort for internal combustion engines, an $O_2$ sensor which has been designed to change its output value abruptly near the stoichiometric fuel ratio by using the principle of oxygen concentration cells of a solid electrolyte, is arranged in an engine exhaust system at an upstream side relative to the point of arrangement of a catalytic converter (three-way catalyst) in the engine exhaust system. The air/fuel ratio of the internal combustion engine is controlled by comparing an output from the $O_2$ sensor with a predetermined standard value (As the standard value, an intermediate value of values between which the abrupt change takes place is given as a fixed value. This value is useful as a value for the judgement of either a rich air-fuel mixture or a lean air-fuel mixture) and then controlling the quantity of the fuel to be injected from each electromagnetic fuel injection valve (injector) in such a way that the air-fuel mixture is rendered lean when the output of the $O_2$ sensor is greater than the standard value but is rendered rich when the output of the $O_2$ sensor becomes smaller on the contrary.

It has recently been proposed to provide an additional $O_2$ sensor on the downstream side of the catalytic converter provided in the engine exhaust system (This $O_2$ sensor will hereinafter be called "rearward $O_2$ sensor" while an $O_2$ sensor provided on the upstream side of the catalytic converter like the above-described $O_2$ sensor will be called a forward $O_2$ sensor) and to use an output from the rearward $O_2$ as auxiliary information for the control of the air/fuel ratio (so-called dual $O_2$ sensor system or double $O_2$ sensor system). Even in this case, a standard value which should be compared with an output from the rearward $O_2$ sensor will not be changed once it has been set.

Among such conventional air/fuel ratio control systems for internal combustion engines, as far as $O_2$ sensors are concerned, the former systems perform the feedback control of the air/fuel ratio only by the output of the forward $O_2$ sensor and there is hence a room for improvements to the accuracy of the control, and the latter systems may not be able to perform successfully the feedback control of the air/fuel ratio on the basis of the output of the forward $O_2$ sensor in some instances because the standard value for the rearward $O_2$ sensor is a fixed value, and there is also a room for improvements in this regard.

In the conventional air/fuel ratio control systems for internal combustion engines, the standard value to be compared with the output of the forward $O_2$ sensor is a fixed value no matter whether they are of the former type or of the latter type. They hence involve a problem in connection with the reliability of the control, since the characteristics of $O_2$ sensors vary from one sensor to another and also along the passage of time, the accuracy of the control varies, and the efficiency of cleaning of exhaust gas by the catalytic converter also changes.

SUMMARY OF THE INVENTION

It is the object of this invention to solve such a problem.

More specifically, an object of this invention is to provide an air/fuel ratio control system for an internal combustion engine, which allows to change, based on outputs from a forward $O_2$ sensor and a rearward $O_2$ sensor provided inside or on a downstream side of a catalytic converter, a standard value to be compared with an output from one of the forward and rearward $O_2$ sensors, whereby the accuracy of the control is not changed by variations in characteristics of each $O_2$ sensor and changes of its characteristics along the passage of time and the efficiency of cleaning of exhaust gas by the catalytic converter can also be maintained high, thereby making it possible to obtain high reliability in regard to the control.

Another object of this invention is to provide an air/fuel ratio control system for an internal combustion engine, which allows to change, based on outputs from both forward $O_2$ sensor and rearward $O_2$ sensor, a second standard value to be compared with an output from the other one of the forward and rearward $O_2$ sensors so as to obtain high reliability with respect to the control.

In one aspect of this invention, there is thus provided an air/fuel ratio control system for an internal combustion engine, comprising:

a first oxygen density sensor arranged on an upstream side of a catalytic converter so as to detect the density of oxygen in exhaust gas, said catalytic converter being provided in an exhaust system of the internal combustion engine and adapted to clean the exhaust gas;

a second oxygen density sensor arranged inside the catalytic converter or on a downstream side of the catalytic converter so as to detect the density of oxygen in the exhaust gas;

an air/fuel ratio control means for controlling the air/fuel ratio of the internal combustion engine on the basis of results of comparison between a detection value from one of the first and second oxygen density sensors and a predetermined standard value; and a standard-value changing means for changing the standard value on the basis of outputs from the first and second oxygen density sensors.

Said standard-value changing means may preferably change the air/fuel ratio between a rich side and a lean side relative to a stoichiometric air/fuel ratio, detects outputs from the first and second oxygen density sensors at each air/fuel ratio upon changing the air/fuel ratio, and then changes the standard value on the basis of a difference in output between the first oxygen density sensor and second oxygen density sensor. In addition, said standard-value changing means may change the standard value at intervals of a predetermined period of operation time.

Further, said standard-value changing means may change the air/fuel ratio between a rich side and a lean side relative to a stoichiometric air/fuel ratio, detects outputs from the first and second oxygen density sensors at each air/fuel ratio upon changing the air/fuel ratio, and changes and renews the standard value by a median of outputs from said one oxygen density sensor in a range where a corresponding output characteristic curve obtained as a result of the detection has an inclination greater than a predetermined inclination.

In another aspect of this invention, there is also provided an air/fuel ratio control system for an internal combustion engine, comprising:

a first oxygen density sensor arranged on an upstream side of a catalytic converter so as to detect the density of oxygen in exhaust gas, said catalytic converter being provided in an exhaust system of the internal combustion engine and adapted to clean the exhaust gas;

a second oxygen density sensor arranged inside the catalytic converter or on a downstream side of the catalytic converter so as to detect the density of oxygen in the exhaust gas;

an air/fuel ratio control means for controlling the air/fuel ratio of the internal combustion engine on the basis of results of comparison between a detection value from one of the first and second oxygen density sensors and a predetermined standard value;

a second standard-value setting means for setting a second standard value for the other oxygen density sensor on the basis of outputs from the first and second oxygen density sensors; and an air/fuel ratio control correction means for effecting a correction to the air/fuel ratio control, which is to be performed by said air/fuel ratio control means, on the basis of results of comparison between the second standard value set by said second standard-value setting means and an output from the other oxygen density sensor.

Said second standard-value changing means may preferably change the air/fuel ratio between a rich side and a lean side relative to a stoichiometric air/fuel ratio, detects outputs from the first and second oxygen density sensors at each air/fuel ratio upon changing the air/fuel ratio, and changes and renews the second standard value by a value pertaining to an output of the other oxygen density sensor, said output corresponding to the median of outputs from said one oxygen density sensor in a range where a corresponding output characteristic curve obtained as a result of the detection has an inclination greater than a predetermined inclination. Said second standard-value changing means may change the second standard value at intervals of a predetermined period of operation time.

In addition, a correction may be effected to any one of at least response delay time, proportional gain and integral gain on the basis of results of comparison between the second standard value and an output from the other oxygen density sensor. Moreover, a correction may also be effected to the standard value on the basis of results of comparison between the second standard value and an output from the other oxygen density sensor.

Further, said air/fuel ratio control correcting means may use the average value of outputs from the other oxygen density sensor as the output from the other oxygen density sensor, and the average value of the outputs is renewed whenever the output value of said one oxygen density sensor is reversed. A correction may be effected to the air/fuel control by said air/fuel control means on the basis of results of comparison between the second standard value and the average value of the outputs from the other oxygen density sensor, when the number of reversals of the output value from said one oxygen density sensor has been exceeded a predetermined value.

Said air/fuel ratio control correction means may use the average value of outputs from the other oxygen density sensor as the output from the other oxygen density sensor, and the average value of the outputs may be renewed whenever the quantity of intake air of the internal combustion engine exceeds a first predetermined value. When the number of occasions where the quantity of the intake air of the internal combustion engine exceeded a predetermined value has exceeded a second predetermined value, a correction may be effected to the air/fuel ratio control by said air/fuel ratio control means on the basis of results of comparison between the second standard value and the average value of the outputs from the other oxygen density sensor.

In a further aspect of this invention, there is also provided an air/fuel ratio control system for an internal combustion engine, comprising:

a first oxygen density sensor arranged on an upstream side of a catalytic converter so as to detect the density of oxygen in exhaust gas, said catalytic converter being provided in an exhaust system of the internal combustion engine and adapted to clean the exhaust gas;

a second oxygen density sensor arranged inside the catalytic converter or on a downstream side of the catalytic converter so as to detect the density of oxygen in the exhaust gas;

an air/fuel ratio control means for controlling the air/fuel ratio of the internal combustion engine on the basis of results of comparison between a detection value from one of the first and second oxygen density sensors and a predetermined standard value;

a standard-value changing means for changing the standard value on the basis of outputs from the first and second oxygen density sensors;

a second standard-value setting means for setting a second standard value for the other oxygen density sensor on the basis of outputs from the first and second oxygen density sensors; and an air/fuel ratio control correction means for effecting a correction to the air/fuel ratio control, which is to be performed by said air/fuel ratio control means, on the basis of results of comparison between the second standard value set by said second standard-value setting means and an output from the other oxygen density sensor.

According to the present invention, the reference value for rich/lean judgement, which is to be compared with an output from the upstream-side, namely, forward oxygen density sensor relative to the catalytic converter, can be changed on the basis of outputs from both forward oxygen density sensor and downstream-side, i.e., rearward oxygen density sensor. As a consequence, the accuracy of the control is not changed by variations in characteristics of each oxygen density sensor and changes of its characteristics along the passage of time and the efficiency of cleaning of exhaust gas by the catalytic converter can be maintained high, thereby bringing about an advantage that high reliability is assured in regard to the control.

BRIEF DESCRIPTION OF THE DRAWINGS

FIGS. 1(*a*) through 8 illustrate an air/fuel ratio control system according to a first embodiment of this invention, which is suitable for use with an internal combustion engine, in which:

FIG. 1(*a*) is a block diagram of the control system;

FIG. 1(*b*) is a fragmentary block diagram of the control system;

FIG. 3(*a*) is a schematic illustration of an exhaust system of an engine showing a modified arrangement of a second oxygen density sensor;

FIG. 6(*b*) is a flow chart for illustrating an integration time computing routine for the control system;

FIGS. 9 through 12 illustrate an air/fuel ratio control system according to a second embodiment of this invention, which is suitable for use with an internal combustion engine, in which:

FIG. 9 is a fragmentary block diagram of the control system;

FIGS. 10(*a*) through 10(*f*) are respectively flow charts for describing a main routine of the control system;

FIGS. 11(*a*)–11(*c*) are a graph illustrating an air/fuel ratio feedback factor for the control system; and FIGS. 12(*a*) and 12(*b*) are graph for illustrating the response time of an $O_2$ sensor in the control system.

FIGS. 13 through 31 depict an air/fuel ratio control system according to a third embodiment of this invention, which is suitable for use with an internal combustion engine, in which:

FIG. 13 is a fragmentary block diagram of the control system;

FIGS. 14(*a*) through 14(*e*) are respectively flow charts for describing a main routine of the control system;

FIG. 15 is a flow chart for determining a deviation between an output from a rearward $O_2$ sensor in the control system and a target value;

FIG. 16 is a flow chart for correcting response delay time on the basis of the deviation determined in FIG. 15;

FIG. 17 is a flow chart for correcting, based on the deviation determined in FIG. 15, an integral gain for the air/fuel ratio feedback control;

FIG. 18 is a flow chart for correcting, based on the deviation determined in FIG. 15, a proportional gain for the air/fuel ratio feedback control;

FIGS. 19(*a*), 19(*b*), 20(*a*) and 20(*b*) are respectively graphs for describing a correction value for response delay time;

FIGS. 21(*a*), 21(*b*), 22(*a*) through 22(*b*) are respectively graphs for illustrating a correction value for the integral gain which is for the air/fuel ratio feedback control;

FIGS. 23(*a*), 23(*b*), 24(*a*) and 24(*b*) are respectively graphs for illustrating a correction value for the proportional gain which is for the air/fuel ratio feedback control;

FIGS. 25(*a*)–25(*c*) and 26(*a*)–26(*c*) are respectively graphs for describing a correction method which relies upon the response delay time;

FIGS. 27(*a*)–27(*c*) and 28(*a*)–28(*c*) are respectively graphs for describing a correction method which relies upon the integral gain for the air/fuel ratio feedback control;

FIGS. 29(*a*)–29(*c*) and 30(*a*)–30(*c*) are respectively graphs for describing a correction method which relies upon the proportional grain for the air/fuel ratio feedback control; and FIG. 31 is a graph showing $V_f$–$V_r$ characteristics of the control system.

FIGS. 32 through 53 depict an air/fuel ratio control system according to a fourth embodiment of this invention, which is suitable for use with an internal combustion engine, in which:

FIG. 32 is a fragmentary block diagram of the control system;

FIGS. 33(*a*) through 33(*e*) are respectively flow charts for describing a main routine of the control system;

FIG. 34 is a flow chart for determining a deviation between an output from a rearward $O_2$ sensor in the control system and a target value (standard value);

FIG. 35 is a flow chart for correcting response delay time on the basis of the deviation determined in FIG. 34;

FIG. 36 is a flow chart for correcting, based on the deviation determined in FIG. 34, an integral gain for the air/fuel ratio feedback control;

FIG. 37 is a flow chart for correcting, based on the deviation determined in FIG. 34, a proportional gain for the air/fuel ratio feedback control;

FIG. 38 is a flow chart for correcting, based on the deviation determined in FIG. 34, a standard value for rich/lean judgement to be compared with an output from a forward $O_2$ sensor;

FIGS. 39(*a*), 39(*b*), 40(*a*) and 40(*b*) are respectively graphs for describing a correction value for response delay time;

FIGS. 41(*a*), 41(*b*), 42(*a*) and 42(*b*) are respectively graphs for illustrating a correction value for the integral gain which is for the air/fuel ratio feedback control;

FIGS. 43(*a*), 43(*b*), 44(*a*) and 44(*b*) are respectively graphs for illustrating a correction value for the proportional gain which is for the air/fuelratio feedback control;

FIGS. 45(*a*) and 45(*b*) are respectively graphs for describing a correction value for the standard value for rich/lean judgement to be compared with an output from a forward $O_2$ sensor;

FIGS. 46(*a*)–46(*c*) and 47(*a*–47(*c*) are respectively graphs for describing a correction method which relies upon the response delay time;

FIGS. 48(*a*(–48(*c*) and 49(*a*)–49(*c*) are respectively graphs for describing a correction method which relies upon the integral gain for the air/fuel ratio feedback control;

FIGS. 50(*a*)–50(*c*) and 51(*a*)–51(*c*) are respectively graphs for describing a correction method which relies upon the proportional grain for the air/fuel ratio feedback control; and FIGS. 52(*a*)–52(*c*) and 53(*a*)–53(*c*) are respectively graphs for describing a correction method which relies upon the standard value for rich/lean judgement to be compared with the output from the forward $O_2$ sensor;

FIGS. 56(*a*), 56(*b*) and 57 depict an air/fuel ratio control system according to a fifth embodiment of this invention, which is suitable for use with an internal combustion engine, in which:

FIGS. 56(*a*) and 56(*b*) are flow charts for describing a part of a main routine of the control system.

DETAILED DESCRIPTION OF THE INVENTION AND PREFERRED EMBODIMENTS

The embodiments of this invention will hereinafter be described with reference to the accompanying drawings.

Figure 3:
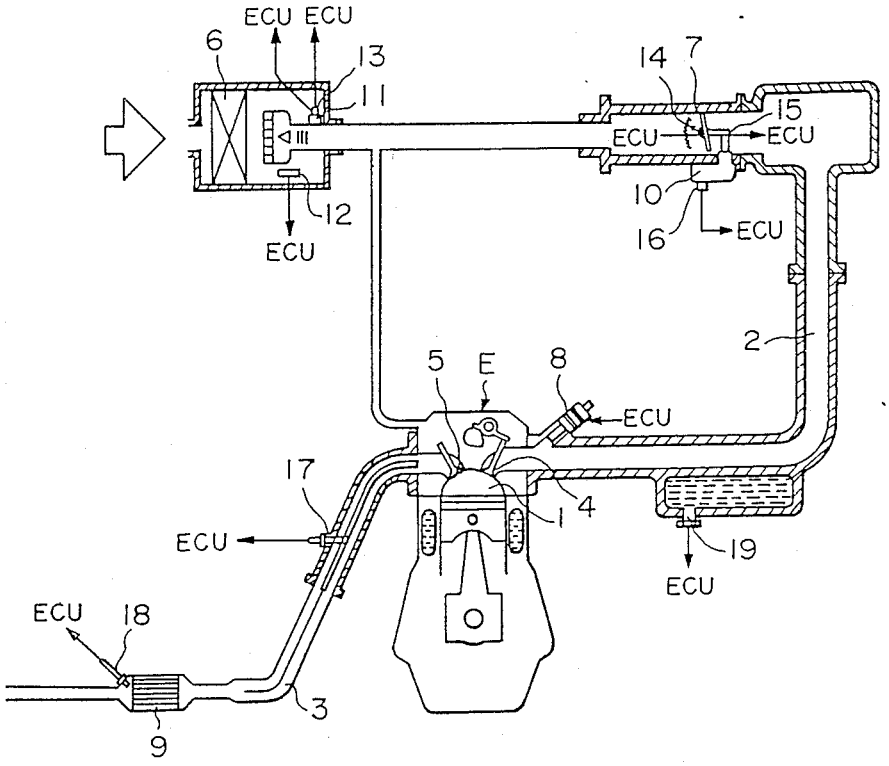
FIG. 3 is a schematic illustration showing an overall engine system.
Figure 3A:
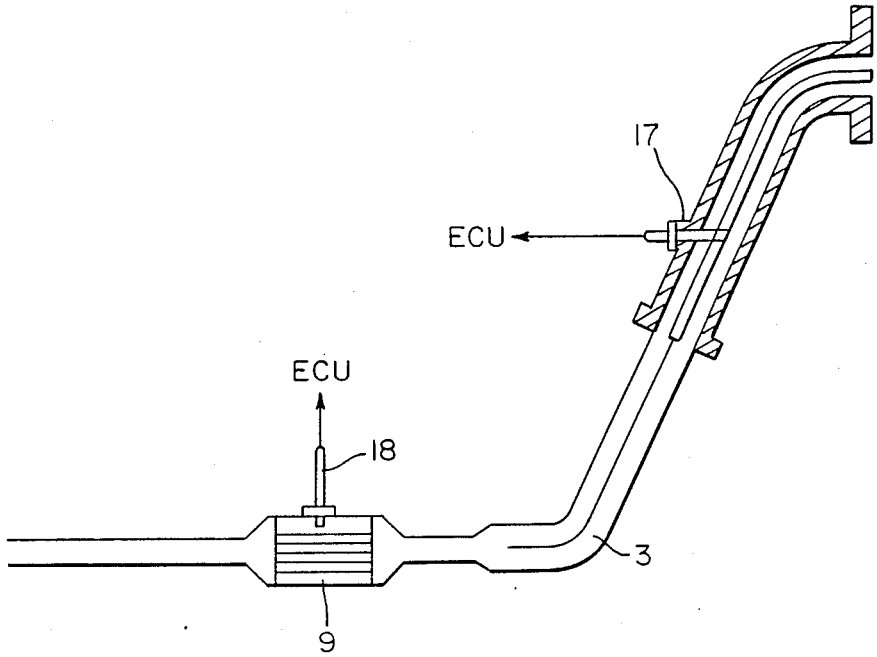
Figure 4A:
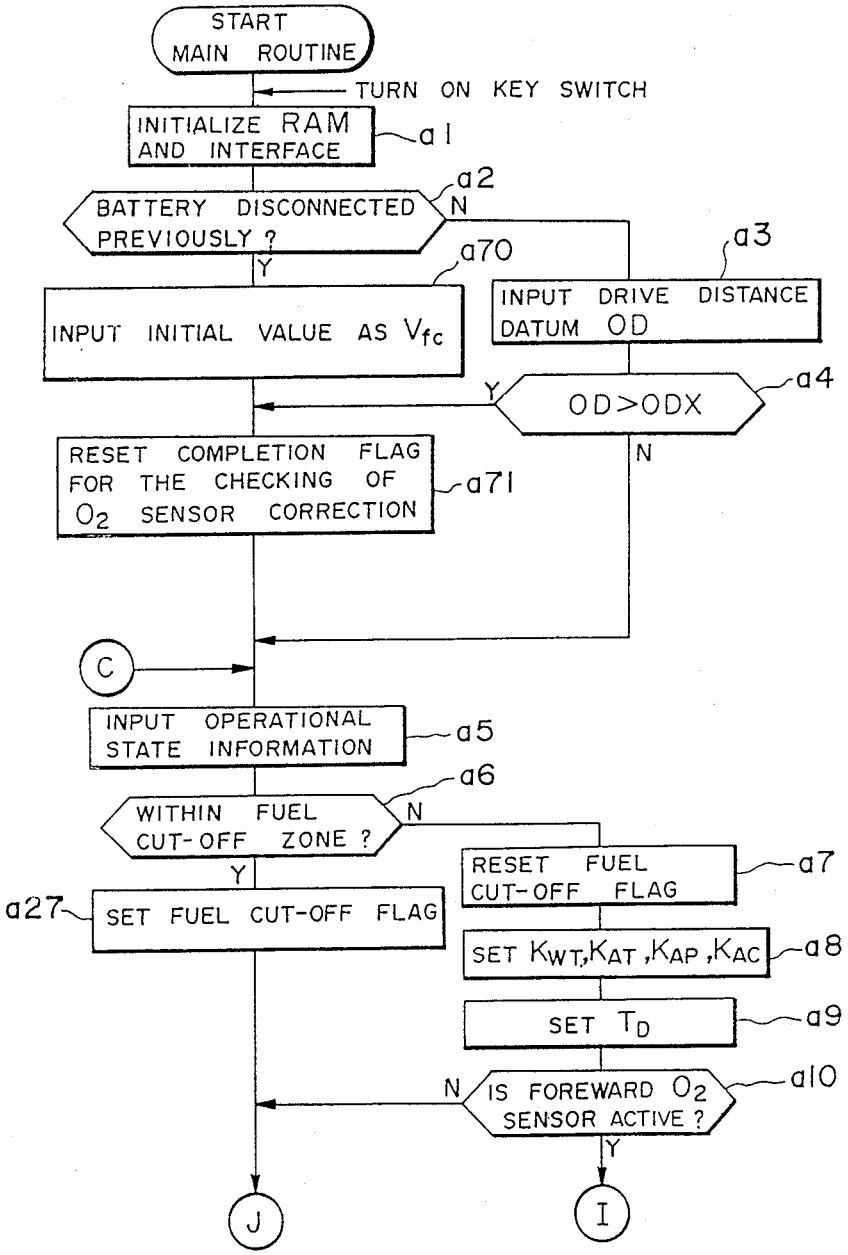
FIGS. 4(*a*) through 4(*e*) are respectively flow charts for illustrating a main routine of the control system.
Figure 4B:
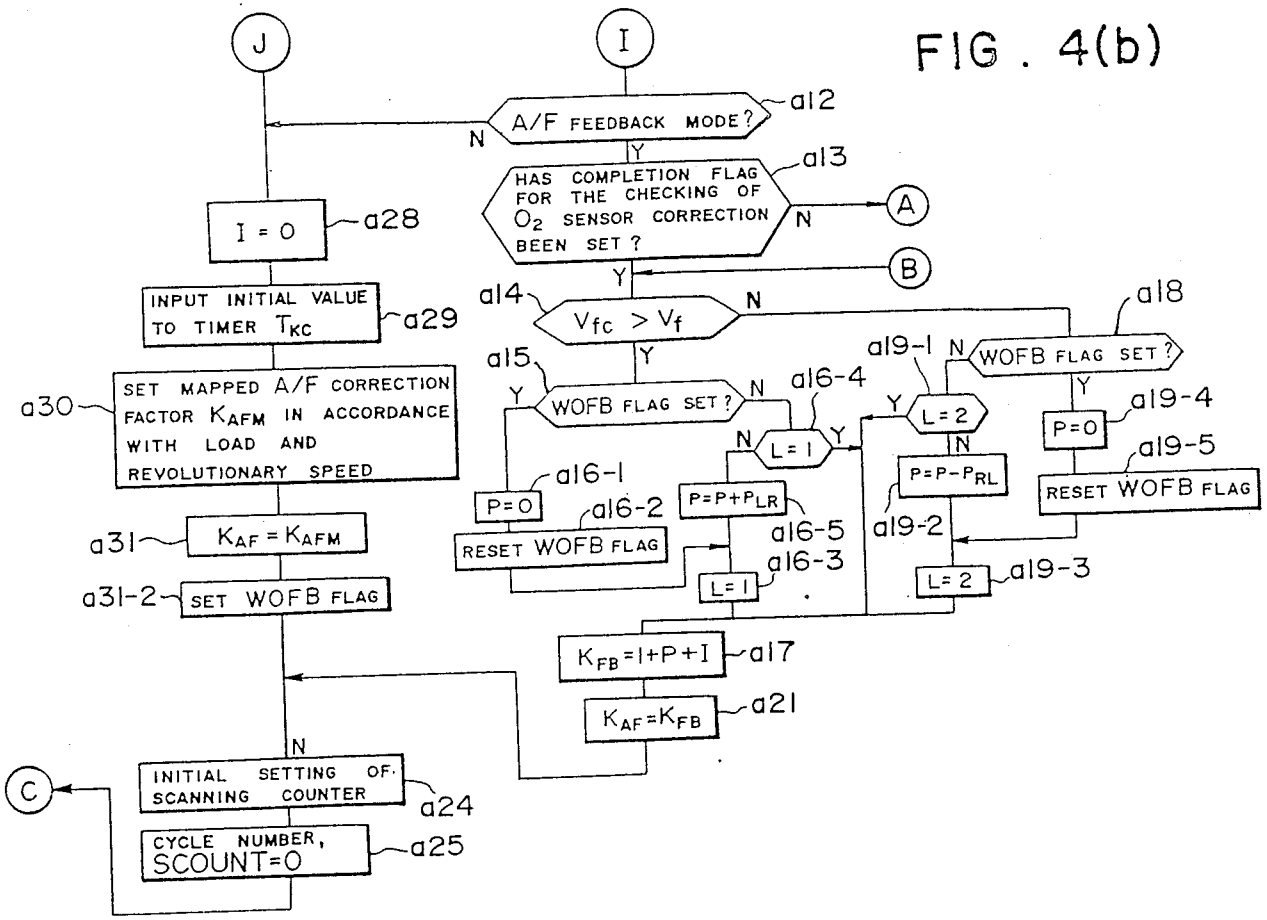
Figure 4C:
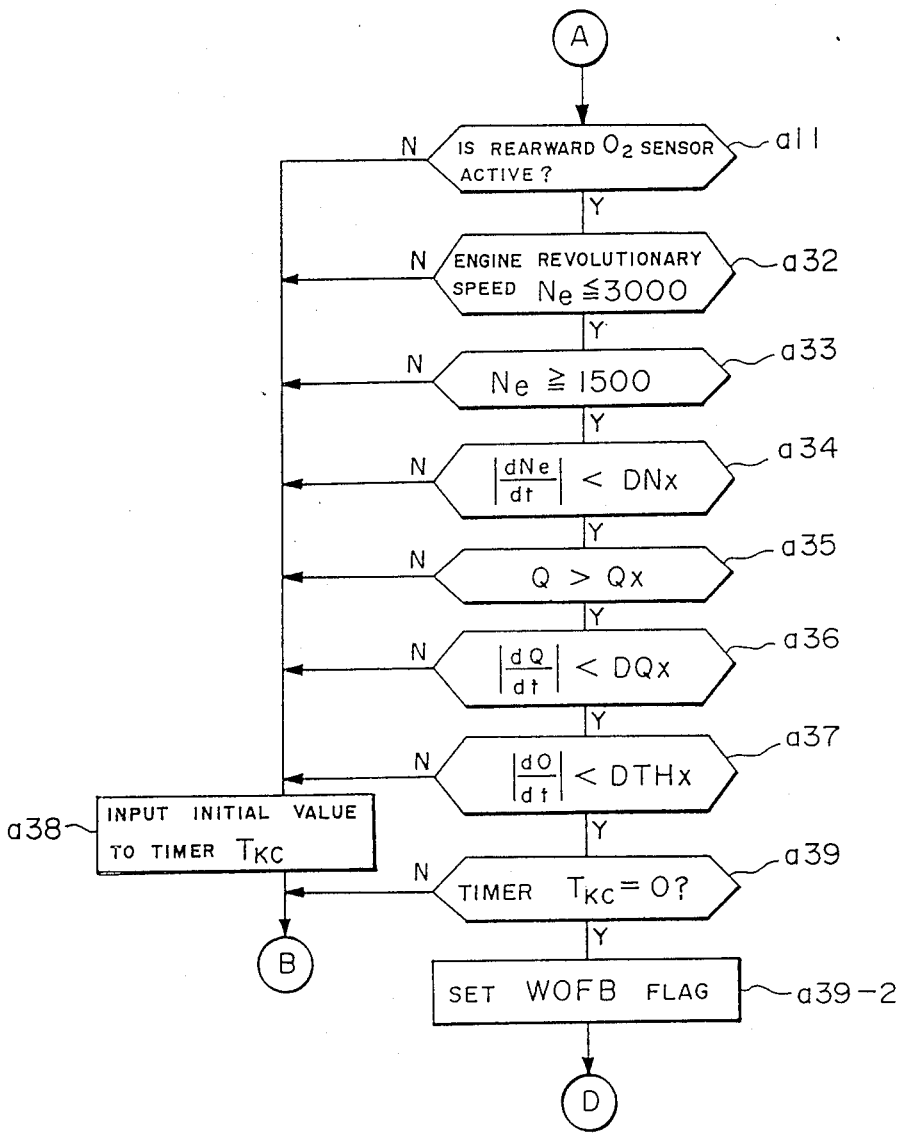
Figure 4D:
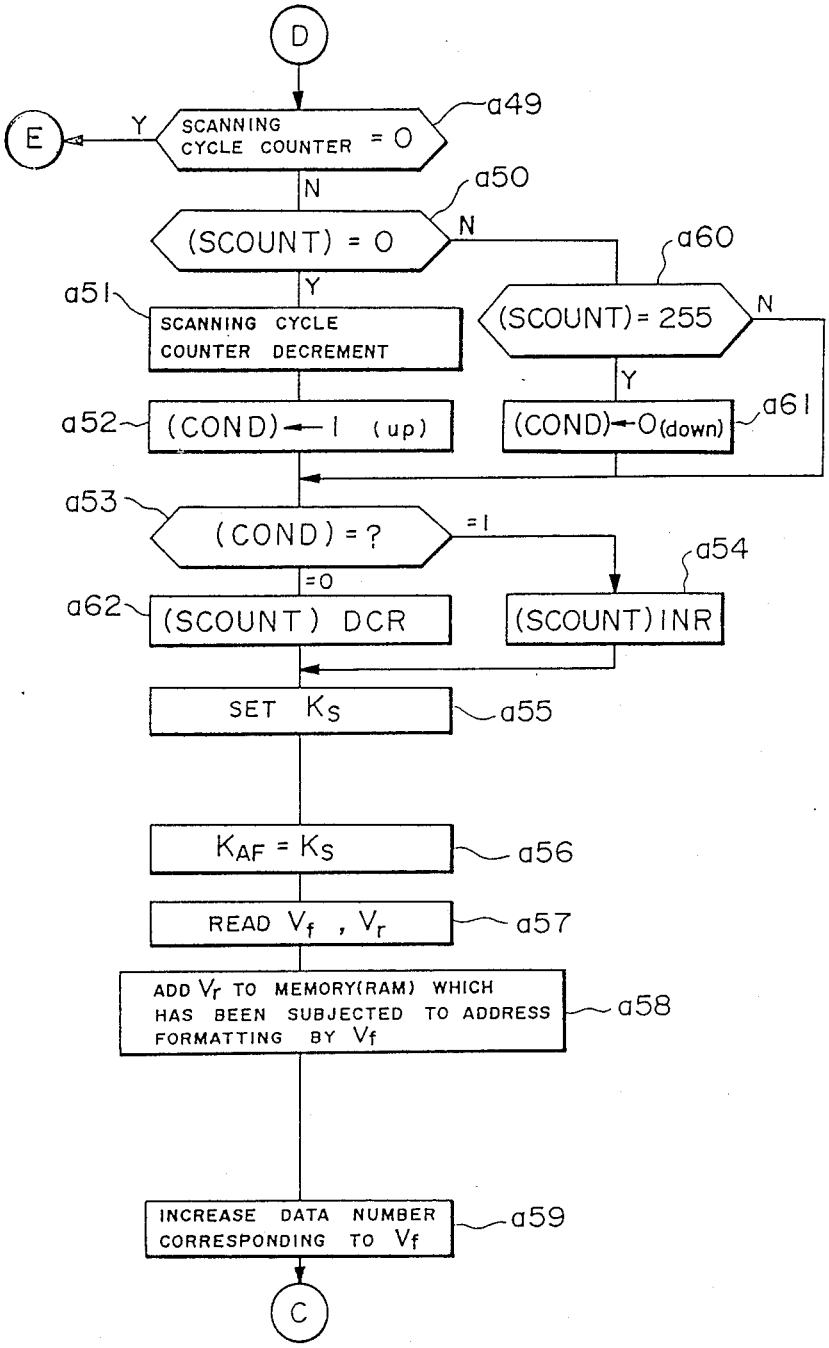
Figure 4E:
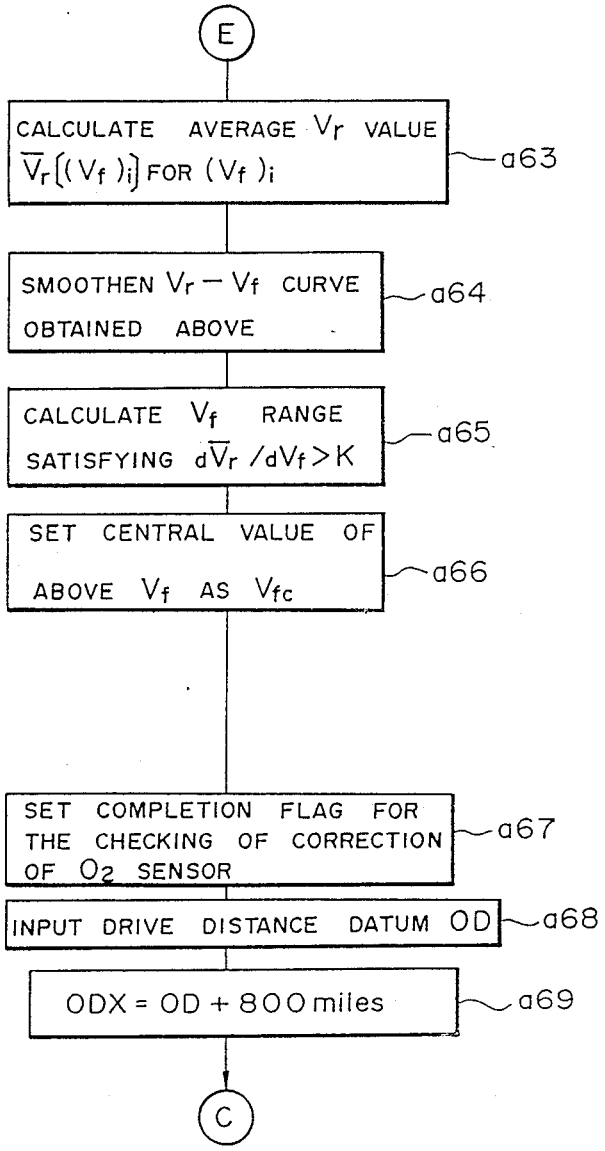

An engine system controlled by the system of this invention may be illustrated as shown on FIG. 3, in which an engine E has an intake passage 2 and an exhaust passage 3, both, communicated to a combustion chamber 1. The communication between the intake passage 2 and combustion chamber 1 is controlled by an intake valve 4, while that of the discharge passage 3 with the combustion chamber 1 is controlled by an exhaust valve 5.

In addition, the intake passage 2 is provided with an air cleaner 6, a throttle valve 7 and an electromagnetic fuel injection valve (solenoid valve) 8 in order from the upstream side thereof. The exhaust passage 3 is provided with a catalytic converter (three-way catalyst) 9 for cleaning exhaust gas and an unillustrated muffler in order from the upstream side thereof.

Incidentally, solenoid valves of the same type as the solenoid valve 8 are provided as many as the number of cylinders in an intake manifold portion. Let's now assume that the engine E is an in-line 4-cylinder engine in the present embodiment. Four solenoid valves 8 are hence provided. In other words, the engine E can be said to be an engine of the so-called multi-point fuel injection (MPI) system.

The throttle valve 7 is connected via an unillustrated wire cable to an accelerator pedal (not shown) so that the opening rate of the throttle valve 7 changes in accordance with the degree of depression of the accelerator pedal. In addition, the throttle valve 7 is also driven by an idling speed control motor (ISC motor), whereby the opening rate of the throttle valve 7 can be varied without need for depression of the accelerator pedal upon idling.

Owing to the above-described construction, air which has been drawn in accordance with the opening rate of the throttle valve 7 through the air cleaner 6 is mixed with a fuel from the solenoid valve 8 in the intake manifold portion so as to give a suitable air/fuel ratio. The resulting air-fuel mixture is ignited at suitable timing by an unillustrated spark plug in the combustion chamber 1, so that the air-fuel mixture is caused to burn. After producing an engine torque, the air-fuel mixture is discharged as exhaust gas into the exhaust passage 3 and subsequent to cleaning of three noxious components CO, HC, $NO_x$ in the exhaust gas by the catalytic converter 9, the exhaust gas is reduced in noise by an unillustrated muffler and then released into the surrounding atmosphere.

A variety of sensors is provided in order to control the engine E. On the side of the intake passage 2 first of all, there are provided an airflow sensor 11 for detecting the quantity of intake air from Karman vortex information, an intake air temperature sensor 12 for detecting the temperature of the air drawn and a barometric pressure sensor 13, all, in the portion where the air cleaner is provided. In a portion where the throttle valve is installed, there are provided a throttle sensor 14 of the potentiometer type, said throttle sensor 14 being adapted to detect the opening rate of the throttle valve 17, an idle switch 15 for detecting the state of idling, and a motor position sensor 16 for detecting the position of the ISC motor 10.

Further, on the side of the exhaust passage 3, a forward $O_2$ sensor 17 as a first oxygen density sensor for detecting the oxygen ($O_2$) density in the exhaust gas is provided first of all at a position upstream of the catalytic converter 9, and a rearward $O_2$ sensor 18 as a second oxygen density sensor for also detecting the $O_2$ density in the exhaust gas is then arranged at a position downstream of the catalytic converter 9. Here, the forward $O_2$ sensor 17 and rearward $O_2$ sensor 18 both make use of the principle of oxygen concentration cells of a solid electrolyte. They have such a characteristic that their output voltages change abruptly near the stoichiometric air/fuel ratio. Their voltages are low on the side leaner than the stoichiometric air/fuel ratio but high on the side richer than the stoichiometric air/fuel ratio.

Incidentally, the rearward $O_2$ sensorl8 may be provided inside the catalytic converter 9 as is shown by way of example in FIG. 3(*a*).

As other sensors, in addition to a water temperature sensor 19 for detecting the temperature of the cooling water for the engine and a vehicle speed sensor 20 (see FIG. 2) for detecting the vehicle speed, a crank angle sensor 21 for detecting the crank angle (which also serves as a revolutionary speed sensor for detecting the revolutionary speed of the engine) and a TDC sensor 22 for detecting the top dead center of a first cylinder (base cylinder) are also provided with the distributor.

Detection signals from these sensors 11–22 are inputted to an electronic control unit (ECU) 23.

Also inputted to the ECU 23 are a voltage signal from a battery sensor 25 for detecting the voltage of a battery 24 and a signal from an ignition switch (key switch) 26.

Figure 2:
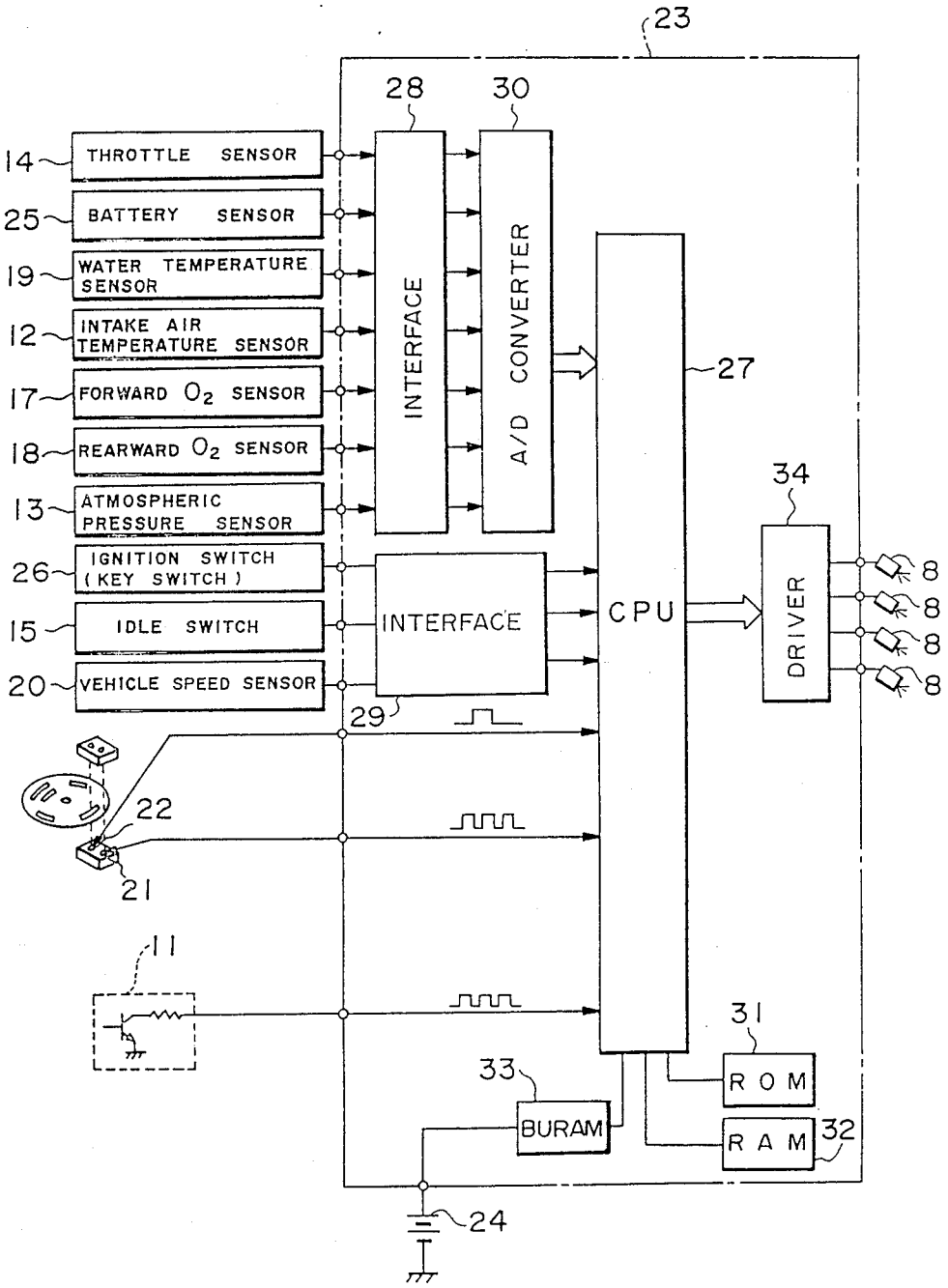
FIG. 2 is a block diagram of the control system, which depicts its hardware primarily.

The hardware construction of the ECU 23 may be illustrated as shown in FIG. 2. The ECU 23 is equipped with a CPU 27 as its main element. The CPU 27 is fed with detection signals from the intake air temperature sensor 12, barometric sensor 13, throttle sensor 14, forward $O_2$ sensor 17, rearward $O_2$ sensor 18 and battery sensor 25 by way of an input interface 28 and/or an A/D converter 30. Detection signals from the idle sensor 15, vehicle speed sensor 20 and ignition switch 26 are also inputted through an input interface 29, while detection signals from the air flow sensor 11, crank angle sensor 21 and TDC sensor 22 are inputted directly to the input port.

Via bus lines, the CPU 27 performs transfer of data with an ROM 31 which serves to store program data and fixed-value data, an RAM which is renewed and rewritten sequentially, and a battery backed-up RAM (BURAM) 33 which is backed up by the battery 24 to maintain its contents while the battery 24 is connected.

Incidentally, the RAM 32 is designed in such a way that data stored therein are erased and reset when the ignition switch 26 is turned off.

Let's now pay attention only to the control of fuel injection (air/fuel ratio control). A fuel injection control signal which has been computed in a manner to be described subsequently is ouputted via a driver 34, whereby the 4 solenoid valves 8 by way of example are successively actuated.

Figure 1A:
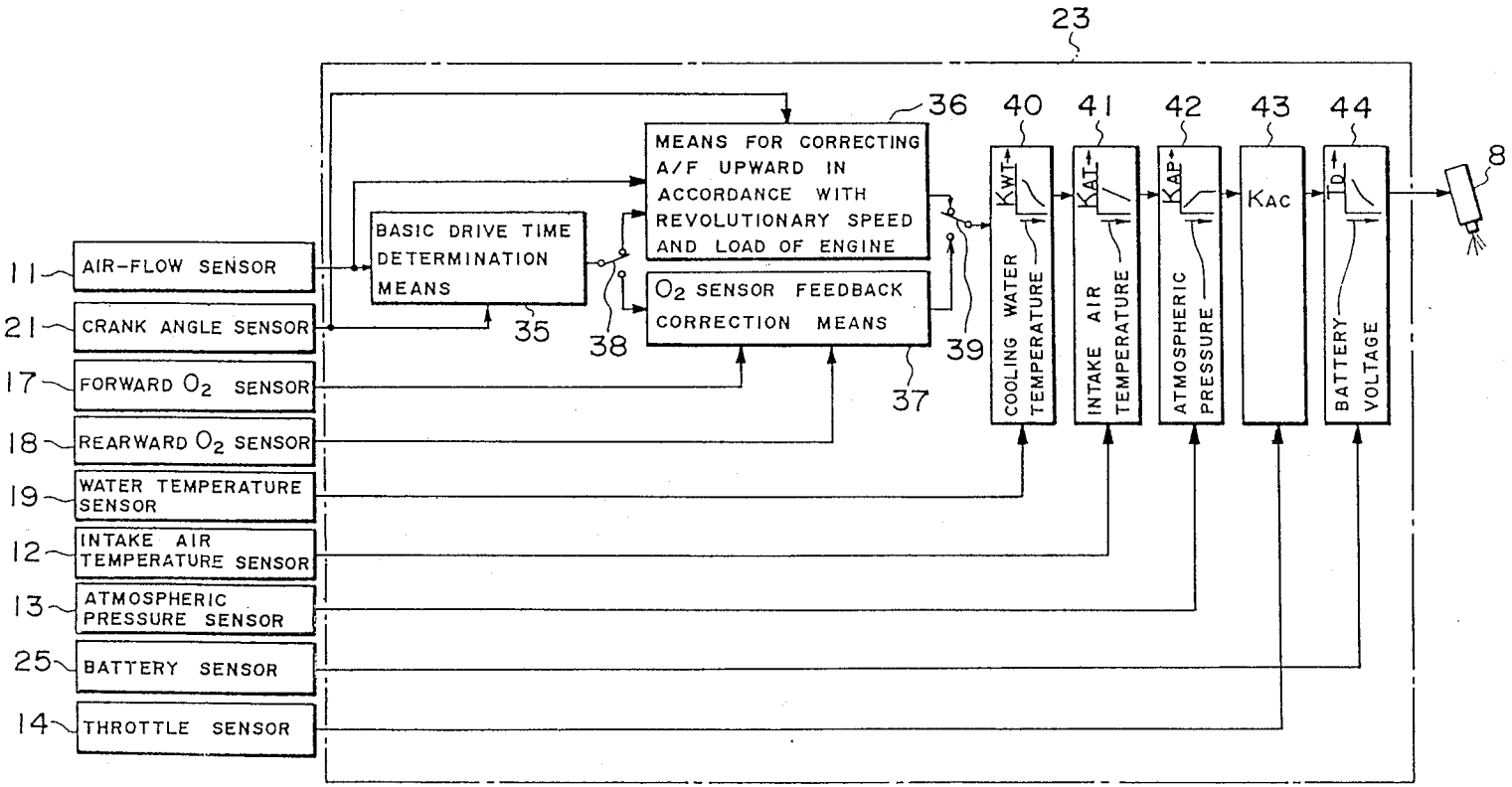
Figure 1B:
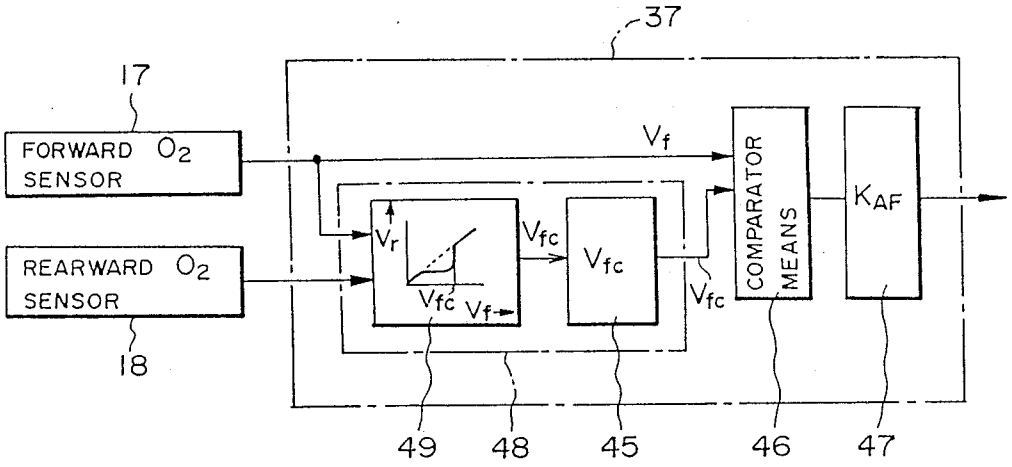

A function block diagram of such a fuel injection control (the control of the drive time of each solenoid valve) may be illustrated as shown in FIG. 1(*a*). Let's now make a discussion on the ECU 23 from the standpoint of its software. First of all, the ECU 23 is equipped with a basic energization time determination means 35 for determining the basic drive time $T_B$ for the solenoid valves 8. The basic energization time determination means 35 determines information on the intake air volume per revolution of the engine (Q/Ne) on the basis of information on an intake air quantity Q from the airflow sensor 11 and information on engine revolutionary speed Ne from the crank angle sensor 21 and then determines a basic drive time $T_B$ on the basis of the information.

There are also provided an air/fuel ratio upward correction means 36 for performing an upward correction of the air/fuel ratio in accordance with the revolutionary speed of the engine and the engine load (the above Q/Ne information contains engine load information) and an $O_2$ sensor feedback correction means 37 for conducting corrections of the $O_2$ sensors by setting a correction factor $K_{AF}$ upon performing the feedback control of the $O_2$ sensors. Either one of the air/fuel ratio upward correction means 36 and $O_2$ sensor feedback correction means 37 is selected by switching means 38,39 which are changed over in a mutually-interlocked manner.

Also provided are a water-temperature-dependent correction means 40 for setting a correction factor $K_{WT}$ in accordance with the temperature of the cooling water for the engine, an intake-air-temperature-dependent correction means 41 for setting a correction factor $K_{AT}$ in accordance with the temperature of the air drawn, a barometric-pressure-dependent correction means 42 for setting a correction factor $K_{AP}$ in accordance with the barometric pressure, an accelerating-fuel-increment correction means 43 for setting a correction factor $K_{AC}$ for the increment of fuel quantity for acceleration, and a dead time correction means 44 for setting a dead time (ineffective time) $T_D$ for correcting the drive time in accordance with the voltage of the battery. During $O_2$ feedback control, the drive time $T_{INJ}$ of the solenoid valve 8 is eventually expressed by $T_B \times K_{WT} \times K_{AT} \times K_{AP} \times K_{AC} \times K_{AF} + T_D$ and the solenoid valve 8 is actuated for the drive time $T_{INJ}$.

Figure 5:
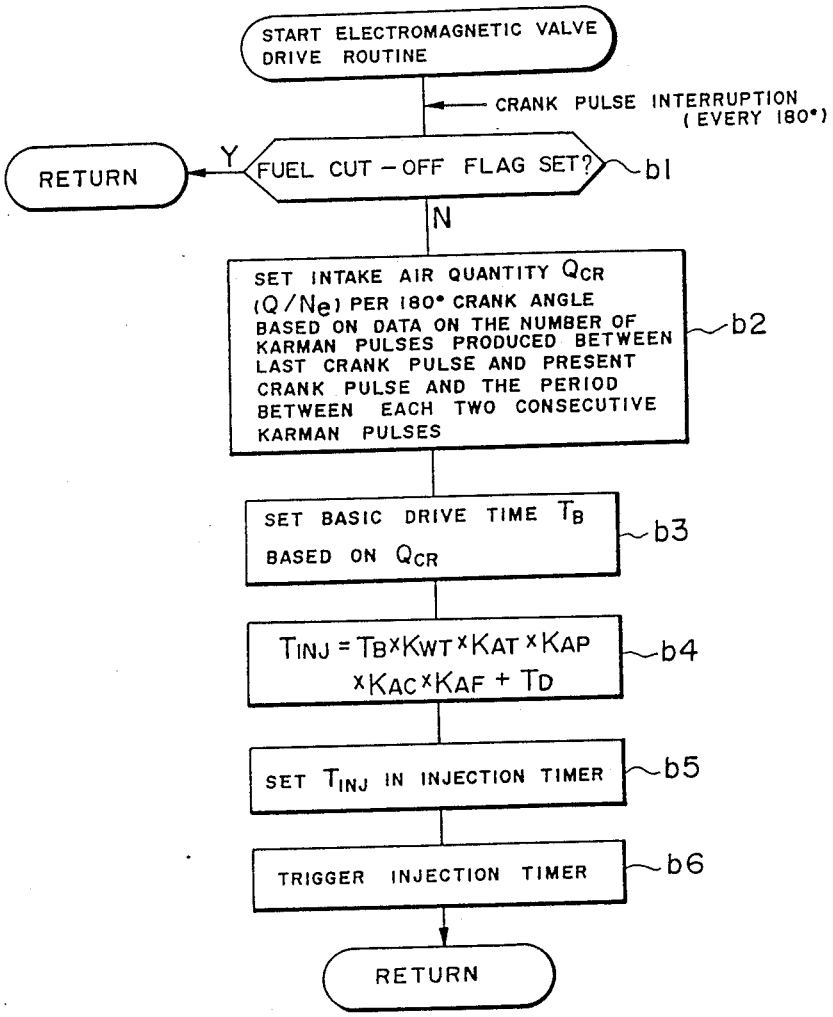
FIG. 5 is a flow chart for describing an electromagnetic valve drive routine for the control system.

The procedure of such a control of the actuation of the solenoid valve may be illustrated like the flowchart of FIG. 5. The routine of the flow chart shown in FIG. 5 is performed by a crank pulse interruption which takes place every 180°. First of all, it is judged in Step bl whether a fuel cut-off flag has been set up or not. Where the fuel cut-off flag has been set up, no fuel injection is required and the routine returns. Otherwise, an intake air quantity $Q_{CR}$(Q/Ne) per 180° crank angle is set up in Step b2 on the basis of data on the number of Karman pulses produced between the last crank pulse and the present crank pulse and the period between the Karman pulses.

The routine then advances to Step b3, where the basic drive time $T_B$ is set up in accordance with the $Q_{CR}$. The solenoid valve drive time $T_{INJ}$ is then determined in Step b4 by computing it in accordance with $T_B \times K_{WT} \times K_{AT} \times K_{AP \times KAC} \times K_{AF} + T_D$. The $T_{INJ}$ is set in an injection timer in Step b5 and is then triggered in Step b6. By this trigger, the fuel is injected only for the time $T_{INJ}$.

During the air/fuel ratio feedback control making use of the $O_2$ sensors, an output $V_f$ from the forward $O_2$ sensor 17 is compared with a predetermined standard value $V_{fc}$, which is selected at an intermediate level between a high-level output and a low-level output of the forward $O_2$ sensor 17 and functions as a so-called rich/lean judgement voltage. The air-fuel mixture is rendered richer when $V_{fc} > V_f$ but is rendered leaner when $V_{fc} \leqq V_f$.

Accordingly, the $O_2$ sensor feedback correction means 37 has, as depicted in FIG. 1(*b*), a rich/lean judgement voltage setting means 45 for setting the standard value $V_{fc}$, a comparator means 46 for comparing the output $V_f$ from the forward $O_2$ sensor 17 with the standard value $V_{fc}$ from the rich/lean judgement voltage setting means 45, and a correction factor determination means 47 for determining the air/fuel ratio correction factor $K_{AF}$ in accordance with comparison results from the comparator means 46. Different from conventional systems, the present air/fuel ratio control system is equipped with a standard value changing means 48 for allowing to change the standard value (rich/lean judgement voltage) $V_{fc}$ on the basis of the outputs $V_f$ and $V_r$ from the forward $O_2$ sensor 17 and rearward $O_2$ sensor 18, for example, for every predetermined drive distance or after every battery disconnection.

A description will next be made of reasons for which the standard value can be changed and corrected to a more reasonable rich/lean judgement voltage $V_{fc}$ on the basis of both outputs $V_f$ and $V_r$ from the forward $O_2$ sensor 17 and rearward $O_2$ sensor 18.

Let's now plot outputs $V_f$ of the forward $O_2$ sensor 17 along the axis of abscissas and outputs $V_r$ of the rearward $O_2$ sensor 18 along the axis of ordinates so as to determine the relation between both outputs $V_f$ and $V_r$. They are found to have such characteristics as shown by a solid curve in FIG. 8(*b*). When such characteristics is compared with the characteristics of $NO_x$ cleaning efficiency [see FIG. 8(*a*), solid curve] and the characteristics of CO.HC cleaning efficiency [see FIG. 8(*a*), broken curve], it is appreciated that an output value $V_{fc}$ of the forward $O_2$ sensor 17 giving the maximum cleaning efficiencies shown in FIG. 8(*a*) (i.e., at the stoichiometric air/fuel ratio) coincides with an output value $V_{fc}$ of the forward $O_2$ sensor 17 at which the characteristics depicted in FIG. 8(*c*) change abruptly.

An air/fuel ratio at which $V_r$ changes extremely great relative to a change of the output $V_f$ has been found to be an air/fuel ratio capable of giving high cleaning efficiencies for the three components of HC, CO and $NO_x$ (i.e., the stoichiometric air/fuel ratio), irrespective of variations in characteristics from one $O_2$ sensor to another, changes of the characteristics of each $O_2$ sensor along the passage of time, and the like.

Figure 8A:
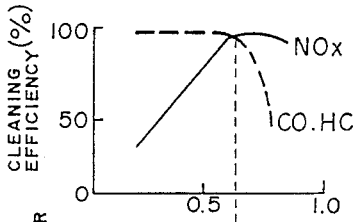
FIGS. 8(*a*) through 8(*c*) are respectively graphs for illustrating the operation of the control system.
Figure 8B:
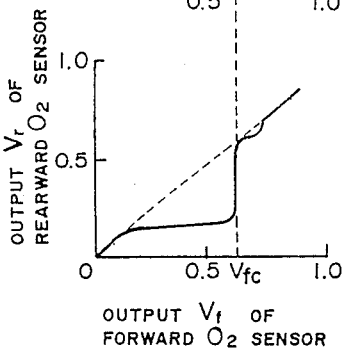

The output characteristics of the forward $O_2$ sensor 17 and rearward $O_2$ sensor 18 are illustrated as shown in FIG. 8(b) for the following reasons. When unburnt components such as CO are contained in an exhaust gas, the output levels of the $O_2$ sensors increase. Even when the air/fuel ratio is lean, the same reasons because unburnt gases such as HC, CO and $H_2$ exist on the upstream side of the catalytic converter 9. On the other hand, the output of the rearward $O_2$ sensor 18 does not increase since such unburnt gases have been cleaned by the catalytic converter 9 on the downstream side of the catalytic converter 9 and also inside the catalytic converter 9. Since these relationship becomes very clear in the vicinity of the stoichiometric air/fuel ratio characteristics such as those depicted in FIG. 8(*b*) are obtained.

For the reasons mentioned above, the standard value changing means 48 is equipped with a characteristics computing means 49 which is adapted to compute the characteristics in relationship between the output of the forward $O_2$ sensor 17 and that of the rearward $O_2$ sensor 18. An output value $V_{fc}$ of the forward $O_2$ sensor 17, which has been determined by the characteristic computing means 49, is stored as a new rich/lean judgement voltage $V_{fc}$. This function of renewal is provided with the rich/lean judgement voltage setting means 45.

Incidentally, the $V_f$-$V_r$ characteristics and the standard value $V_{fc}$ for rich/lean judgement are stored in the BRUAM 33.

The main routine of the air/fuel ratio control system, which includes the above-described changing of the standard value, the determination of the correction factor and the like, will next be described in detail with reference to FIGS. 4(*a*) through 4(*e*). Although these FIGS. 4(*a*) through 4(*e*) illustrate a single flow chart, the flow chart is very long and for the sake of convenience, has hence been divided at the appropriate parts into the five figures.

In the main flow, the routine is started firstly as depicted in FIG. 4(*a*) when a key switch (ignition switch) is turned on. First of all, the RAM 32 and interfaces are initialized in Step a1. It is next judged in Step a2 whether the battery 24 has been disconnected or not. Since the battery 24 is kept connected generally, the NO route is followed and a drive distance datum OD is inputted in Step a3.

The routine then advances to Step a4, where the OD datum is compared with a standard-value-rewriting distance ODX which is backed up by the battery. When not OD>ODX, namely, the drive distance has not yet reached the standard-value-rewriting distance, operational state information is inputted in Step a5. In the next Step a6, it is judged whether the operational state is in a fuel cut-off zone or not. When it is not in the fuel cut-off zone, a fuel cut-off flag is reset in Step a7, followed by setting of the correction factors $K_{WT}$, $K_{AT}$, $K_{AP}$ and $K_{AC}$ in Step a8. The dead time $T_D$ is then set in Step a9. These factors are set by the cooling-water-temperature-dependent correction means 40, intake-air-temperature-dependent correction means 41, barometric-pressure-dependent correction means 42, accelerating fuel-increment correction means 43 and dead time correction means 44, respectively.

In Step a10, it is next judged from the output voltage value of the forward $O_2$ sensor 17 whether the sensor is in an active state or not.

If the forward $O_2$ sensor 17 is active as shown in FIG. 4(*b*), the routine advances to the next Step a12 in which a judgement is made to determine whether it is in the air/fuel ratio (A/F) feedback mode or not. When the temperature of the cooling water is higher than a predetermined value in a prescribed operation zone (A/F zone) which is determined by the load and revolutionary speed of the engine, the operation is judged in the A/F feedback mode.

In the case of the A/F feedback mode, it is judged in Step a13 whether a completion flag for the checking of the $O_2$ sensor correction has been set or not. Since Step a71 is usually jumped over, the completion flag has been set. The routine therefore advances along the YES route, and in Step a14, the output $V_f$ of the forward $O_2$ sensor 17 and the rich/lean judgement voltage $V_{fc}$ are compared with each other. When $V_{fc}>V_f$, it is judged in Step a15 whether a without feedback flag (hereinafter called "WOFB flag") has been set or not. Since WOFB flag is in a set state at the time point immediately after the A/F feedback zone has been entered, the routine takes the YES route, the proportional gain P is changed to 0 in Step a16-1, WOFB flag is reset in Step a16-2, and Flag L is changed to 1 in Step a16-3.

Here, Flag L indicates enrichment by 1 and leanness by 2. The term "leanness" as used herein should be interpreted to mean that an air-fuel mixture is rendered leaner.

After Step a16-3, the feedback correction factor $K_{FB}$ is determined as $1+P+I$ in Step a17 and this value $K_{FB}$ is inputted to an address $K_{AF}$ in Step a21. At the beginning, the proportional gain $P=0$ and the integral factor $I=0$. The routine therefore starts with $K_{FB}=1$.

The initial setting of a scan counter is then performed in Step a24. A suitable value other than 0 is chosen as an initial value at this time. The scan counter is also used upon changing and renewal of the standard value as will be described subsequently. In Step a24, n sets of $V_f$ counters which will also be used at the same time as the scan counter are reset in advance.

The cycle number SCOUNT, which will also be used upon changing and renewal of the standard value as will also be described subsequently, is reduced to 0 in Step a25, and the routine then returns to Step a5 of FIG. 4(*a*).

When the routine has returned again to Step a15, the NO route is taken this time since WOFB flag has been reset in Step a16-2. In Step a16-4, it is judged whether Flag L is 1 or not. When L is judged to be 1 in Step a16-3, the YES route is taken to perform the processing of Step a17.

Figure 6B:
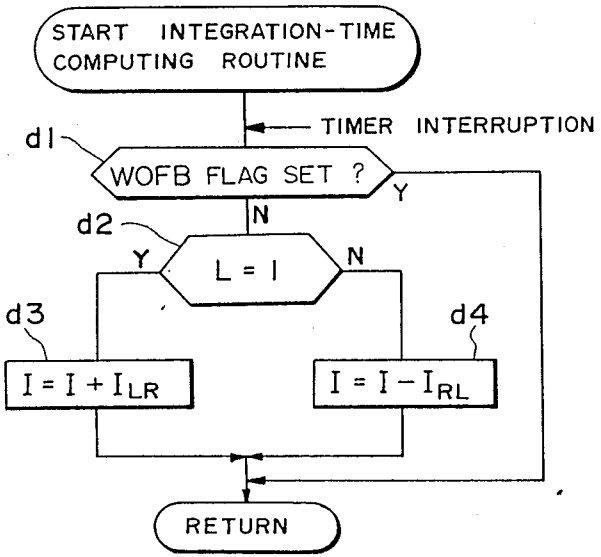
FIG. 6(*a*) is a flow chart for describing a timer subtraction routine for the control system.
Figure 6A:
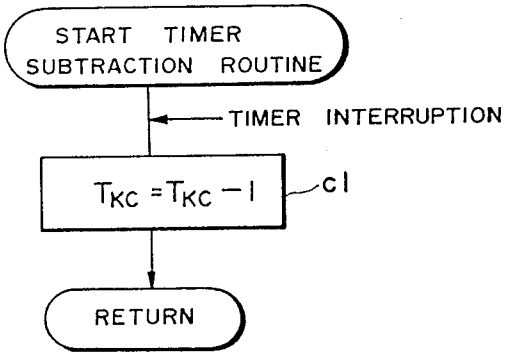

Incidentally, the integration-time computing routine for the integral factor I can be illustrated like the flow chart of FIG. 6(*b*). In this routine, at every interruption of the timer, it is judged in Step d1 whether WOFB flag has been set or not. When WOFB flag has been found to be reset (when the operation is in the A/F feedback mode), it is judged in Step d2 whether Flag L is 1 or not. If $L=1$, the sum of I and $I_{LR}$ (an integral factor for enrichment) is obtained newly as I in Step d3. Unless $L=1$, the difference obtained by subtracting $I_{RL}$ (an integral factor for leanness) is obtained newly as I. $I_{LR}$ is therefore added at every timer interruption while $L=1$. While L is not 1 (i.e., $L=2$), $I_{RL}$ is subtracted at every time interruption. Accordingly, the feedback correction factor $K_{FB}$ becomes greater while $I_{LR}$s are added successively, so that the enrichment is promoted further. While $I_{RL}$s are subtracted successively, the feedback correction factor $K_{FB}$ becomes smaller so as to promote the leanness.

Since $L=1$ in this case, $I_{LR}$ is added at every time interruption and the feedback correction factor $K_{FB}$ becomes greater. The enrichment is therefore promoted.

When $V_{fc}$ becomes equal to or smaller than $V_f$ ($V_{fc} \leqq V_f$) as a result of enrichment in the above-described manner, the NO route is taken in Step a14, and it is judged in Step a18 whether WOFB flag has been set or not. When the operation is still in the A/F feedback mode, WOFB flag is still in the reset state. The NO route is therefore followed in Step a18, and in Step a19-1, a judgement is made to determine whether Flag L is 2 or not. Since L=1 immediately after the switching, the proportional gain $P_{RL}$ for leanness is subtracted from the proportional gain P in Step a19-2 so as to use the difference as P. After changing L to 2(L=2) in Step a19-3, the feedback correction factor $K_{FB}$ is determined as 1+P+I in Step a17. This value $K_{FB}$ is then inputted to the address $K_{AF}$ in Step a21. As a consequence, the feedback correction factor $K_{FB}$ is decreased by the proportional gain $P_{RL}$ for leanness from its maximum value.

Thereafter, the initial setting of the scan counter is performed in Step a24 and after reducing the cycle number SCOUNT to 0 in Step a25, the routine returns to Step a5 of FIG. 4(*a*).

When the routine has returned again to Step a19-1 via Step al8, the YES route is taken this time because L has been changed to 2 in Step a19-3. The processing of Step a17 is therefore applied.

Since L=2 in this case, at every timer interruption, the NO route is taken in Step d2 of FIG. 6(*b*) and $I_{RL}$ is subtracted in Step d4 of the same figure, and the feedback correction factor $K_{FB}$ becomes smaller. The leanness is therefore promoted.

When $V_{fc}$ becomes greater than $V_f$ ($V_{fc}>V_f$) as a result of leanness in the above-described manner, the YES route is taken in Step a14, and it is judged in Step a15 whether WOFB flag has been set or not. When the operation is still in the A/F feedback mode, WOFB flag is still in the reset state. The NO route is therefore followed in Step a15, and in Step a16-4, a judgement is made to determine whether Flag L is 1 or not. Since L=2 immediately after the switching, the proportional gain $P_{LR}$ for enrichment is added to the proportional gain P in Step a16-5 so as to use the sum as P. After changing L to 1 (L=1) in Step a16-3, the feedback correction factor $K_{FB}$ is determined as 1+P+I in Step a17. This value $K_{FB}$ is then inputted to the address $K_{AF}$ in Step a21. As a consequence, the feedback correction factor $K_{FB}$ is increased by the proportional gain $P_{LR}$ for enrichment from its minimum value.

Figures 7A, 7B, 7C:
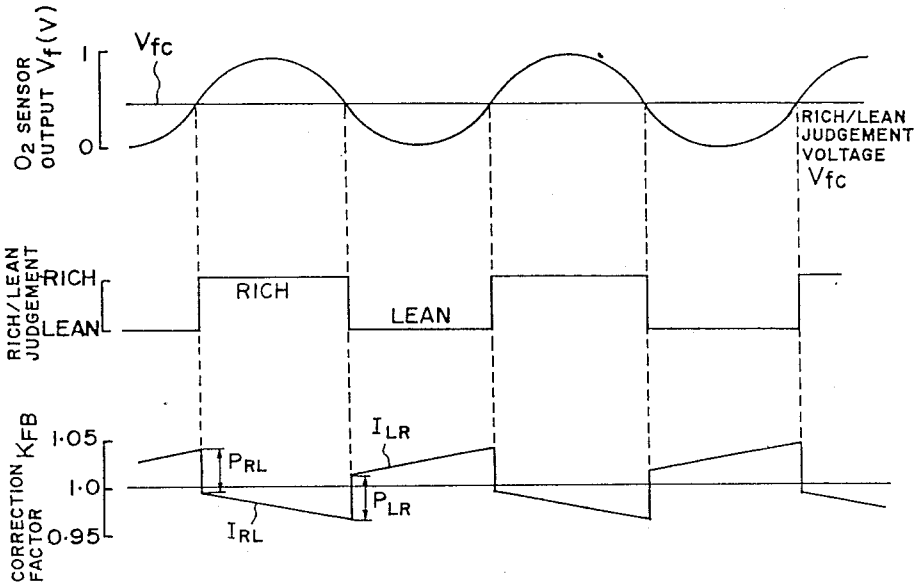
FIGS. 7(*a*)–7(*c*) are a graph for illustrating an air/fuel ratio feedback factor for the control system.

By repeating the above processing thereafter, the feedback correction factor $K_{FB}$ is varied as shown in FIG. 7(*c*) so that the desired air/fuel ratio control is performed in the A/F feedback mode.

Incidentally, FIG. 7(*a*) is a waveform diagram of the output of the forward $O_2$ sensor, while FIG. 7(*b*) is a waveform diagram for the rich/lean judgement.

When $V_{fc} \leqq V_f$ immediately after entering the A/F feedback zone, the YES route is followed in Step a18 since WOFB flag is in a set state at the time point immediately after the entering. The proportional gain P is changed to 0 in Step a19-4, WOFB flag is reset in Step a19-5, and Flag L is changed to 2 in Step a19-3. After Step a19-3, the feedback correction factor $K_{FB}$ is determined as 1+P+I in Step a17 and this value $K_{FB}$ is inputed to the address $K_{AF}$ in Step a21. Here again, the proportional gain and integral factor I are both 0 (P=0, I=0) at the beginning, and the routine also starts from $K_{FB}=1$.

As has been described above, it is the comparator means 46 and correction factor determination means 47 in the $O_2$ sensor feedback correction means 37 that perform the comparison between $V_{fc}$ and $V_f$ and determine the correction factor $K_{AF}$ on the basis of results of the comparison.

When the operation is found to be in the fuel cut-off zone in Step a6 subsequent to Step a5 and a fuel cut-off flag is set in Step a27 as shown in FIG. 4(*a*), the integral factor I is changed to 0 in Step a28 as depicted in FIG. 4(*b*), an initial value (for example, 10 seconds or so) is inputted to the timer $T_{KC}$ in Step a29, and a mapped A/F correction factor $K_{AFM}$ is set in accordance with the load and revolutionary speed of the engine. The mapped A/F correction factor $K_{AFM}$ is inputted to the address $K_{AF}$ in Step a31, and after setting WOFB flag in Step a31-2, the routine returns to Step a5 via Steps a24 and a25. Since WOFB flag has been set in Step a31-2, WOFB flag is in a set state at the time point immediately after entering the A/F feedback mode.

When the answer is "NO" in Step a10 or a12, it is impossible to perform the A/F feedback control. The routine therefore returns to Step a5 via Steps a28, a31, a31-2, a24 and a25.

During usual driving, the above routine is performed repeatedly so as to set the factors $K_{WT}$, $K_{AT}$, $K_{AP}$, $K_{AC}$, $K_{AF}$ and the time $T_D$ in accordance with the state of the engine. By performing the solenoid valve drive routine depicted in FIG. 5 by using these values, each solenoid valve 8 is actuated to inject a desired quantity of the fuel. In this manner, the desired air/fuel ratio control is effected.

When the drive distance OD (operation time) reaches the standard value rewriting distance ODX (predetermined operation time), the YES route is taken in Step a4 and the flag for the completion of checking of the $O_2$ sensor is reset in Step a71. Incidentally, the operation time of an engine can be typified by the drive distance where the engine is mounted on a vehicle. This may however be the time period of an actual operation. The term "drive distance" as used hereinafter may also mean "operation time".

Thereafter, the routine advances through Step a5 and performs the processing of Step a6. When the operation is found to be outside the fuel cut-off zone in Step a6, the routine advances through Steps a7–a9 and the processings of Steps a10–a12 are performed. When the answer is "YES" in each of Steps a10,a12, it is judged in Step a13 whether the flag for the completion of checking of the $O_2$ sensor has been set or not. Since it has been reset in Step a71 in this case, the routine advances through the NO route and then moves to Steps a11,a32-,a33 illustrated in FIG. 4(*c*).

In Step a11, a judgement is made to determine whether the rearward $O_2$ sensor is in an active state or not. In Steps a32,a33, it is judged whether the revolutionary speed Ne of the engine is 3,000 rpm or lower and whether it is 1,500 rpm or higher. When both answers are "YES", it is judged in Step a34 whether the engine fluctuation $|dNe/dt|$ is smaller than a preset value $DN_x$. When it is smaller, it is judged in Steps a35,a36 whether the intake air quantity Q is greater than a preset value $Q_x$ and whether the intake air fluctuation $|dQ/dt|$ is smaller than a preset value $DQ_x$. When both answers are "YES", it is judged in Step a37 whether the fluctuation $|d\theta/dt|$ of the throttle opening rate $\theta$ is smaller than a preset value $DTH_x$. When the answer is also "YES" in Step a37, a further judgement is made in Step a39 to determine whether the timer $T_{KC}$ is 0 or not.

Incidentally, the timer $T_{KC}$ is designed to operate at every time interruption in accordance with the timer subtraction routine shown in FIG. 6(*a*). The timer subtracts 1 from the contents of $T_{KC}$ to give new contents, in other words, performs a downcount.

When the timer $T_{KC}$ is not 0, the routine returns to the processings of Step a14 and its subsequent steps depicted in FIG. 4(*b*).

When the answers of Steps a32,a37 are both "NO", an initial value (the same value as that inputted in Step a29) is inputted to the timer $T_{KC}$ and the routine returns to the processings of Step a14 and its subsequent steps shown in FIG. 4(*b*).

Even when the drive distance datum OD has reached the standard value rewriting distance ODX, the routine does not therefore advance to the standard value rewriting processing and is caused to return to the side of the routine work for normal driving so long as both $O_2$ sensors 17,18 are not in an active state, the operation is not in the A/F feedback mode (in which the operation range is set in a relatively stable operation range), the revolutionary speed Ne of the engine does not fall between 1,500 and 3,000 (inclusive, i.e., $1{,}500 \leqq Ne \leqq 3{,}000$), the engine fluctuation is large, the intake air quantity is little, or the intake air fluctuation or throttle opening rate fluctuation is great.

Even when all the above conditions are met, the routine does not advance either to the standard value rewriting processing and is caused to return to the side of the routine work for normal driving until the lapse of prescribed period of time (a time period corresponding to the initial value of the timer $T_{KC}$) after the full satisfaction of the conditions.

When all the above conditions are met and the prescribed period of time has lapsed (these conditions will hereinafter be called "standard value rewriting conditions"), WOFB flag is set in Step a39-2 and in Step a49 of FIG. 4(*d*), it is judged whether the scan cycle counter is 0 or not. Since the initial value other than 0 has been set at the beginning in Step a24 of FIG. 4(*b*), the NO route is taken and in Step a50, it is judged whether the cycle number SCOUNT is 0 or not. In this case, the cycle number has been set at 0 in Step a25 shown in FIG. 4(*b*). The routine therefore advances along the YES route to Step a51, where decrement (DCR) processing is applied so that the contents of the scan counter are decreased by 1. Flag COND is changed to 1 in the next Step a52 to judge the state of Flag COND in Step a53. Since COND is 1 in this case, the cycle number SCOUNT is increased by 1 step in Step a54.

Thereafter, the air/fuel ratio factor $K_S$ is determined by $1+(1-SCOUNT/128)\times 0.05$ (since SCOUNT is 1 in this case, $K_S \simeq 1.05$) in Step a55. In Step a56, the factor $K_{AF}$ is determined from $K_S$ to shift the air/fuel ratio to the rich side intentionally. Thereafter, the output $V_f$ of the forward $O_2$ sensor 17 and the output $V_r$ of the rearward $O_2$ sensor are read in Step a57. In Step a58, $V_r$ is added to the memory (RAM) which has been address-formatted by $V_f$. In Step a59, the number of data corresponding to the thus-added $V_f$ is increased by 1. In this case, an address number sufficient to prepare the $V_f-V_r$ characteristic diagram shown in FIG. 8(*b*) is chosen as the address number of the memory. The inverse number of this address number is equivalent to the resolution. The $V_f$ counters are provided as many as the address number (n) of the memory, and when $V_r$ is stored at a corresponding address, the count number is increased by 1.

After the above-described Step a59, the routine returns to Step a5 of FIG. 4(*a*). When the routine advances through the NO route in Step a6, the NO route in Step a13 of FIG. 4(*b*) and the YES route in Step a39 and returns again to Step a49 shown in FIG. 4(*d*), the NO route is taken because the scan cycle counter is still not 0. In Step a50, a judgement is made to determine whether SCOUNT is 0 or not. Since SCOUNT has been set at 1 in Step a54 in this case, the NO route is taken in Step a50 and in Step a60, it is judged whether SCOUNT is 255 or not. Since the answer is "NO" in this case, Step a61 is jumped over and a judgement is made in Step a53 to determine the state of Flag COND. Since the state of COND which has been set at 1 in Step a52 has not been cancelled in this case, SCOUNT is again increased by 1 in Step a54. Accordingly, the factor $K_S$ is set by introducing 2/128 as the term SCOUNT/128 in Step a55. After the factor $K_{AF}$ is determined to shift the air/fuel ratio to the lean side a little, the individual outputs $V_f$ and $V_r$ of the forward $O_2$ sensor 17 and rearward $O_2$ sensor 18 are read, and $V_r$ is added to the memory which has been address-formatted by $V_f$. After increment of a datum number corresponding to $V_f$ thus added (Steps a56 and a59), the routine returns to Step a5 of FIG. 4(*a*) and as in the foregoing, again to Step a49 of FIG. 4(*d*).

Thereafter, the above-described processings are repeated until SCOUNT reaches 255 (SCOUNT=255). The air/fuel ratio is shifted successively from the rich side to the lean side (from about 1.05 to about 0.95 in terms of $K_S$ value) in the above-described manner. By reading the individual outputs $V_f$,$V_r$ of the forward $O_2$ sensor 17 and rearward $O_2$ sensor 18 in the course of the shifting of the air/fuel ratio, it is possible to measure the $V_f$-$V_r$ characteristics upon shifting of the air/fuel ratio from the rich side to the lean side around the stoichiometric air/fuel ratio.

When SCOUNT reaches 255, the routine is switched to the YES route in Step a60 and Flag COND hence changes to 0 (Step a61).

Accordingly, the processing of Step a62 is then performed subsequent to Step a53. Namely, the cycle number SCOUNT is decreased by 1 step.

The air/fuel ratio factor $K_S$ is thereafter determined by $1+(1-SCOUNT/128)\times 0.05$ (since SCOUNT is 254 in this case, $K_S \simeq 0.95$). After determining the factor $K_{AF}$ as $K_S$ in Step a56, the output $V_f$ of the forward $O_2$ sensor 17 and the output $V_r$ of the rearward $O_2$ sensor 18 are read in Step a57. In Step a58, $V_r$ is added to the memory (RAM) which has been address-formatted by $V_f$. The datum number corresponding the thus-added $V_f$ is increased by 1. Since this is the second performance of the routine, the count number of the corresponding counter is increased to 2.

After the Step a59, the routine returns to Step a5 of FIG. 4(*a*). When the routine advances through the NO route in Step a6, the NO route in Step a13 of FIG. 4(*b*) and the YES route in Step a39 and returns again to Step a49 shown in FIG. 4(*d*), the NO route is taken because the scan cycle counter is still not 0. In Step a50, a judgement is made to determine whether SCOUNT is 0 or not. Since SCOUNT has been set at 254 in Step a62 in this case, the NO route is taken in Step a50 and in Step a60, it is judged whether SCOUNT is 255 or not. Since the answer is "NO" in this case, Step a61 is jumped over and a judgement is made in Step a53 to determine the state of Flag COND. Since the state of COND which has been set at 0 in Step a61 has not been cancelled in this case, SCOUNT is again decreased by 1 in Step a62. Accordingly, the factor $K_S$ is set by introducing 253/128 as the term SCOUNT/128 in Step a55. After the factor $K_{AF}$ is determined, the individual outputs $V_f$, $V_r$ of the forward $O_2$ sensor 17 and rearward $O_2$ sensor 18 are read, and $V_r$ is added to the memory which has been address-formatted by $V_f$. After increment of a datum number corresponding to $V_f$ thus added (Steps a56 and a59), the routine returns to Step a5 of FIG. 4(*a*) and as in the foregoing, again to Step a49 of FIG. 4(*d*).

Thereafter, the above-described processings are repeated until SCOUNT reaches 0 (SCOUNT=0). The air/fuel ratio is thus shifted successively from the lean side to the rich side (from about 0.95 to about 1.05 in terms of $K_S$ value). By reading the individual outputs $V_f$,$V_r$ of the forward $O_2$ sensor 17 and rearward $O_2$ sensor 18 in the course of the shifting of the air/fuel ratio, it is possible to perform the second measurement of the $V_f$-$V_r$ characteristics by shifting the air/fuel ratio from the lean side to the rich side around the stoichiometric air/fuel ratio. As a result, the range around the theoretical air/fuel ratio (the $V_f$-$V_r$ characteristics ranging approximately from 1.05 to 0.95 in terms of the value of $K_S$) has been measured back and forth.

When SCOUNT reaches 0, the routine is switched to the YES route in Step a50. After decreasing the scan cycle counter by 1, Flag COND is changed to 1 (Step a52).

Accordingly, the air/fuel ratio is shifted again from the rich side to the lean side and then in the opposite direction, thereby performing the third and fourth measurements of the $V_f$-$V_r$ characteristics.

When the above measurement of the $V_f$-$V_r$ characteristics has been performed back and forth several times (the number of these reciprocations being dependent on the initial value set in the scan cycle counter), the value of the scan cycle counter becomes 0 in Step a51. When the routine has thereafter returned again to Step a49, the YES route is taken to perform the processing of Step a63 shown in FIG. 4(*e*). Namely, in Step a63, an average value $\overline{V}_r[(V_f)_i]$ of $V_r$ for $(V_f)_i$ measured by that time is calculated. Upon calculation of the average value, the count number of the $V_f$ counter is used.

After determination of the average $V_r$ value in the above manner, the $\overline{V}_r$-$V_f$ curve is smoothened by a suitable interpolation method or the like in Step a64. The characteristics thus obtained [see FIG. 8(*c*)] are the $V_r$-$V_f$ characteristics shown in FIG. 8(*b*).

The routine then advances to Step a65. A $V_f$ range satisfying $d\overline{V}_r/dV_f > K$, namely, a $V_f$ range where $V_r$ rises aruptly is determined. In Step a66, the median of the $V_f$ range is chosen as the rich/lean-judging standard value $V_{fc}$. This new value $V_{fc}$ is stored in the BURAM 33. Thus, the rewriting of the standard value $V_{fc}$, namely, the renewal of the standard value $V_{fc}$ has been completed. The completion flag for the checking of correction of the $O_2$ sensor is then set in Step a67. The drive distance datum OD is inputted in Step a68, and the next standard value rewriting distance ODX is set, for example, at ODX+800 (miles) in Step a69.

The routine thereafter returns to Step a5 of FIG. 4(*a*). If the operation is not in the fuel cut-off zone, the NO route is taken in Step a6 and Steps a7–a9 are then performed. If the answers of Steps a7–a9 are all "YES", it is judged in Step a13 of FIG. 4(*b*) whether the completion flag for the checking of correction of the $O_2$ sensor has been set or not. Since this flag is in a set state in Step a67 of FIG. driving, said routine work being defined by Step a14 and its subsequent steps, is performed.

In this case, the air/fuel ratio control is performed on the basis of the rich/lean-judging standard value $V_{fc}$ renewed in the manner described above.

Since the rich/lean-judging standard value $V_{fc}$ to be compared with the output $V_f$ of the forward $O_2$ sensor 17 can be changed and renewed on the basis of both outputs $V_f$,$V_r$ of the forward $O_2$ sensor 17 and rearward $O_2$ sensor 18, the accuracy of the control does not vary even by variations in characteristics from one $O_2$ sensor to another and variations of the characteristics of each $O_2$ sensor along the passage of time and more over, the cleaning efficiency of exhaust gas by the catalytic converter 9 is maintained high. High control reliability can thus be assured.

Even when EGR is not performed or even when EGR is performed at a low rate even if EGR is performed, a good exhaust gas quality level is achieved. The EGR system can therefore be simplified and in addition, the power performance and drivability are not sacrificed by exhaust gas.

Incidentally, the voltage $V_{fc}$ for rich/lean judgement is stored in the BURAM 33 and the stored value is not erased by the turn-off of the ignition switch 26 alone. When the battery 24 is disconnected, the contents of the memory are erased. When the history of battery disconnection is found in Step a2 of FIG. 4(*a*), a representative $V_f$ value (for example, a value corresponding to 0.6 volt) is tentatively inputted as an intial value in Step a70. Thereafter, the resetting of the completion flag for the checking of correction of the $O_2$ sensor is performed in Step a71.

When the completion flag for the checking of correction of the $O_2$ sensor has been reset as described above, the NO route is taken in Step a13, and after satisfying the standard value rewritting conditions, the rich/lean-judging standard value $V_{fc}$ is rewritten. The processing in this case is exactly the same as the processing upon the above-described rewriting of the standard value, its detailed description is omitted herein.

Figure 8C:
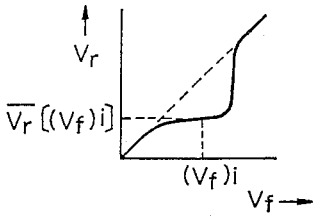

In the above-described first embodiment, by changing $K_S$ stepwise after converting the air/fuel feedback system from the closed loop to the open loop, the air/fuel ratio is changed around the stoichiometric air/fuel ratio so that $V_f$ and $V_r$ are measured at a prescribed interval for a predetermined time period at each air/fuel ratio and their average values are calculated to obtain the graph of FIG. 8(*c*). Since the air/fuel ratio may vary and different $V_f$-$V_r$ characteristics may exist in some instances, for example, upon feedback control of an actual system, the air/fuel ratio may be changed 1/128 by 1/128 from 125/128 of the $K_S$ value to 131/128 of the $K_S$ value while giving air/fuel ratio fluctuation similar to that observed on the actual system (for example, air/fuel ratio variation cycle: 2 Hz; air/fuel ratio fluctuation magnitude: 5% in terms of fuel).

The air/fuel ratio control system according to the second embodiment of this invention, which is suitable for use with an internal combustion engine, will next be described with reference to FIGS. 9–12.

Figures 11A, 11B, 11C:
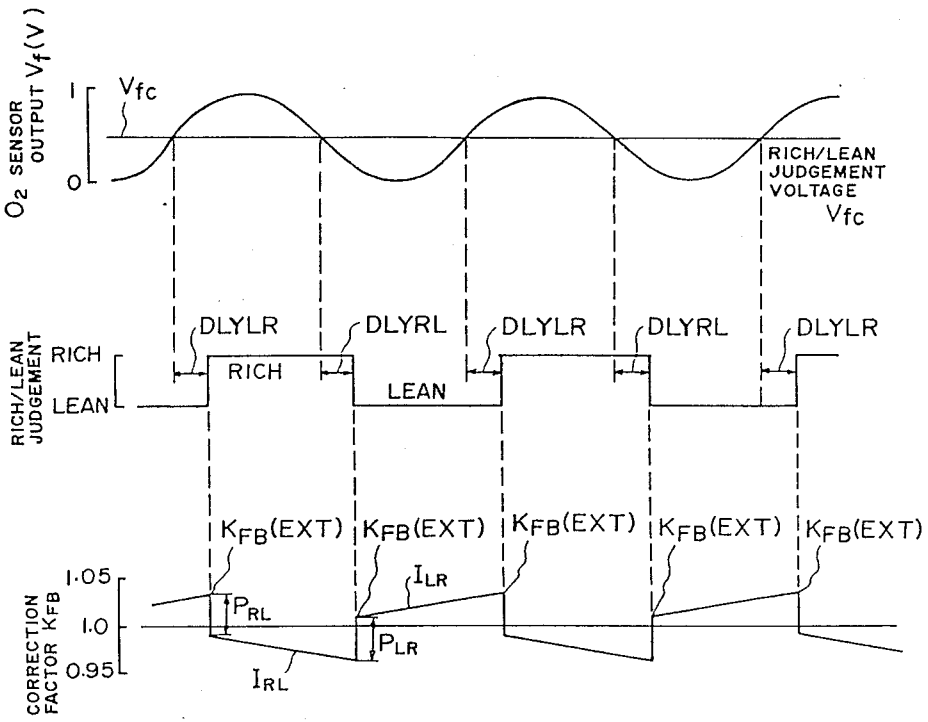
Figures 12A, 12B:
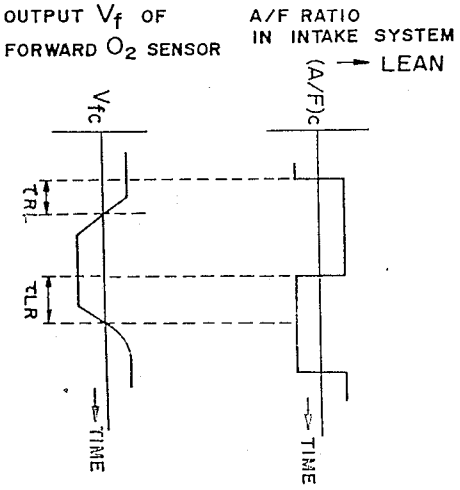

In addition to the performance of the first embodiment described above, the air/fuel ratio control system according to the second embodiment determines the response time $\tau_{RL}$ of the former $O_2$ sensor 17 to the change from a rich air-fuel mixture to a lean airfuel mixture and the response time $\tau_{LR}$ of the former $O_2$ sensor 17 to the change from a lean air-fuel mixture to a rich air-fuel mixture and in accordance with these response times $\tau_{RL}$,$\tau_{LR}$, corrects any one of the delay times DLYRL,DLYLR shown in FIG. 11, the proportional gains $P_{RL}$,$P_{LR}$ of the air/fuel ratio feedback control and the integral gains $I_{RL}$,$I_{LR}$ of the air/fuel ratio feedback control.

Here, the response time $\tau_{RL}$ is a judgement delay time of the forward $O_2$ sensor 17 for a change from a rich air-fuel mixture to a lean air-fuel mixture and means the time required until the output $V_f$ of the forward $O_2$ sensor reaches the standard value $V_{fc}$ after the air/fuel ratio in the intake system has varied across $(A/F)_c$ from the rich side to the lean side. On the other hand, the response time $\tau_{RL}$ is a judgement delay time of the forward $O_2$ sensor 17 for a change from a lean air-fuel mixture to a rich air-fuel mixture and means the time required until the output $V_f$ of the forward $O_2$ sensor reaches the standard value $V_{fc}$ after the air/fuel ratio has varied across $(A/F)_c$ from the lean side to the rich side [see FIGS. 12(*a*) and 12(*b*)].

In the air/fuel ratio feedback control making use of the $O_2$ sensors, the second embodiment also compares the output $V_f$ from the forward $O_2$ sensor 17 with the predetermined standard value $V_{fc}$ (an intermediate value between the high-level output of the forward $O_2$ sensor 17 and the low-level output thereof being chosen as the standard value $V_{fc}$ and said standard value $V_{fc}$ serving as a so-called rich/lean judgement voltage) and renders the air-fuel mixture richer when $V_{fc}>V_f$ but makes it leaner when $V_{fc}\leqq V_f$.

Figure 9:
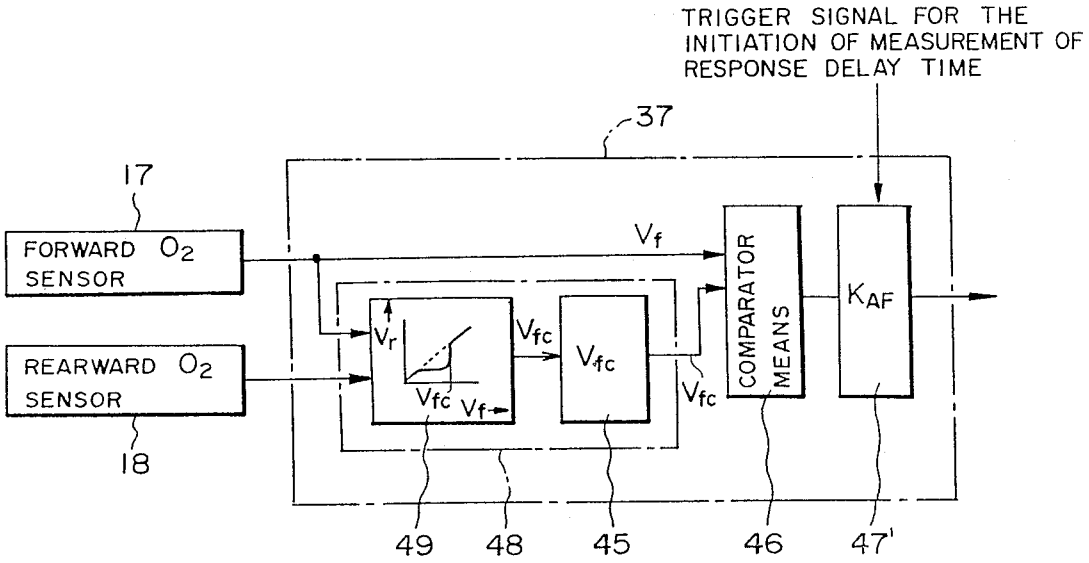
Figure 10A:
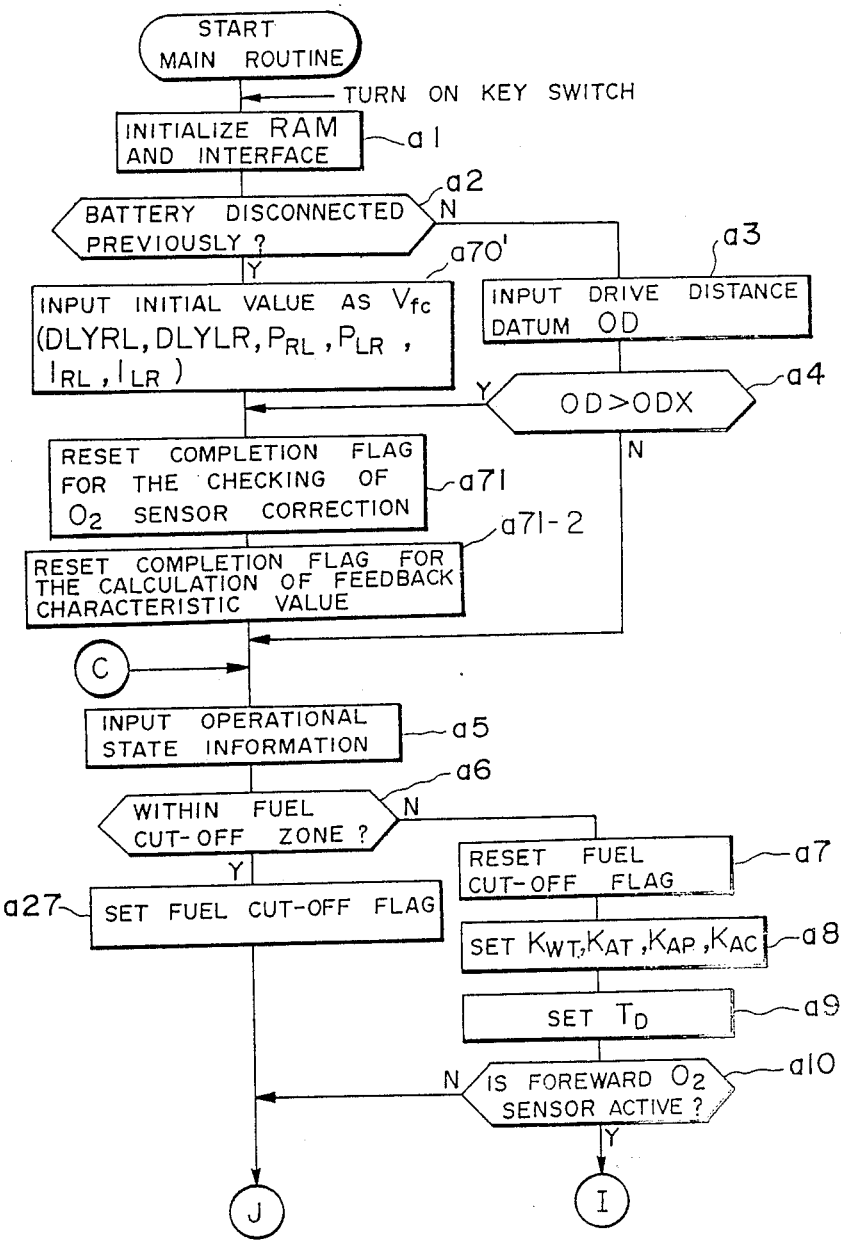
Figure 10B:
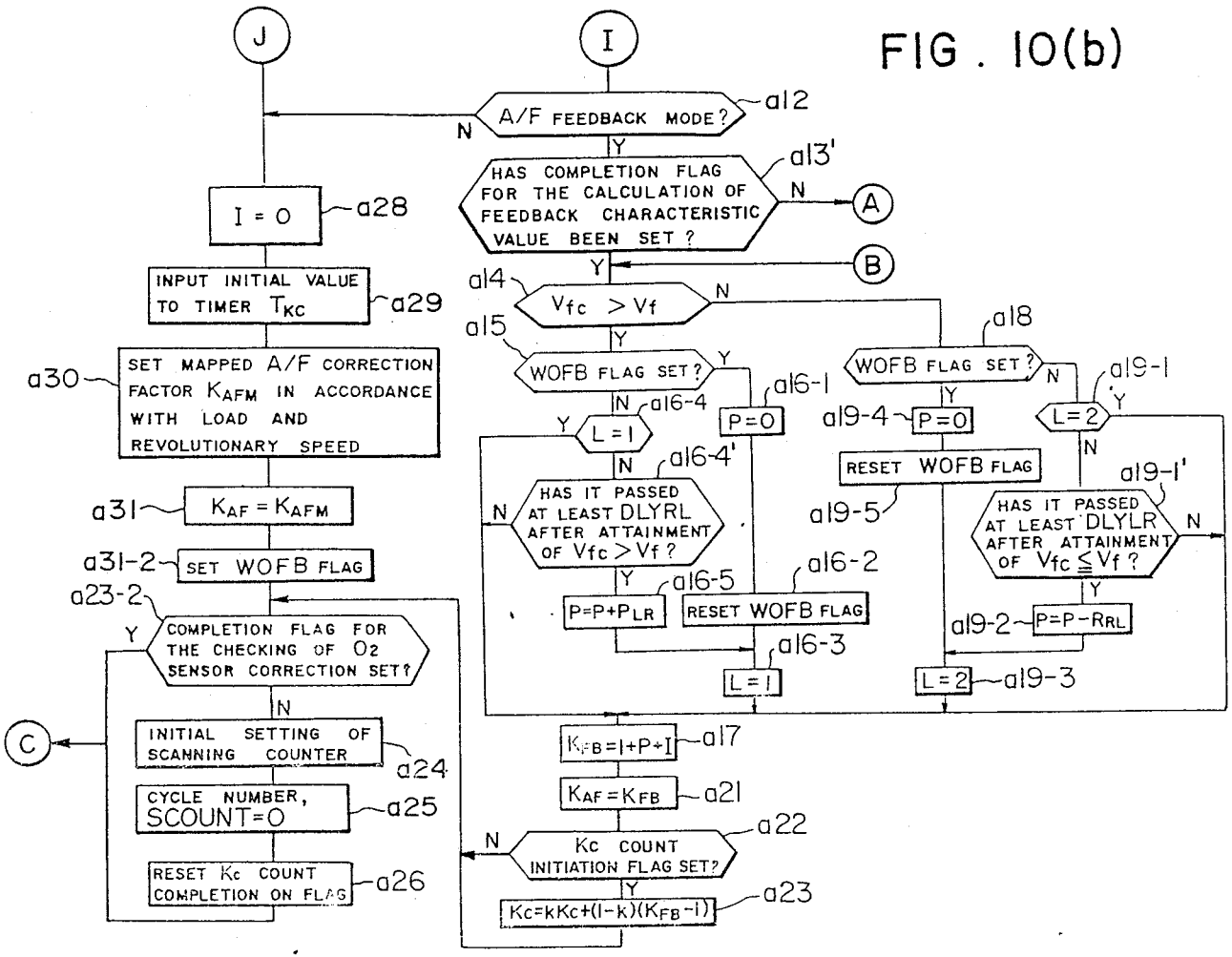
Figure 10C:
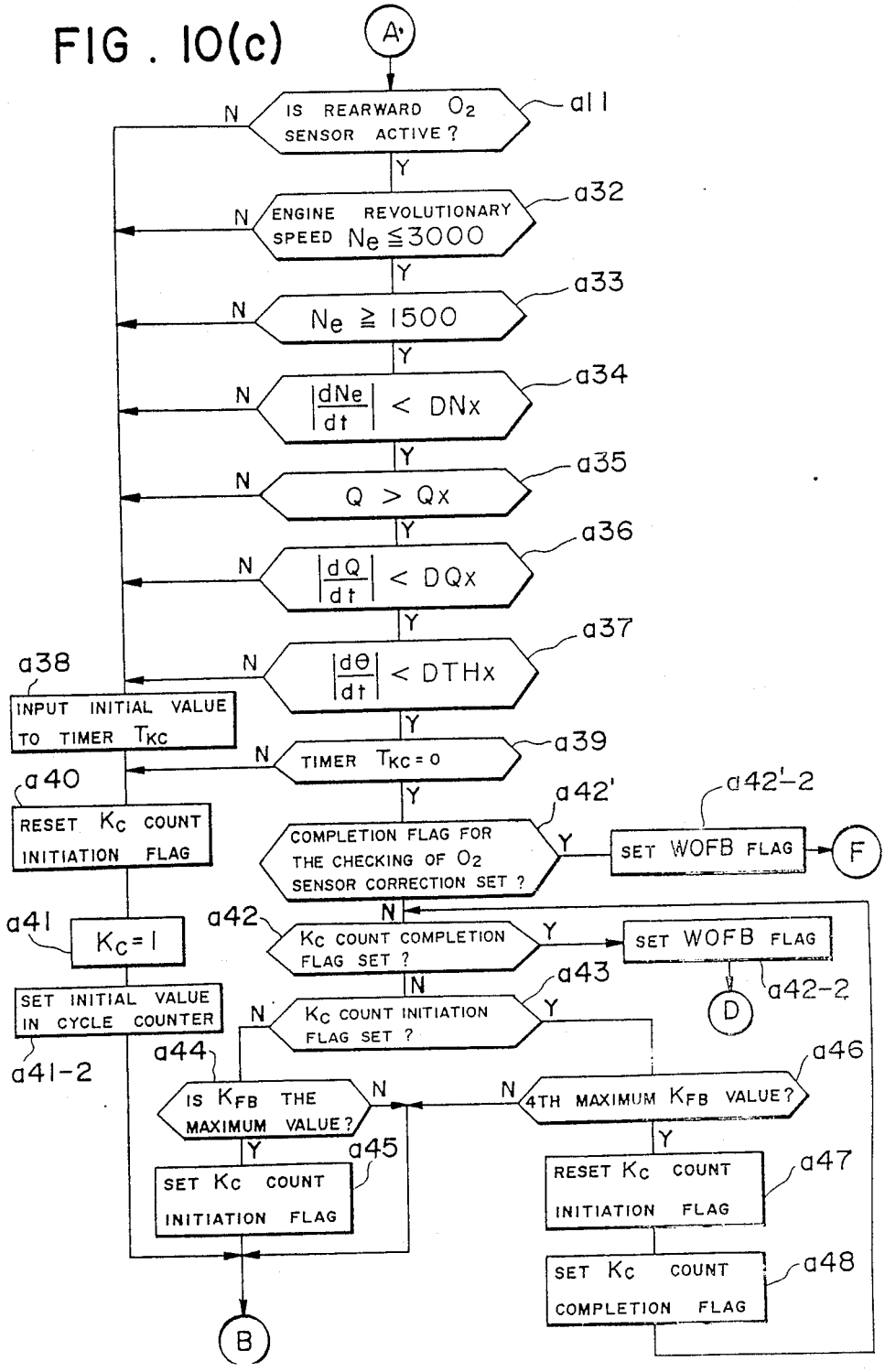
Figure 10D:
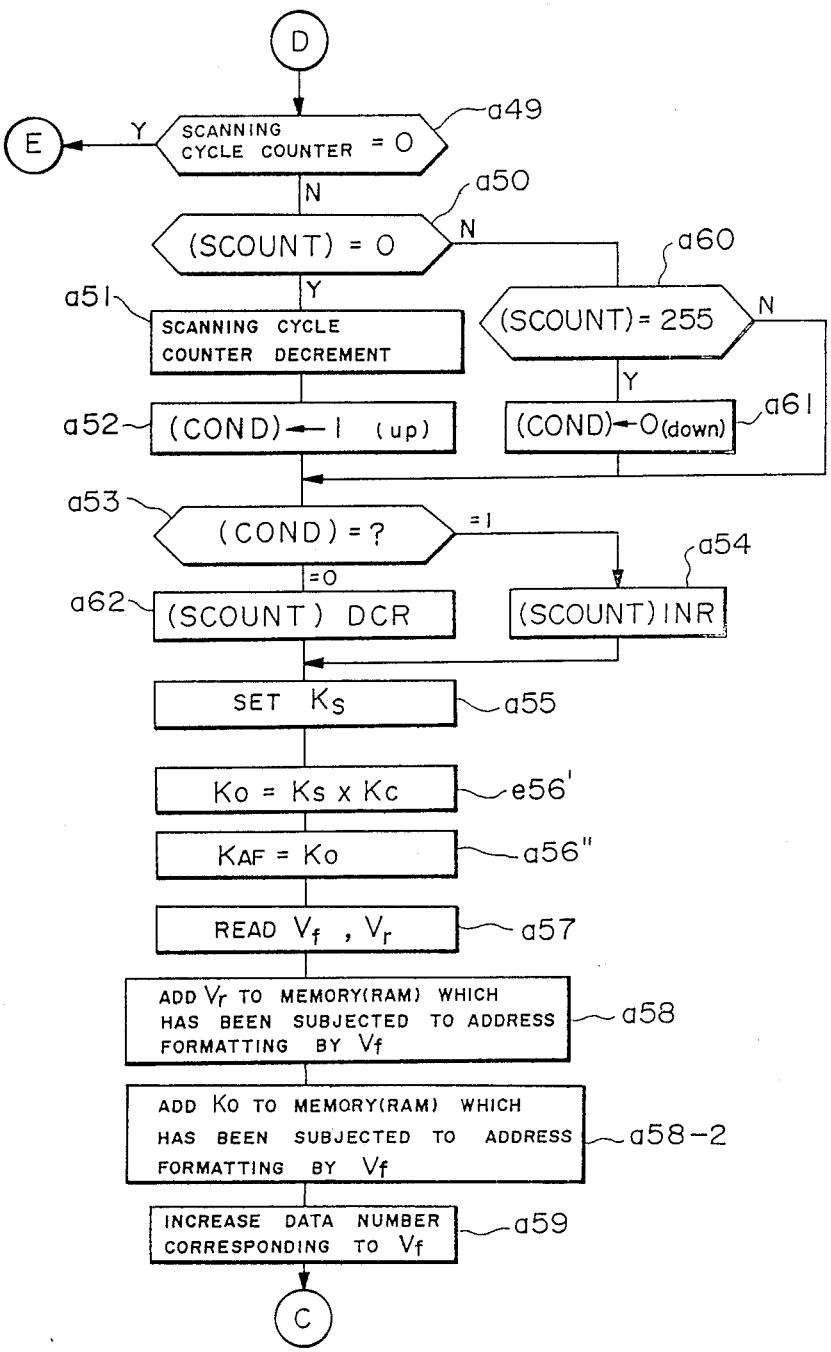
Figure 10E:
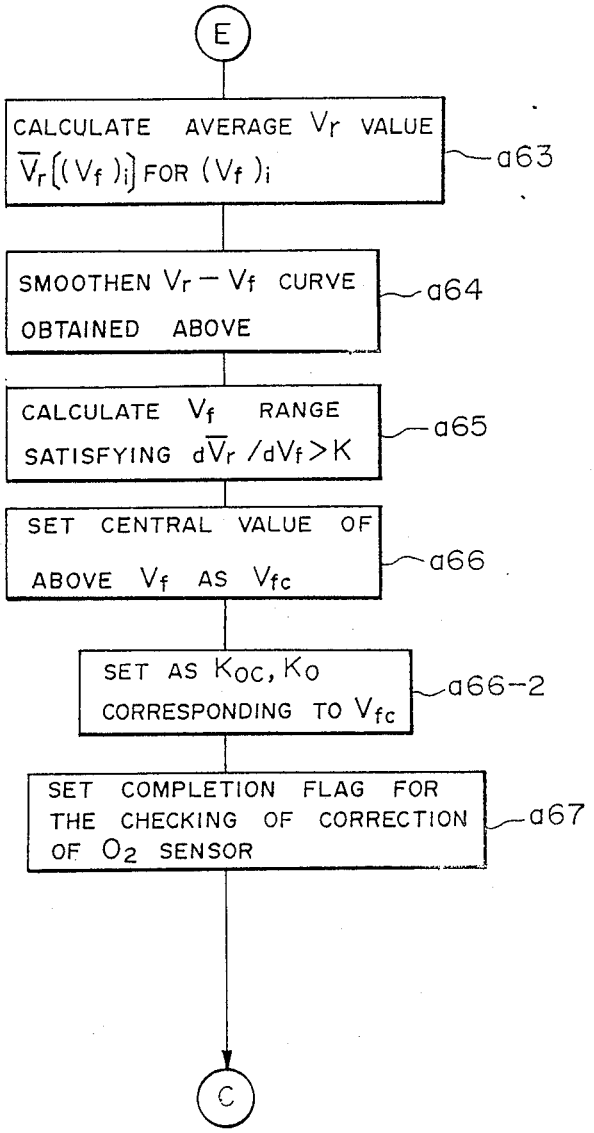
Figure 10F:
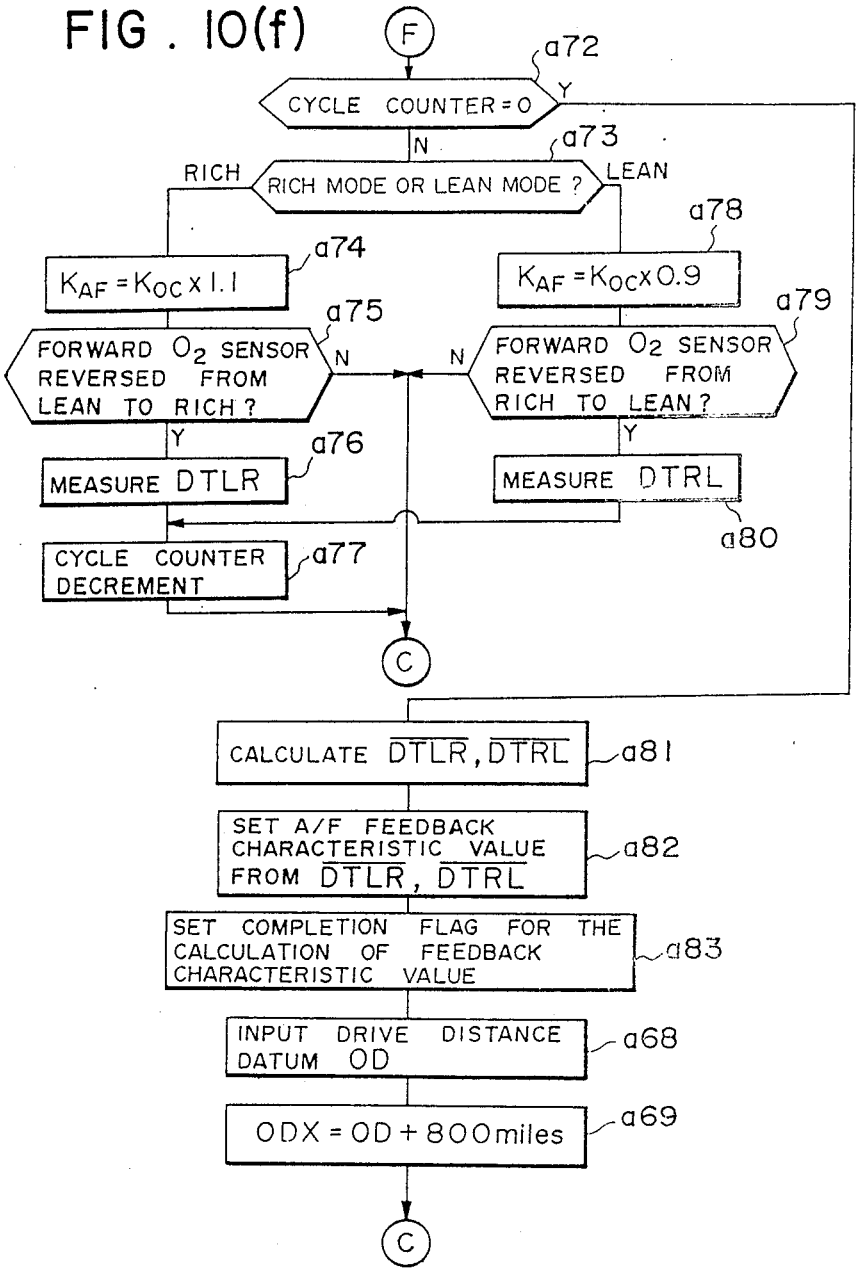

Accordingly, the $O_2$ sensor feedback correction means 37 has, as depicted in FIG. 9, the rich/lean judgement voltage setting means 45 for setting the standard value $V_{fc}$, the comparator means 46 for comparing the output $V_f$ from the forward $O_2$ sensor 17 with the standard value $V_{fc}$ from the rich/lean judgement voltage setting means 45, and the correction factor determination means 47' for determining the air/fuel ratio correction factor $K_{AF}$ in accordance with comparison results from the comparator means 46. Different from conventional systems, the present air/fuel ratio control system is also equipped with the standard value changing means 48 for allowing to change the standard value (rich/lean judgement voltage) $V_{fc}$ on the basis of the outputs $V_f$ and $V_r$ from the forward $O_2$ sensor 17 and rearward $O_2$ sensor 18, for example, for every predetermined drive distance.

The correction factor determination means 47' includes a means for determining response times $\tau_{RL}$,$\tau_{LR}$ and correcting any one of the response delay times DLYRL,DLYLR, proportional gains $P_{RL}$,$P_{LR}$ and integral gains $I_{RL}$,$I_{LR}$ in accordance with these response times $\tau_{RL}$,$\tau_{LR}$.

Incidentally, the above-described $V_f$-$V_r$ characteristics, $V_f$-$K_o$ characteristics, and the response delay times DLYRL,DLYLR, proportional gains $P_{RL}$,$P_{LR}$ and integral gains $I_{RL}$,$I_{LR}$ to be corrected in accordance with the rich/lean-judging standard voltage $V_{fc}$ or response times $\tau_{RL}$,$\tau_{LR}$ are stored in the BURAM 33.

The main routine of the air/fuel ratio control system, which includes the above-described changing of the standard value, the determination of the correction factor and the like, will next be described in detail with reference to FIGS. 10(*a*) through 10(*f*). Although these FIGS. 10(*a*) through 10(*f*) illustrate a single flow chart, the flow chart is very long and for the sake of convenience, has hence been divided at the appropriate parts into the six figures.

In this main flow, the routine is also started firstly as depicted in FIG. 10(*a*) when the key switch (ignition switch) is turned on. First of all, the RAM 32 and interfaces are initialized in Step a1. It is next judged in Step a2 whether the battery 24 has been disconnected or not. Since the battery 24 is kept connected generally, the NO route is followed and a drive distance datum OD is inputted in Step a3.

The routine then advances to Step a4, where the OD datum is compared with the standard-value-rewriting distance ODX which is backed up by the battery. When not OD>ODX, namely, the drive distance has not yet reached the standard-value-rewriting distance, operational state information is inputted in Step a5. In the next Step a6, it is judged whether the operational state is in a fuel cut-off zone or not. When it is not in the fuel cut-off zone, the fuel cut-off flag is reset in Step a7, followed by setting of the correction factors $K_{WT}$, $K_{AT}$, $K_{AP}$ and $K_{AC}$ in Step a8. The dead time $T_D$ is then set in Step a9. These factors are set by the cooling-water-temperature-dependent correction means 40, intake-air-temperature-dependent correction means 41, barometric-pressure-dependent correction means 42, accelerating fuel-increment correction means 43 and dead time correction means 44, respectively.

In Step a10, it is next judged from the output voltage value of the forward $O_2$ sensor 17 whether the sensor is in an active state or not.

If the forward $O_2$ sensor 17 is active as shown in FIG. 10(*b*), the routine advances to the next Step a12 in which a judgement is made to determine whether it is in the air/fuel ratio (A/F) feedback mode or not.

If the operation is in the A/F feedback mode, it is judged in Step a13' whether a completion flag for the calculation of a feedback characteristic value (FB characteristic value) has been set or not. Since the FB characteristic value is usually in a set state, the YES route is taken, and in Step a14, the output $V_f$ of the forward $O_2$ sensor 17 and the rich/lean judgement voltage $V_{fc}$ are compared with each other. When $V_{fc}>V_f$, it is judged in Step a15 whether WOFB flag has been set or not. Since WOFB flag is in a set state at the time point immediately after the A/F feedback zone has been entered, the routine takes the YES route, the proportional gain P is changed to 0 in Step a16-1, WOFB flag is reset in Step a16-2, and Flag L is changed to 1 in Step a16-3.

After Step a16-3, the feedback correction factor $K_{FB}$ is determined as 1+P+I in Step a17 and this value $K_{FB}$ is inputted to an address $K_{AF}$ in Step a21. At the beginning, the proportional gain P=0 and the integral factor I=0. The routine therefore starts with $K_{FB}=1$.

It is thereafter judged in Step a22 whether the $K_c$ count initiation flag has been set or not. Since the flag is in a reset state at the beginning, the routine jumps to Step a23-2 to judge whether the completion flag for the checking of the $O_2$ sensor has been set or not. Since the flag is generally in a set state, the YES route is taken so that the routine returns to Step a5 of FIG. 10(*a*).

After returning again Step a15, the NO route is taken this time since WOFB flag has been reset in Step a16-2. It is then judged in Step a16-4 whether Flag L is 1 or not. Since Flag L has been changed to 1 in this case in Step a16-3, the YES route is taken to perform the processing of Step a17.

Incidentally, the integration-time computing routine for the integral factor I is the same as the flow chart of FIG. 6(*b*) in the first embodiment described above.

Since L=1 in this case, $I_{LR}$ is added at every time interruption and the feedback correction factor $K_{FB}$ becomes greater. The enrichment is therefore promoted.

When $V_{fc}$ becomes equal to or smaller than $V_f$ ($V_{fc} \leqq V_f$) as a result of enrichment in the above-described manner, the NO route is taken in Step a14, and it is judged in Step a18 whether WOFB flag has been set or not. When the operation is still in the A/F feedback mode, WOFB flag is still in the reset state. The NO route is therefore followed in Step a18, and in Step a19-1, a judgement is made to determine whether Flag L is 2 or not. Since L=1 immediately after the switching, the NO route is taken in Step a19-1. In Step a19-1', subsequent to the attainment of $V_{fc} \leqq V_f$, it is judged whether the delay time DLYLR has lapsed. While the delay time DLYLR has not lapsed, the NO route is taken to perform the processing of Step a17. After the delay time DLYLR has been lapsed, the YES route is taken and the proportional gain $P_{RL}$ for leanness is subtracted from the proportional gain P. The difference is then set as P. After changing L to 2 (L=2) in Step a19-3, the feedback correction factor $K_{FB}$ is determined as 1+P+I in Step a17. This value $K_{FB}$ is inputted to the address $K_{AF}$ in Step a21. As a result, the feedback correction factor $K_{FB}$ is decreased by the proportional gain $P_{RL}$ for leanness from its maximum value.

Thereafter, the routine returns to Step a5 in the same manner as described above.

When the routine has returned again to Step a19-1 via Step a18, the YES route is taken this time because L has been changed to 2 in Step a19-3. The processing of Step a17 is therefore applied.

Since L=2 in this case, at every timer interruption, the NO route is taken in Step d2 of FIG. 6(*b*) and $I_{RL}$ is subtracted in Step d4 of the same figure, and the feedback correction factor $K_{FB}$ becomes smaller. The leanness is therefore promoted.

When $V_{fc}$ becomes greater than $V_f$ ($V_{fc} > V_f$) as a result of leanness in the above-described manner, the YES route is taken in Step a14, and it is judged in Step a15 whether WOFB flag has been set or not. When the operation is still in the A/F feedback mode, WOFB flag is still in the reset state. The NO route is therefore followed in Step a15, and in Step a16-4, a judgement is made to determine whether Flag L is 1 or not. Since L=2 immediately after the switching, the NO route is taken in Step a16-4. After attainment of $V_{fc} > V_f$ in Step a16-4', it is judged whether the delay time DLYRL has lapsed or not. While the delay time DLYRL has not lapsed, the NO route is taken to perform the processing of Step a17. After the delay time DLYRL has lapsed, the YES route is taken and the proportional gain $P_{LR}$ for enrichment is added to the proportional gain P in Step a16-5 so as to use the sum as P. After changing L to 1 (L=1) in Step a16-3, the feedback correction factor $K_{FB}$ is determined as 1+P+I in Step a17. This value $K_{FB}$ is then inputted to the address $K_{AF}$ in Step a21. As a consequence, the feedback correction factor $K_{FB}$ is increased by the proportional gain $P_{LR}$ for enrichment from its minimum value.

By repeating the above processing thereafter, the feedback correction factor $K_{FB}$ is varied as shown in FIG. 11(*c*) so that the desired air/fuel ratio control is performed in the A/F feedback mode.

Incidentally, FIG. 11(*a*) is a waveform diagram of the output of the forward $O_2$ sensor, while FIG. 11(*b*) is a waveform diagram for the rich/lean judgement. The delay times DLYRL,DLYLR are, as illustrated in FIG. 11(*b*), times corresponding to the delays until a rich/lean judgment is performed when the output of the $O_2$ sensor has crossed the rich/lean judgement voltage $V_{fc}$ upwardly or downwardly as illustrated in FIG. 11(*a*).

When $V_{fc} \leqq V_f$ immediately after entering the A/F feedback zone, the YES route is also followed in Step a18 since WOFB flag is in a set state at the time point immediately after the entering, the proportional gain P is changed to 0 in Step a19-4, WOFB flag is reset in Step a19-5, and Flag L is changed to 2 in Step a19-3. After Step a19-3, the feedback correction factor $K_{FB}$ is determined as 1+P+I in Step a17 and this value $K_{FB}$ is inputted to the address $K_{AF}$ in Step a21. Here again, the proportional gain and integral factor I are both 0 (P=0, I=0) at the beginning, and the routine also starts from $K_{FB}=1$.

As has been described above, it is the comparator means 46 and correction factor determination means 47' in the $O_2$ sensor feedback correction means 37 that perform the comparison between $V_{fc}$ and $V_f$ and results of the comparison.

In the second embodiment, the delay times DLYRL, DLYLR, proportional gains $P_{RL}$,$P_{LR}$ and integral gains $I_{RL}$,$I_{LR}$ are variable as will be described subsequently.

When the operation is found to be in the fuel cut-off zone in Step a6 subsequent to Step a5, the fuel cut-off flag is set in Step a27 as shown in FIG. 10(*a*), the integral factor I is changed to 0 in Step a28 as depicted in FIG. 10(*b*), an initial value (for example, 10 seconds or so) is inputted to the timer $T_{KC}$ in Ste a29, and the mapped A/F correction factor $K_{AFM}$ is set in accordance with the load and revolutionary speed of the engine. The mapped A/F correction factor $K_{AFM}$ is inputted to the address $K_{AF}$ in Step a31, and after setting WOFB flag in Step a31-2, the routine returns to Step a5 via Steps a23-2.

When the answer is "NO" in Step a10 or a12, it is impossible to perform the A/F feedback control. The routine therefore returns to Step a5 via Steps a28, a31, a31-2 and a23-2.

During usual driving, the above routine is performed repeatedly so as to set the factors $K_{WT}$,$K_{AT}$, $K_{AP}$,$K_{AC}$,-$K_{AF}$ and the time $T_D$ in accordance with the state of the engine. By performing the solenoid valve drive routine depicted in FIG. 5 by using these values, each solenoid valve 8 is actuated to inject a desired quantity of the fuel. In this manner, the desired air/fuel ratio control is effected.

When the drive distance OD reaches the standard value rewriting distance ODX, the YES route is taken in Step a4 and the flag for the completion of checking of the $O_2$ sensor is reset in Step a71 and the completion flag for the completion of calculation of the FB characteristic values is reset in Step a71-2.

Thereafter, the routine advances through Step a5 and performs the processing of Step a6. When the operation is found to be outside the fuel cut-off zone in Step a6, the routine advances through Steps a7–a9 and the processings of Steps a10–a12 are performed. When the answer is "YES" in each of Steps a10,a12, it is judged in Step a13' whether the flag for the calculation of the FB characteristic values has been set or not. Since it has been reset in Step a71-2 in this case, the routine advances through the NO route and then moves to Steps a11,a32,a33 illustrated in FIG. 10(*c*).

In Step all, a judgement is made to determine whether the rearward $O_2$ sensor is in an active state or not. In Steps a32,a33, it is judged whether the revolutionary speed Ne of the engine is 3,000 rpm or lower and whether it is 1,500 rpm or higher. When both answers are "YES", it is judged in Step a34 whether the engine fluctuation |dNe/dt| is smaller than the preset value $DN_x$. When it is smaller, it is judged in Steps a35,a36 whether the intake air quantity Q is greater than the preset value $Q_x$ and whether the intake air fluctuation |dQ/dt| is smaller than the preset value $DQ_x$. When both answers are "YES", it is judged in Step a37 whether the fluctuation $|d\theta/dt|$ of the throttle opening rate $\theta$ is smaller than the preset value $DTH_x$. When the answer is also "YES" in Step a37, a further judgement is made in Step a39 to determine whether the timer $T_{KC}$ is 0 or not.

Incidentally, the timer $T_{KC}$ is also designed to operate at every time interruption in accordance with the timer subtraction routine shown in FIG. 6(*a*).

When the timer $T_{KC}$ is not 0, the Kc count initiation flag is reset in Step a40, and the factor $K_c$ (this factor $K_c$ is a value which would probably become equal to the stoichiometric air/fuel ratio when the A/F feedback control is performed, and like the above-described first embodiment, indicates a median) is set at 1 in Step a41. After setting an initial value other than 0 in Step a41-2, the routine returns to the processings of Step a14 and its subsequent steps depicted in FIG. 10(*b*).

The routine then advances through Steps a14–a21, and further via the NO route in Step a22. When the routine reaches Step a23-2, the routine advances through the NO route because the completion flag for the checking of correction of the $O_2$ sensor has been reset. Initial setting of the scan counter is then performed in Step a24. Here, a suitable number other than 0 is selected as the initial value. Similar to the first embodiment, the scan counter is used upon changing and renewing the standard value. The n sets of $V_f$ counters, which are employed at the this time, are also reset in Step a24.

Further, the cycle number SCOUNT which is also used upon changing and renewing the standard value is set at 0 in Step a25. After resetting the $K_c$ count completion flag in Step a26, the routine returns to Step a5.

Incidentally, the resetting of the $V_f$ counters may be performed in Step a41-2.

When the answers of Steps a32–a37 are both "NO", an initial value (the same value as that inputted in Step a29) is inputted to the timer $T_{KC}$ and the $K_c$ count initiation flag is set in Step a40. After changing the factor $K_c$ to 1 in Step a41, an initial value is set in the cycle counter. The routine then returns to the processings of Step a14 and its subsequent steps shown in FIG. 10(*b*).

Even when the drive distance datum OD has reached the standard value rewriting distance ODX, the routine does not therefore advance to the standard value rewriting processing and is caused to return to the side of the routine work for normal driving so long as both $O_2$ sensors 17,18 are not in an active state, the operation is not in the A/F feedbac mode (in which the operation range is set in a relatively stable operation range), the revolutionary speed Ne of the engine does not fall between 1,500 and 3,000 (inclusive, i.e., $1{,}500 \leqq Ne \leqq 3{,}000$), the engine fluctuation is large, the intake air quantity is little, or the intake air fluctuation or throttle opening rate fluctuation is great.

Even when all the above conditions are met, the routine does not advance either to the standard value rewriting processing and is caused to return to the side of the routine work for normal driving until the lapse of a prescribed period of time (a time period corresponding to the initial value of the timer $T_{KC}$) after the full satisfaction of the conditions.

When all the above conditions are met and the prescribed period of time has lapsed (these conditions will hereinafter be called "standard value rewriting conditions" as in the first embodiment described above), it is judged in Step a42' of FIG. 10(*c*) whether the completion flag for the checking of correction of the $O_2$ sensor has been set or not. Since this flag has been reset in Step a71 in this case, the routine advances through the NO route to Step a42, where it is judged whether the $K_c$ count completion flag has been set or not.

Since the $K_c$ count completion flag has been reset in Step a26 [see FIG. 10(*b*)], the NO route is taken first of all. It is then judged in Step a43 whether the $K_c$ count initiation flag has been set or not. Since the $K_c$ count initiation flag is in a reset state at the beginning, the NO route is taken to judge whether the factor $K_{FB}$ is the maximum value $K_{FB}$(EXT) or not. If the factor $K_{FB}$ is found to be the maximum value $K_{FB}$(EXT), the $K_c$ count initiation flag is set in Step a45 so that the processings of Step a14 and its subsequent steps of FIG. 10(*b*) are applied. After performing the processings of Steps a15–a21, it is judged in Step a22 whether the $K_c$ count initiation flag has been set or not. Since the $K_c$ count initiation flag has been set in Step a45 of FIG. 10(*c*), the YES route is taken in this Step a22. In the next Step a23, $K_c$ (the value which would probably become equal to the stoichiometric air/fuel ratio when the A/F feedback control is performed; median) is determined as $kK_c+(1-k)(K_{FB}-1)$. Thereafter, the routine returns to Steps a23-2,a24-26,a5 so as to perform their respective processings.

When the answer is "NO" in Step a44, namely, the factor $K_{FB}$ has not reached the maximum value, Step a23 is jumped over and the routine returns to Steps a23-2,a24–a26,a5 so as to perform their respective processings. As a result, the median $K_c$ is not changed and renewed.

When the routine advances again to Step a43 in the same manner, the YES route is taken since the $K_c$ count initiation flag has been set in Step a45. It is then judged in Step 46 whether the maximum value $K_{FB}$(EXT) has occurred four times after the detection of the first occurrence of the maximum value of the factor $K_{FB}$.

While the maximum value $K_{FB}$(EXT) has not occurred four times, the NO route is taken in Step a46. The routine then advances through Steps a14–a21 to Step a22, where the YES route is taken to change and renew the median $K_c$. Thereafter, the processings of Steps a23-2,a24 and their subsequent processings are performed.

If conditions not satisfying the standard value rewriting conditions arise even in the course of the above performance, the median $K_c$ is set tentatively at 1.

When the maximum value $K_{FB}$(EXT) has occurred four times, the $K_c$ count initiation flag is reset in Step a47, the $K_c$ count completion flag is set in Step a48, and the routine returns to Step a42. At this time, the average value of the four median is stored as the central value $K_c$ at the prescribed address. The processing for calculating the average value of central values $K_c$ in the above-described manner will be called "pre-processing for the rewriting of the standard value".

When the pre-processing for the rewriting of the standard value has been completed in the above manner, the YES route is taken in Step a42. After setting WOFB flag in Step a42-2, it is judged in Step a49 of FIG. 10(*d*) whether the scan cycle counter is 0 or not. Since the initial value other than 0 has been set at the beginning in Step a24 of FIG. 10(*b*), the NO route is taken and in Step a50, it is judged whether the cycle number SCOUNT is 0 or not. In this case, the cycle number has been set at 0 in Step a25 shown in FIG. 10(*b*). The routine therefore advances along the YES route to Step a51, where decrement (DCR) processing is applied so that the contents of the scan counter are decreased by 1. Flag COND is changed to 1 in the next Step a52 to judge the state of Flag COND in Step a53. Since COND is 1 in this case, the cycle number SCOUNT is increased by 1 step in Step a54.

Thereafter, the air/fuel ratio factor $K_S$ is determined by $1+(1-SCOUNT/128)\times 0.05$ (since SCOUNT is 1 in this case, $K_S \simeq 1.05$) in Step a55. In Step a56', the factor $K_o$ is determined from $K_S \times K_c$ (in this case, $K_c$ is a value of 1 or substantially 1). Further, $K_{AF}$ is set at $K_o$ in Step a56" to shift the air/fuel ratio to the rich side intentionally. Thereafter, the output $V_f$ of the forward $O_2$ sensor 17 and the output $V_r$ of the rearward $O_2$ sensor are read in Step a57. In Step a58, $V_r$ is added to the memory (RAM) which has been address-formatted by $V_f$. In Step a58-2, $K_o$ is also added to the memory (RAM) which has been address-formatted by $V_f$In Step a59, the number of data corresponding to the thus-added $V_f$ is increased by 1. In this case, an address number sufficient to prepare the $V_f$-$V_r$ characteristic diagram described before in the first embodiment and shown in FIG. 8(*b*) is chosen as the address number of the memory. The inverse number of this address number is equivalent to the resolution. The $V_f$ counters are provided as many as the address number (n) of the memory, and when $V_r$ is stored at a corresponding address, the count number is increased by 1. In this respect, the second embodiment is equal to the first embodiment described before.

Incidentally, the same $V_f$ counters may be used commonly not only as the memory for $V_r$ (see the processing of Step a58) but also as the memory for $K_o$ (see the processing of Step a58-2). As an alternative, their own $V_f$ counters may also be used.

After the above-described Step a59, the routine returns to Step a5 of FIG. 10(*a*). When the routine advances through the NO route in Step a13, the YES route is taken in Step a42 and the routine then the scan counter is still not 0, the NO route is taken to judge in Step a50 whether SCOUNT is 0 or not. Since SCOUNT has been set at 1 in Step a54 in this case, the NO route is taken in Step a50 and in Step a60, it is judged whether SCOUNT is 255 or not. Since the answer is "NO" in this case, Step a61 is jumped over and a judgement is made in Step a53 to determine the state of Flag COND. Since the state of COND which has been set at 1 in Step a52 has not been cancelled in this case, SCOUNT is again increased by 1 in Step a54. Accordingly, the factor $K_S$ is set by introducing 2/128 as the term SCOUNT/128 in Step a55. After the factors $K_o$ and $K_{AF}$ are determined to shift the air/fuel ratio to the lean side a little, the individual outputs $V_f$ and $V_r$ of the forward $O_2$ sensor 17 and rearward $O_2$ sensor 18 are read, and $V_r$ and $K_o$ are added to the memory which has been address-formatted by $V_f$. After increment of a datum number corresponding to $V_f$ thus added (Steps a56 and a59), the routine returns to Step a5 of FIG. 10(*a*) and as in the foregoing, again to Step a49 of FIG. 10(*d*).

Thereafter, the above-described processings are repeated until SCOUNT reaches 255 (SCOUNT=255). The air/fuel ratio is shifted successively from the rich side to the lean side (from about 1.05 to about 0.95 in terms of $K_S$ value) in the above-described manner. By reading the individual outputs $V_f$,$V_r$ of the forward $O_2$ sensor 17 and rearward $O_2$ sensor 18 in the course of the shifting of the air/fuel ratio, it is possible to measure the $V_f$-$V_o$ characteristics upon shifting of the air/fuel ratio from the rich side to the lean side around the stoichiometric air/fuel ratio.

When SCOUNT reaches 255, the routine is switched to the YES route in Step a60 and Flag COND hence changes to 0 (Step a61).

Accordingly, the processing of Step a62 is then performed subsequent to Step a53. Namely, the cycle number SCOUNT is decreased by 1 step.

The air/fuel ratio factor $K_S$ is thereafter determined by $1+(1-SCOUNT/128)\times 0.05$ (since SCOUNT is 254 in this case, $K_S \simeq 0.95$). After determining the factor $K_o$ from $K_S \times K_c$ in Step a56', the output $V_f$ of the forward $O_2$ sensor 17 and the output $V_r$ of the rearward $O_2$ sensor 18 are read in Step a57. In Steps a58 and a58-2, $V_r$ and $K_o$ are added to the memory (RAM) which has been address-formatted by $V_f$. The datum number corresponding the thus-added $V_f$ is increased by 1 in Step a59. Since this is the second performance of the routine, the count number of the corresponding counter is increased to 2.

After the Step a59, the routine returns to Step a5 of FIG. 10(*a*). When the routine advances through the NO route in Step a6, the NO route in Step a13 and the YES route in Step a42 and returns again to Step a49 shown in FIG. 10(*d*), the NO route is taken because the scan cycle counter is still not 0. In Step a50, a judgement is made to determine whether SCOUNT is 0 or not. Since SCOUNT has been set at 254 in Step a62 in this case, the NO route is taken in Step a50 and in Step a60, it is judged whether SCOUNT is 255 or not. Since the answer is "NO" in this case, Step a61 is jumped over and a judgement is made in Step a53 to determine the state of Flag COND. Since the state of COND which has been set at 0 in Step a61 has not been cancelled in this case, SCOUNT is again decreased by 1 in Step a62. Accordingly, the factor $K_S$ is set by introducing 253/128 as the term SCOUNT/128 in Step a55. After the factors $K_o$ and $K_{AF}$ are determined, the individual outputs $V_f$, $V_r$ of the forward $O_2$ sensor 17 and rearward $O_2$ sensor 18 are read, and $V_r$ and $K_o$ are added to the memory which has been address-formatted by $V_f$. After increment of a datum number corresponding to $V_f$ thus added (Steps a56 and a59), the routine returns to Step a5 of FIG. 10(*a*) and as in the foregoing, again to Step a49 of FIG. 10(*d*).

Thereafter, the above-described processings are repeated until SCOUNT reaches 0 (SCOUNT=0). The air/fuel ratio is thus shifted successively from the lean side to the rich side (from about 0.95 to about 1.05 in terms of $K_S$ value). By reading the individual outputs $V_f$,$V_r$ of the forward $O_2$ sensor 17 and rearward $O_2$ sensor 18 in the course of the shifting of the air/fuel ratio, it is possible to perform the second measurements of the $V_f$-$V_r$ characteristics and $V_f$-$K_o$ characteristics when the air/fuel ratio is shifted from the lean side to the rich side around the stoichiometric air/fuel ratio. As a result, the $V_f$-$V_r$ characteristics and $V_f$-$K_o$ characteristics have been measured back and forth around the theoretical air/fuel ratio (the range of from about 1.05 to about 0.95 in terms of the value of $K_S$).

When SCOUNT reaches 0, the routine is switched to the YES route in Step a50. After decreasing the scan cycle counter by 1, Flag COND is changed to 1 (Step a52).

Accordingly, the air/fuel ratio is shifted again from the rich side to the lean side and then in the opposite direction, thereby performing the third and fourth measurements of the $V_f$-$V_r$ characteristics and $V_f$-$K_o$ characteristics.

When the above measurements of the $V_f$-$V_r$ characteristics and $V_f$-$K_o$ characteristics have been performed back and forth several times (the number of these reciprocations being dependent on the initial value set in the scan cycle counter), the value of the scan cycle counter becomes 0 in Step a51. When the routine has thereafter returned again to Step a49, the YES route is taken to perform the processing of Step a63 shown in FIG. 10(*e*). Namely, in Step a63, an average value $\overline{V}_r[(V_f)_i]$ of $V_r$ for $(V_f)_i$ measured by that time is calculated. Upon calculation of the average value, the count number of the $V_f$ counter is used.

After determination of the average $V_r$ value in the above manner, the $\overline{V}_r$-$V_f$ curve is smoothened by a suitable interpolation method or the like in Step a64. The characteristics thus obtained [see FIG. 8(*c*) of the first embodiment] are the $V_r$-$V_f$ characteristics shown in FIG. 8(*b*) of the first embodiment.

The routine then advances to Step a65. A $V_f$ range satisfying $d\overline{V}_r/dV_f > K$, namely, a $V_f$ range where $V_r$ rises abruptly is determined. In Step a66, the median of the $V_f$ range is chosen as the rich/lean-judging standard value $V_{fc}$. This new value $V_{fc}$ is stored in the BURAM 33. Thus, the rewriting of the standard value $V_{fc}$, namely, the renewal of the standard value $V_{fc}$ has been completed.

In Step a55-2, $K_o$ corresponding to the $V_{fc}$ is set as $K_{oc}$, and the completion flag for the checking of correction of the $O_2$ sensor is set in Step a67.

The routine thereafter returns to Step a5 of FIG. 10(*a*). If the operation is not in the fuel cut-off zone, the NO route is taken in Step a6 and the processings of Steps a7–a9 are then performed. If the answers of Steps a7–a9 are all "YES", it is judged in Step a13' whether the completion flag for the calculation of the FB characteristic values has been set or not. Since this flag is in a reset state in Step a71-2, the NO route is again taken in Step a13'. If the standard value rewriting conditions are satisfied, it is judged in Step a42' whether the completion flag for the checking of the $O_2$ sensor has been set or not. In the present case, the flag has already been set subsequent to the renewal of the standard value in Step a67 of FIG. 10(*e*). The routine hence advances through the YES route to Step a72 of FIG. 10(*f*), where a judgement is made to determine whether the cycle counter is 0 or not. Since the initial value other than 0 has been set in this case in Step a41-2 of FIG. 10(*c*), the NO route is taken and in Step a73, it is judged whether the operation is in the rich mode or in the lean mode. If it is judged to be in the rich mode, the factor $K_{AF}$ is set as $K_{oc} \times 1.1$ in Step a74 and in Step a75, it is judged whether the output of the forward $O_2$ sensor 17 has been reversed from the lean level to the rich level.

Thereafter, the value DTLR corresponding to the the response time $\tau_{LR}$ from the lean level to the rich level of the output of the forward $O_2$ sensor 17 is measured in Step 76. The contents of the cycle counter are decreased by 1 in Step a77, and the routine returns to Step a5 of FIG. 10(*a*).

Here, the measurement of DTLR is carried out by measuring the time until the output of the forward $O_2$ sensor 17 is reversed from the lean level to the rich level after an injection command is sent to the solenoid valve 8. This may be practised, for example, in the following manner. When the DTLR measuring counter is always maintained in a reset state until the injection command is produced and after the production of the injection command, the counter is caused to perform counting either upwardly or downwardly and the output of the forward $O_2$ sensor 17 is reversed from the lean level to the rich level, the above counting is stopped and the value at this time is latched as DTLR.

When the operation is found to be in the lean mode in Step a73, the factor $K_{AF}$ is set at $K_{oc} \times 0.9$ ($K_{AF} = -K_{oc} \times 0.9$) in Step a78 and in Step a79, it is judged whether the output of the forward $O_2$ sensor 17 has been reversed from the rich level to the lean level.

Thereafter, the value DTRL corresponding to the the response time $\tau_{RL}$ from the rich level to the lean level of the output of the forward $O_2$ sensor 17 is measured in Step a80. The contents of the cycle counter are decreased by 1 in Step a77, and the routine returns to Step a5 of FIG. 10(*a*).

Here, the measurement of DTRL is also carried out by measuring the time until the output of the forward $O_2$ sensor 17 is reversed from the rich level to the lean level after an injection command is sent to the solenoid valve 8. This may also be practised, for example, in the following manner. The DTRL measuring counter is always maintained in a reset state until the injection command is produced. After the production of the injection command, the counter is caused to perform counting either upwardly or downwardly. The counting is stopped when the output of the forward $O_2$ sensor 17 is reversed from the rich level to the lean level. The value at this time is latched as DTRL.

When the cycle counter reaches 0 by repeating the measurements of DTLR and DTRL in the above manner, the YES route is taken in Step a72 and the average values of DTLR and DTRL are calculated in Step a81.

The response times $\tau_{RL}$,$\tau_{LR}$ of the forward $O_2$ sensor 17 have been determined in the above manner. As is understood from the above description, such response times $\tau_{RL}$,$\tau_{LR}$ can be determined by giving a periodic air/fuel ratio mode such as that shown in FIGS. 12(*a*) and 12(*b*) while the air/fuel feedback is maintained as an open loop under such a load as that employed upon determination of the $V_f$-$V_r$ characteristics shown in FIG. 8(*b*). Here, the median $(A/F)_c$ of the air/fuel ratio variation mode shown in FIG. 12(*a*) corresponds to the median $K_c$ which gives $V_{fc}$.

Thereafter, the air/fuel ratio feedback characteristic value is set from these average values in Step a82.

Where there is a considerable difference between the average number of DTLR and that of DTRL for example, the median $K_c$ of the correction factor is shifted to the lean side or rich side when $\tau_{LR} \neq \tau_{RL}$. Depending on the difference between these average values, any one of the response delay times DLYRL,DLYLR, proportional gains $P_{RL}$,$P_{LR}$ and integral gains $I_{RL}$,$I_{LR}$ is corrected. The thus-corrected value is then stored in the memory.

As a result, the degree of shifting of the median $K_c$ approaches 0 so that it is corrected toward the stoichiometric air/fuel ratio. After the response delay times, proportional gains and integral gains have been corrected in the above manner (it is not essential to correct all of these characteristic values for the air/fuel ratio feedback control, the completion flag for the calculation of the delay time is set in Step a83, the drive distance datum OD is inputted in Step a68, and the next standard value rewriting distance ODX is set for example at ODX+800 miles in Step a69. The routine thereafter returns to Step a5.

After the routine has returned to Step a5 of FIG. 10(*a*), the NO route is taken in Step a6 unless the operation is in the fuel cut-off zone. Subsequent to the processings of Steps a7–a9, if the answers of Steps a10–a12 are all "YES", it is judged in Step a13' whether the completion flag for the calculation of the FE characteristic values has been set or not. Since the flag has been set in Step a83 of FIG. 10(*f*), the above-described routine work for normal driving, said work being defined by Step a14 and its subsequent steps, is performed.

Needless to say, in this case, the air/fuel ratio control is performed on the basis of the rich/lean-judging standard value $V_{fc}$ renewed as described above and if necessary, in accordance with the characteristic values (DLYRL, DLYLR, $P_{RL}$, $P_{LR}$, $I_{RL}$, $I_{LR}$) for the air/fuel ratio feedback control, which values have been corrected based on the response times $\tau_{RL}$,$\tau_{LR}$.

Since the rich/lean-judging standard value $V_{fc}$ to be compared with the output $V_f$ of the forward $O_2$ sensor 17 can be changed and renewed on the basis of both outputs $V_f$,$V_r$ of the forward $O_2$ sensor 17 and rearward $O_2$ sensor 18 and moreover, the characteristic values for the air/fuel ratio feedback control are corrected in accordance with the response time of the forward $O_2$ sensor 17, the accuracy of the control does not vary even by variations in characteristics from one $O_2$ sensor to another and variations of the characteristics of each $O_2$ sensor along the passage of time and more over, the cleaning efficiency of exhaust gas by the catalytic converter 9 is maintained high. High control reliability can thus be assured like the first embodiment described before.

Even when EGR is not performed or even when EGR is performed at a low rate, a good exhaust gas quality level is achieved. The EGR system can therefore be simplified and in addition, the power performance and drivability are not sacrificed by exhaust gas.

The system of the first embodiment can exhibit particularly great effects when the response times $\tau_{RL}$,$\tau_{LR}$ are substantially equal to each other ($|\tau_{RL}-\tau_{LR}| \leqq 10$ msec), while the system of the second embodiment is particularly effective when the difference between $\tau_{RL}$ and $\tau_{LR}$ is great ($|\tau_{RL}-\tau_{LR}| > 10$ msec).

Incidentally, the rich/lean judgement voltage $V_{fc}$ and the characteristic values (DLYRL, DLYLR, $P_{RL}$, $P_{LR}$, $I_{RL}$, $I_{LR}$) for the air/fuel ratio feedback control, said values being subjected to corrections, are stored stored in the BURAM 33 and the stored values are not erased by the turn-off of the ignition switch 26 alone. However, the contents of the memory are erased when the battery 24 is disconnected. When the battery 24 is found to have a history of disconnection in Step a2 of FIG. 10(*a*), representative $V_f$ value (for example, values of DLYRL, DLYLR, $P_{RL}$, $P_{LR}$, $I_{RL}$, $I_{LR}$) are tentatively inputted as an intial value in Step a70. Thereafter, the resetting of the completion flag for the checking of correction of the $O_2$ sensor is performed in Step a71. Further, the resetting of the completion flag for the calculation of the FB characteristic values is also performed in Step a71-2.

When the completion flag for the checking of correction of the $O_2$ sensor and the completion flag for the calculation of the FB characteristic values have been reset as described above, the NO route is taken in Step a13' of FIG. 10(*b*), and after the standard value rewriting conditions are satisfied and the standard value rewriting pre-processing is performed, the rich/lean-judging standard value $V_{fc}$ is rewritten and the response times $\tau_{RL}$,$\tau_{LR}$ are also determined. One or more of the characteristic values (DLYRL, DLYLR, $P_{RL}$, $P_{LR}$, $I_{RL}$, $I_{LR}$) for the air/fuel ratio feedback control are hence corrected on the basis of these response times. The processing in this case is exactly the same as the processing upon the above-described rewriting of the standard value and the aforementioned correction of characteristic values for the air/fuel ratio feedback control. Its detailed description is therefore omitted herein.

The air/fuel ratio control system according to the third embodiment of this invention, which is suitable for use with an internal combustion engine, will next be described with reference to FIGS. 13–31.

In addition to the performance of the first embodiment described before, the output $V_r$ of the rearward $O_2$ sensor 18 is measured during the air/fuel ratio feedback control and one or more of the response delay times DLYRL,DLYLR, proportional gains $P_{RL}$,$P_{LR}$ and the integral gains $I_{RL}$,$I_{LR}$ are corrected on the basis of the output $V_r$.

In the air/fuel ratio feedback control making use of the $O_2$ sensors, the third embodiment also compares the output $V_f$ from the forward $O_2$ sensor 17 with the predetermined standard value $V_{fc}$ (an intermediate value between the high-level output of the forward $O_2$ sensor 17 and the low-level output thereof being chosen as the standard value $V_{fc}$ and said standard value $V_{fc}$ serving as a so-called rich/lean judgement voltage) and renders the air-fuel mixture richer when $V_{fc} > V_f$ but makes it leaner when $V_{fc} \leqq V_f$.

Figure 13:
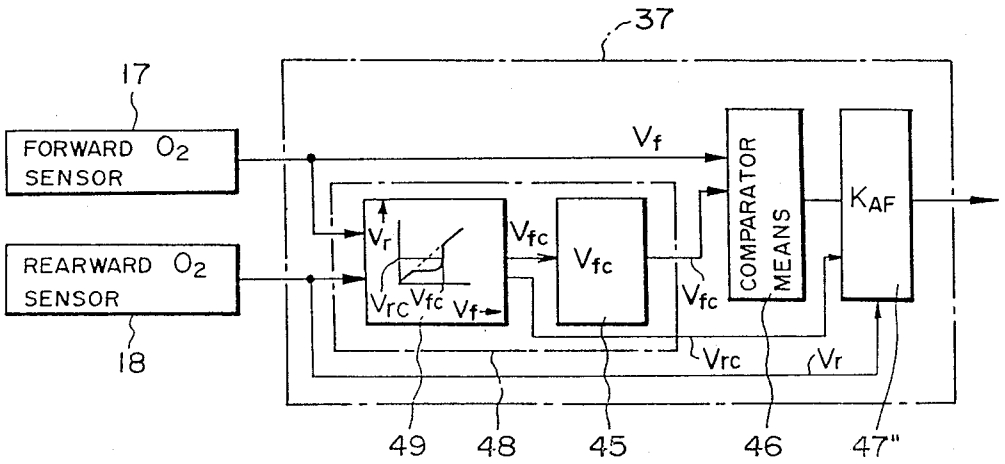
Figure 14A:
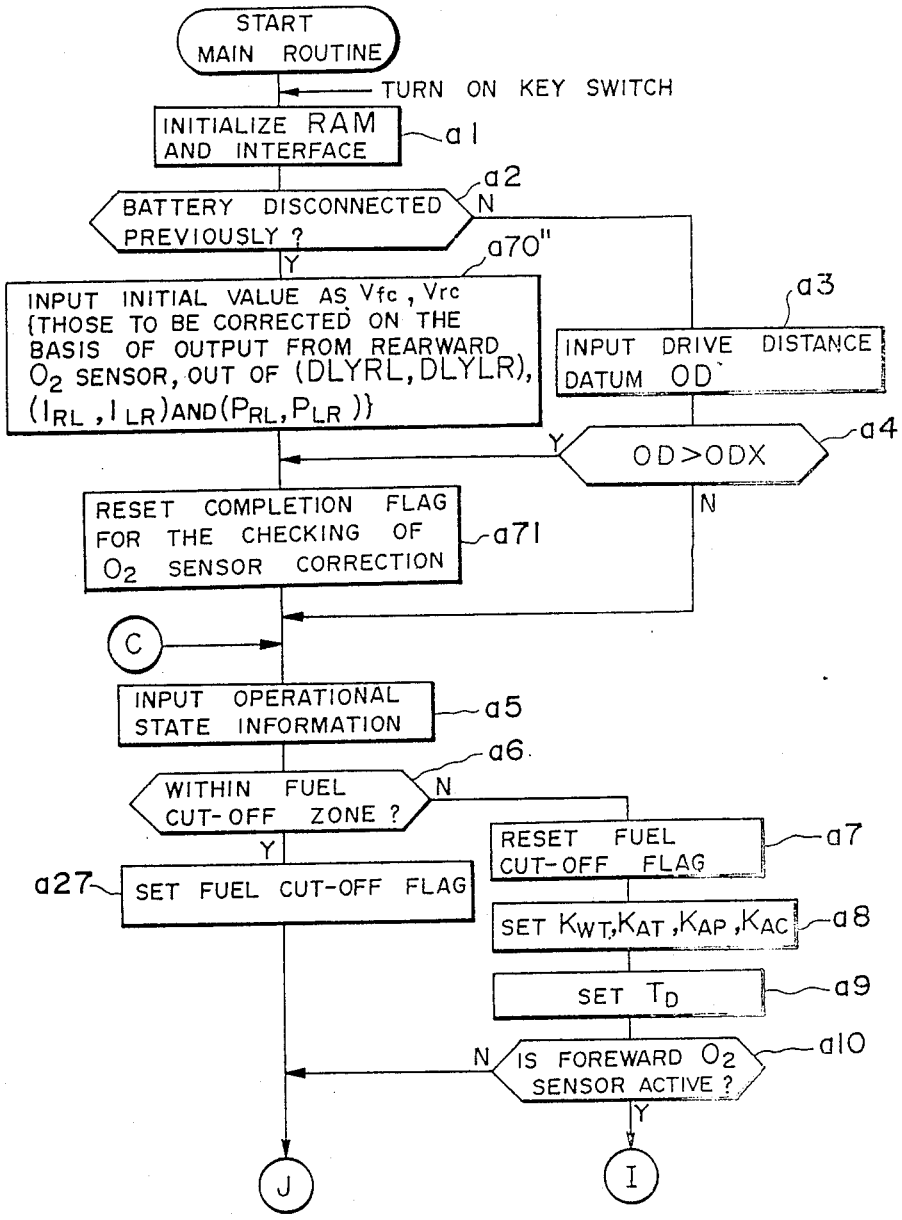
Figure 14B:
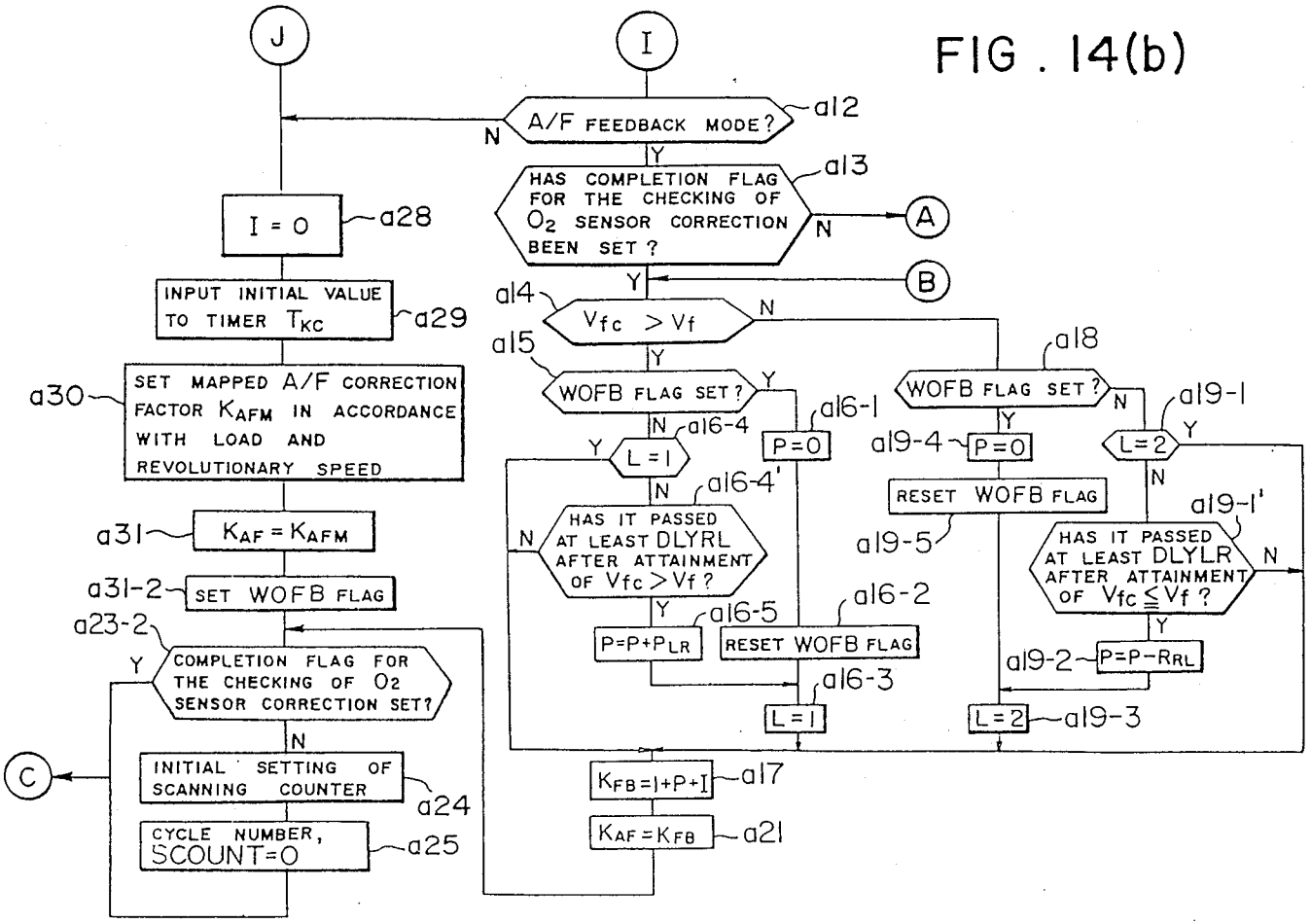
Figure 14C:
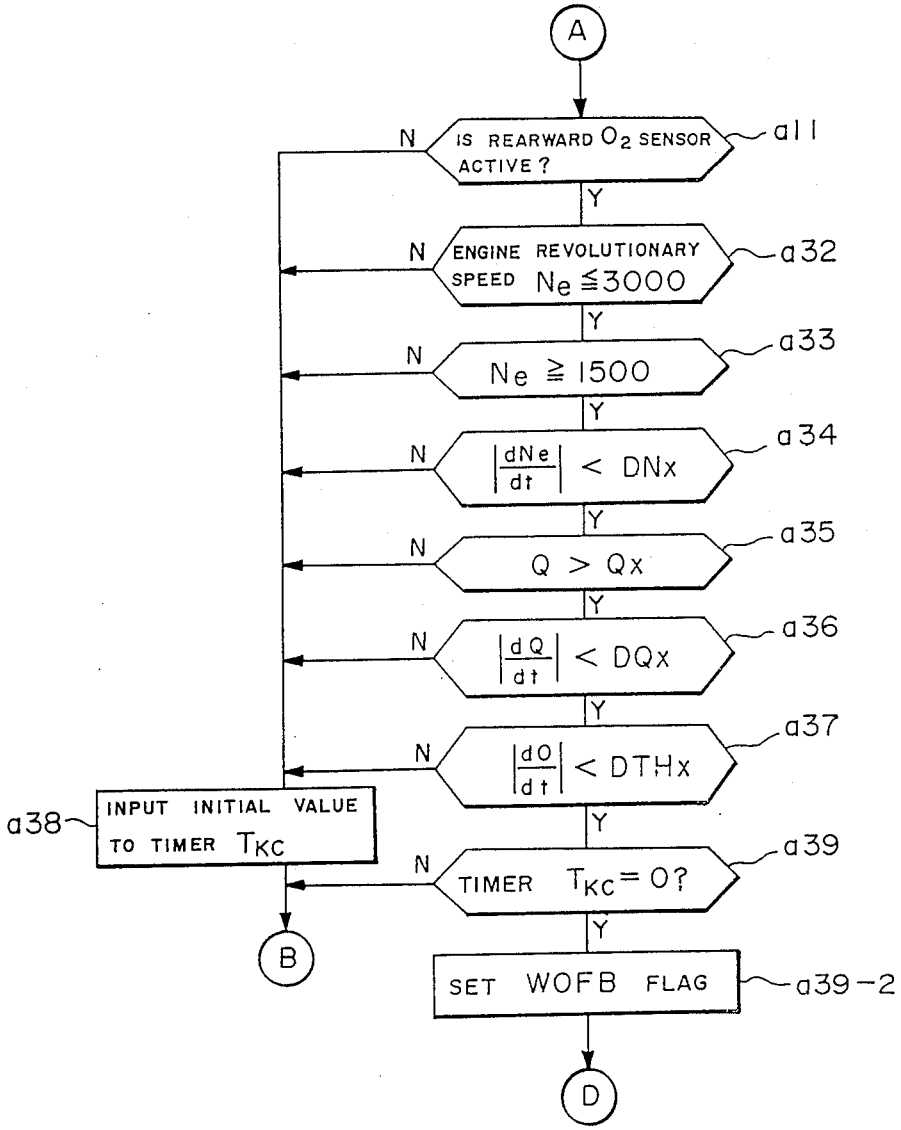
Figure 14D:
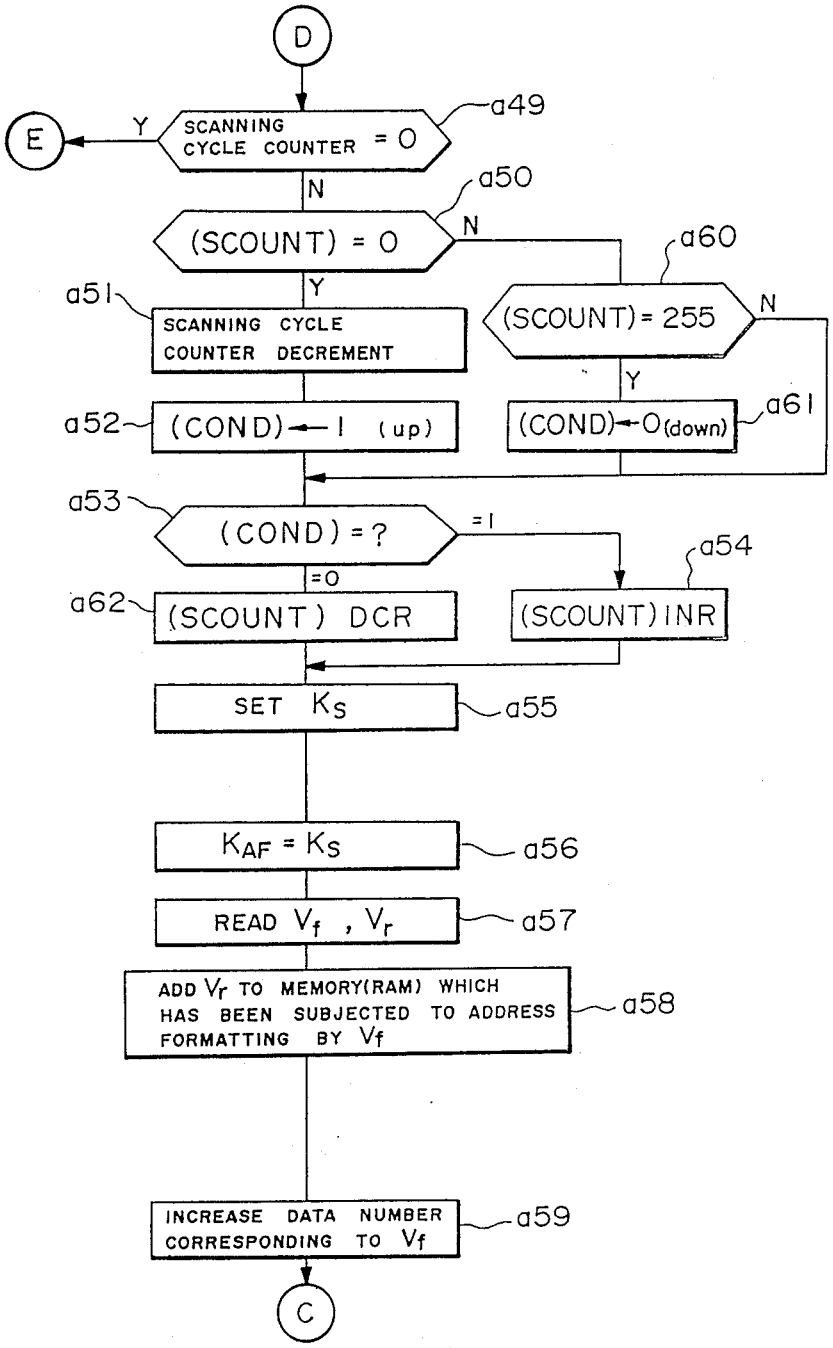
Figure 14E:
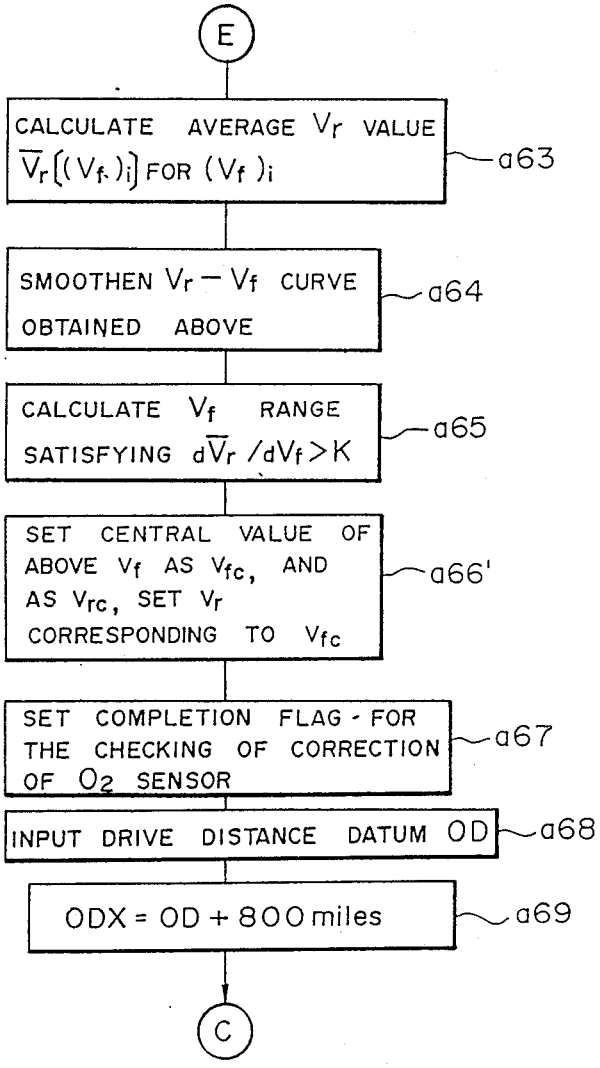

Accordingly, the $O_2$ sensor feedback correction means 37 has, as depicted in FIG. 13, the rich/lean judgement voltage setting means 45 for setting the standard value $V_{fc}$, the comparator means 46 for comparing the output $V_f$ from the forward $O_2$ sensor 17 with the standard value $V_{fc}$ from the rich/lean judgement voltage setting means 45, and a correction factor determinaion means 47" for determining the air/fuel ratio correction factor $K_{AF}$ in accordance with comparison results from the comparator means 46. Different from conventional systems, the present air/fuel ratio control system is also equipped with the standard value changing means 48 for allowing to change the standard value (rich/lean judgement voltage) $V_{fc}$ on the basis of the outputs $V_f$ and $V_r$ from the forward $O_2$ sensor 17 and rearward $O_2$ sensor 18, for example, for every predetermined drive distance.

The correction factor determination means 47" includes a means correcting any of the response delay times DLYRL,DLYLR, proportional gains $P_{RL}$,$P_{LR}$ and integral gains $I_{RL}$,$I_{LR}$ on the basis of the output $V_r$ of the rearward $O_2$ sensor 18 measured during the air/fuel ratio feedback control.

Incidentally, the above-described $V_f$-$V_r$ characteristics and the response delay times DLYRL,DLYLR, proportional gains $P_{RL}$,$P_{LR}$ and integral gains $I_{RL}$,$I_{LR}$ corrected in accordance with the standard values $V_{fc}$,$V_{rc}$ or the output $V_r$ of the rearward $O_2$ sensor 18 are stored in the BURAM 33.

The main routine for changing and renewing the rich/lean-judging standard value $V_{fc}$ for every predetermined drive distance or after every history of battery disconnection may be illustrated as shown in FIGS. 14(*a*) through 14(*e*). Since these flow charts are substantially the same as those depicted in FIGS. 4(*a*) through 4(*e*), the same processings as those in FIGS. 4(*a*) through 4(*e*) are identified by like step numbers and their description is omitted herein. Incidentally, the standard value rewriting distance DOX is backed up by the battery. In FIGS. 14(*a*) through 14(*e*), steps different from those shown in FIGS. 4(*a*) through 4(*e*) are Steps a70", a16-4', a19-1' and a23-2 in FIGS. 14(*a*) and 14(*b*) and Step a66' in FIG. 14(*e*).

Figure 31:
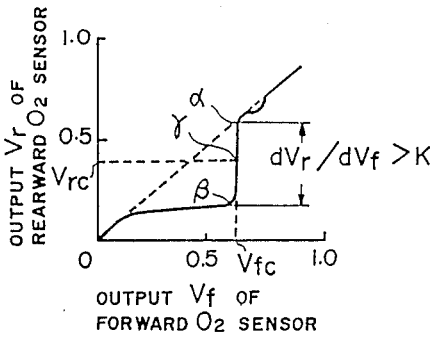

In Step a70" first of all, initial values are inputted with respect to the standard value $V_{rc}$ of the output of the rearward $O_2$ sensor, besides $V_{fc}$ {those to be corrected on the basis of the output of the rearward $O_2$ sensor out of (DLYRL,DLYLR), ($I_{RL}$,$I_{LR}$) and ($P_{RL}$,$P_{LR}$)}. Here, the standard value $V_{rc}$ is determined in the following manner. As illustrated in FIG. 31, the output value of the rearward $O_2$ sensor 18 corresponding substantially to the central point of a range in which $d/V_r/dV_f$ is greater than a certain inclination [see FIG. 14(*e*), Step a65] is determined as the standard value $V_{rc}$. When $V_{fc}$ is about 0.6 volt by way of example, $V_{rc}$ is about 0.4 volt.

If $V_{rc}$ is set at a point $\alpha$ in FIG. 31, the cleaning efficiency of CO is deteriorated. If $V_{rc}$ is set at a point $\beta$ on the contrary, the cleaning efficiency of $NO_x$ is impaired. $V_{rc}$ is therefore set at the central point $\gamma$ as described above.

In Step a66', the median of the $V_f$ range determined in Step a65 is set as $V_{fc}$ and in addition, $V_r$ corresponding to this $V_{fc}$ is set as $V_{rc}$ This $V_{rc}$ is the output value $V_r$ of the rearward $O_2$ sensor 18, which corresponds to the point $\gamma$ described above.

In the above-described manner, the standard value $V_{rc}$ of the output of the rearward $O_2$ sensor (said $V_{rc}$ being available from $V_{fc}$ as mentioned above) is also renewed for the prescribed drive distance or at every history of battery disconnection in the third embodiment, in addition to the the rich/lean-judging standard value $V_{fc}$ which is to be compared with the output $V_f$ of the forward $O_2$ sensor 17. Namely, these these values $V_{fc}$,$V_{rc}$ are not set as fixed values but are set as variable values.

By the way, Step a23-2 is similar to its corresponding step described in the second embodiment. Further, Steps a16-4' and 19-1' are also similar to their corresponding ones described in the second embodiment. In both steps, it is judged after the attainment of $V_{fc}>V_f$ whether the delay time DLYRL has lapsed or not and after the attainment of $V_{fc}<V_f$ whether the delay time DLYLR has lapsed or not. In the third embodiment, DLYRL and DLYLR are however determined in a manner different from those in the second embodiment.

A description will next be made of a method for correcting the response delay times DLYRL,DLYLR, proportional gains $P_{RL}$,$P_{LR}$ and integral gains $I_{RL}$,$I_{LR}$ on the basis of the output $V_r$ of the rearward $O_2$ sensor and the standard value $V_{rc}$.

Figure 15:
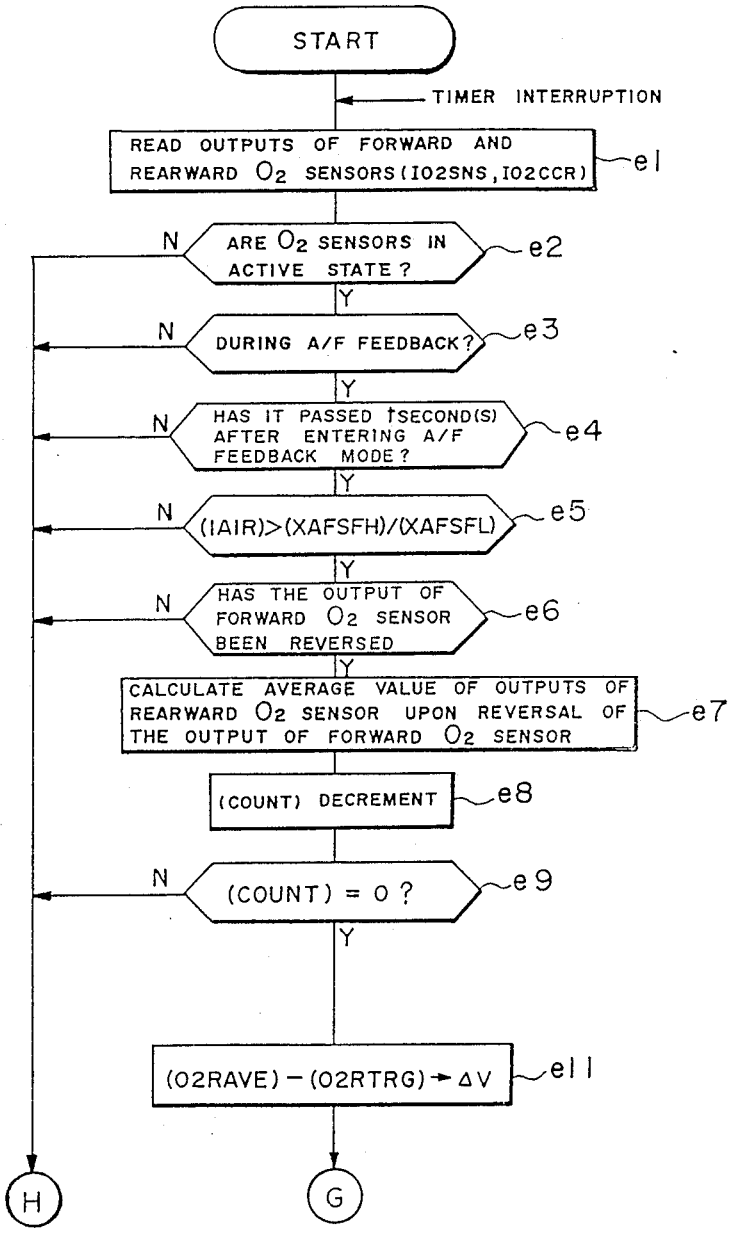

As shown in FIG. 15, the outputs IO2SNS ($V_f$) and IO2CCR ($V_r$) of the forward and rearward $O_2$ sensors 17,18 are read in first of all in Step e1. As the timing of their reading, they may be read in, for example, every 5 msec or every 10 msec. In Step e2, it is then judged from the output voltage values of the forward and rearward $O_2$ sensors 17,18 whether they are in an active state or not.

For the above judgement, it should be noted that separate standard voltage values can be set for the forward $O_2$ sensor 17 and rearward $O_2$ sensor 18.

If both $O_2$ sensors 17,18 are in the active state, it is judged in Step e3 whether the operation is in the air/fuel ratio feedback or not. If the answer is "YES", the routine advances to Step e4 where a judgement is made to determined whether a predetermined period of time has lapsed after the entering in the air/fuel ratio feedback mode. If the answer is "YES", it is judged in Step e5 whether the output frequency IAIR of the airflow sensor 11, namely, the intake air quantity is greater than a preset value.

As the preset value, two values are set, one being a first preset value (XAFSFH) and the other a second preset value (XAFSFL). A judgement is made by using these different preset values, one when the output of the airflow sensor increases and the other when it decreases. Namely, hysteresis has been set for the judgement in Step a5, thereby bringing about an advantage for the preventing of hunting.

In an operational state featuring a small intake air quantity (during idling or the like), the response of the $O_2$ sensors is slow and the output characteristics of the $O_2$ sensors are different. A judgement such as that performed in Step e5 is therefore carried out. It is also feasible to perform the following correction separately when the output frequency of the airflow sensor is lower than a preset value. In this case, learning is performed twice.

If the answer is "YES" in Step e5, it is judged in the next Step e6 whether the output of the forward $O_2$ sensor has been reversed or not. Incidentally, $V_{fc}$ determined and renewed in the above-described main routine [FIGS. 4(*a*) through 4(*e*)] is used as the rich/lean-judging standard value $V_{fc}$ for each output of the forward $O_2$ sensor 17.

When the answer is "NO" in any one of Steps e2–e6, the routine returns.

When the answer is "YES" in Step e6, the average output value of the rearward $O_2$ sensor is renewed on the basis of the short-term output value IO2CCR of the rearward $O_2$ sensor at the time of reversal of the output of the forward $O_2$ sensor and the average output value of the rearward $O_2$ already in storage. Namely, a new average output value O2RAVE of the rearward $O_2$ sensor, which is expressed by the lefthand member of the following equation, is determined as follows.

$$O2RAVE = Kl(IO2CCR) + (1 - Kl)(02RAVE)$$

Incidentally, O2RAVE in the right-hand member of the above formula indicates the last datum of the average output value of the rearward $O_2$ sensor, which had replaced the previous one in Step e7 of the last performance of the time interruption routine and has been stored in the RAM.

Here, Kl is a factor set as a datum in the ROM.

In addition, the contents of the counter COUNT are reduced by 1 in Step e8. Here, the initial value of the counter is set by the data of the ROM and a desired value from 1 to 255 may be set by way of example. This initial value was set in the counter in Step al of the main routine shown in FIG. 14(*a*), when the key switch was turned on.

In the next Step e9, it is judged whether the number of the counter has been counted down to 0. If the answer is "NO", the routine returns. When the answer becomes "YES" (namely, the smoothening processing of output data of the rearward $O_2$ sensor has been performed fully), the routine advances to Step e11 where from a target output voltage value O2RTRG (which corresponds to $V_{rc}$) of the rearward $O_2$ sensor and the average output value O2RAVE of the rearward $O_2$ sensor 18 at the time of rich/lean reversal of the forward $O_2$ sensor 17, the deviation $\Delta V$ between these values is determined. By the way, the initial value upon turning on the key switch is set equal to the same value as the target output value, namely, O2RTRG.

When the deviation $\Delta V$ has been determined as described above, the characteristic values for the air/fuel ratio feedback control, namely, the response delay times, integral gains and proportional gains are corrected by using $\Delta X$.

Since variations of the output $V_r$ of the rearward $O_2$ sensor 18 are slow during the air/fuel ratio feedback control, it is not preferable to use the output $V_r$ directly for the air/fuel ratio feedback control. The output $V_r$ is however produced with substantially the same delay when the fuel/gas ratio changes from the lean side to the rich side and from the rich side to the lean side. It is hence useful for such corrections of characteristic values for the air/fuel ratio feedback control as described above.

Figure 16:
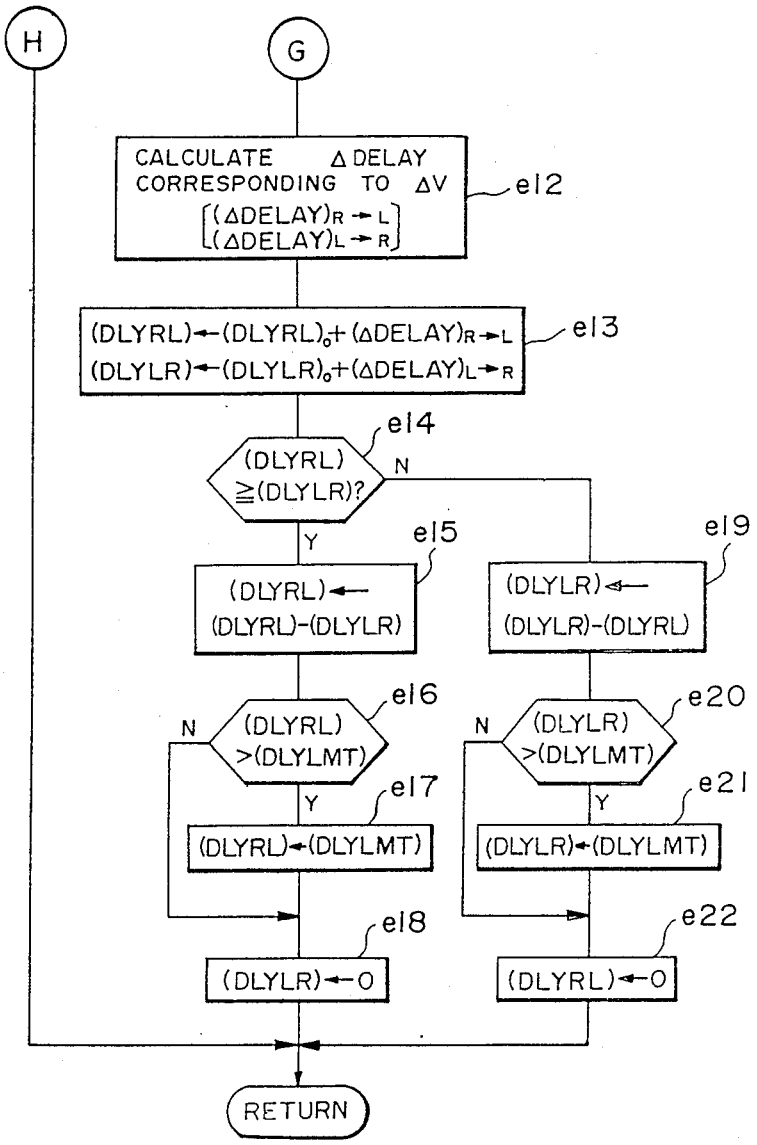

The corrections of the response delay times DLYRL,RLYLR are described first of all. As shown in FIG. 16, $\Delta$DELAY corresponding to $\Delta V$ obtained in Step ell of FIG. 15 is determined first of all in Step e12.

Figure 19A:
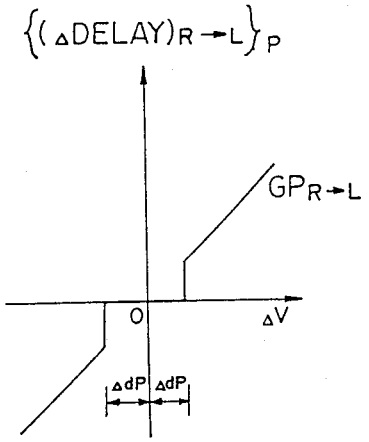
Figure 19B:
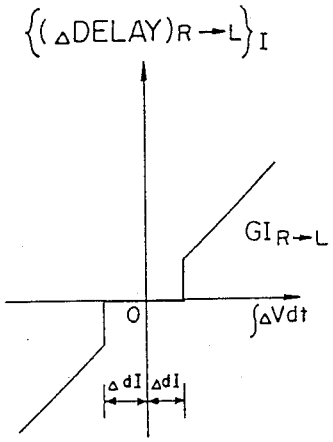
Figure 20A:
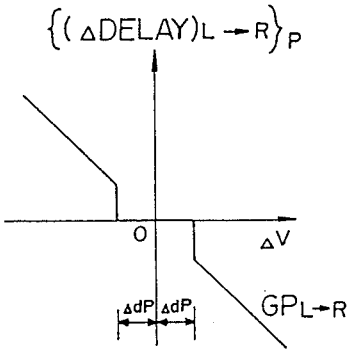
Figure 20B:
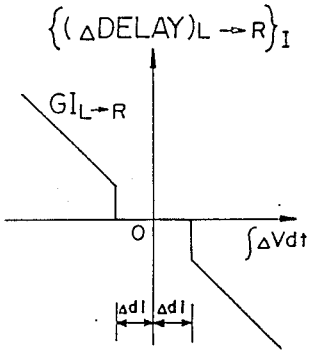
Figure 21A:
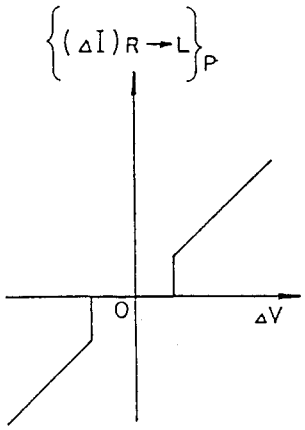
Figure 21B:
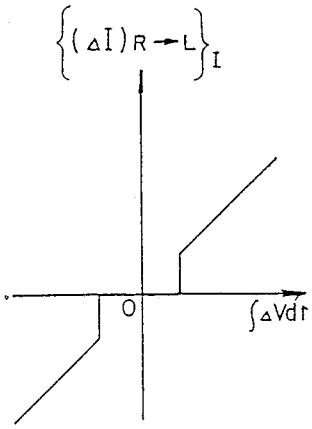

By the way, there are two kinds of delays as $\Delta$DELAY, one being a delay that takes place when the air/fuel ratio changes from the rich side to the lean side and the other being a delay that occurs when the air/fuel ratio changes from the lean side to the rich side. Correction characteristics for the former delay may be illustrated as shown in FIGS. 19(*a*) and 19(*b*), while those for the latter delay may be depicted as shown in FIGS. 20(*a*) and 20(*b*). Namely, $\Delta$DELAY is given as the sum of $\{\Delta DELAY\}_P$ based on a short-term value of $\Delta V$ and $\{\Delta DELAY\}_I$ based on an integrated value of $\Delta V$. It may hence be expressed as follows.

$$(\Delta DELAY)_{R\to L}=\{(\Delta DELAY)_{R\to L}\}_I+\{(\Delta DELAY)_{R\to L}\}_P$$

$$(\Delta DELAY)_{L\to R}=\{(\Delta DELAY)_{L\to R}\}_I+\{(\Delta DELAY)_{L\to R}\}_P$$

Inclinations GP,GI shown in these FIGS. 19(*a*) and 19(*b*) and FIGS. 20(*a*) and 20(*b*) as well as dead zones $\Delta$dP,$\Delta$dI are set in the ROM data.

After determination of $\Delta$DELAYs in the above manner, these $\Delta$DELAYs are added respectively to standard values $(DLYRL)_o$ and $(DLYLR)_o$ of DLYRL and DLYLR in Step e13, thereby determining new DLTRL and DLYLR.

In the next Step e14, it is judged whether DLYRL is either equal to or greater than DLYLR (DLYRL>DLYLR). If the answer is "YES", results obtained by subtracting DLYLR from DLYRL are set as new DLYRL in Step e15. In the next Step e16, it is judged whether DLYRL is greater than DLYLMT (delay limiting value: set by the ROM data) or not. While DLYRL has not reached this limiting value, Step e17 is jumped over, DLYLR is changed to 0 in Step e18, and the routine returns. When DLYRL reaches the limiting value, the limiting value is set as DLYRL in Step e17 and the processing of Step e18 is then applied.

If DLYRL<DLYLR in Step e14, results obtained by subtracting DLYRL from DLYLR are set as new DLYLR in Step e19. In the next Step e20, it is judged whether DLYLR is greater than DLYLMT (delay limiting value: set by the ROM data) or not. While DLYLR has not reached this limiting value, Step e2l is jumped over, DLYRL is changed to 0 in Step e22, and the routine returns. When DLYLR reaches the limiting value, the limiting value is set as DLYLR in Step e2l and the processing of Step e22 is then applied.

The delay limiting values compared in Steps e16,e20 respectively may be the same or different.

Although DLYRL and DLYLR are both backed up by a battery, their initial values in Step a70" are set at 0 by way of example.

When DLYRL and DLYLR are corrected on the basis of the output of the rearward $O_2$ sensor and the air/fuel ratio is rendered richer, DLYLR is added as shown in FIGS. 25(*a*) through 25(*c*). For rendering the air/fuel ratio leaner, DLYRL is added as illustrated in FIGS. 26(*a*) through 26(*c*).

As has been described above, the output $V_r$ of the rearward $O_2$ sensor 18 is measured during the air/fuel ratio feedback control at constant time intervals (or whenever the output $V_f$ of the forward $O_2$ sensor 17 crosses the standard value $V_{fc}$) and the correction of the response delay time is effected to make its moving average equal to $V_{rc}$. The third embodiment of this invention can therefore bring about substantially the same effects and advantages as each of the preceding embodiments and moreover, can perform the air/fuel ratio control with still higher reliability and accuracy.

Figure 17:
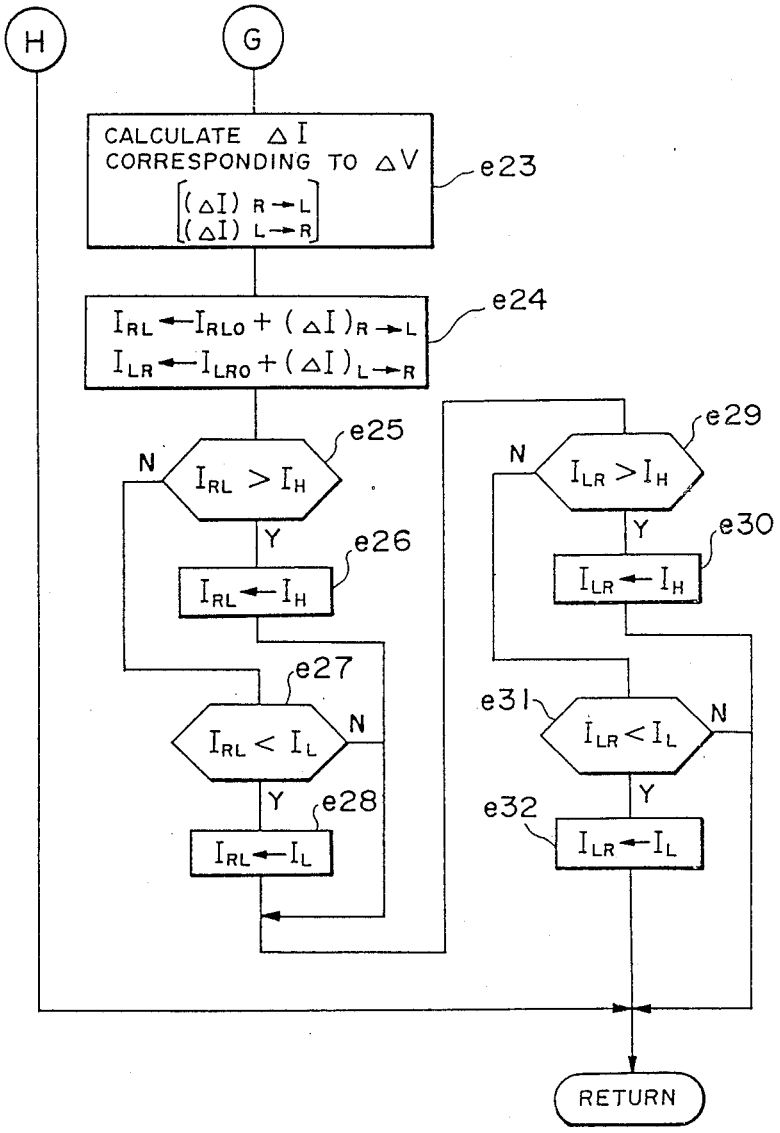

A description will next be made of the corrections of the integral gains $I_{RL}$,$I_{LR}$ for the air/fuel ratio feedback control. As illustrated in FIG. 17, $\Delta I$ corresponding to $\Delta V$ obtained in Step e11 of FIG. 15 is determined first of all in Step e23.

Figure 22A:
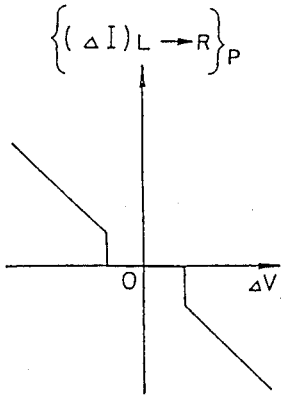
Figure 22B:
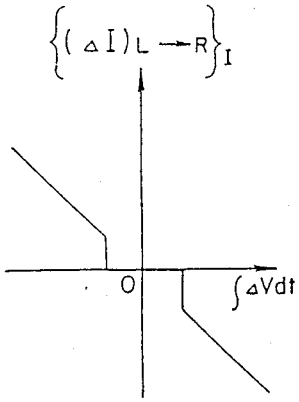

By the way, there are two kinds of integral gains as $\Delta I$, one being an integral gain for the change of the air/fuel ratio from the rich side to the lean side and the other being an integral gain for the change of the air/fuel ratio from the lean side to the rich side. Correction characteristics for the former integral gain may be illustrated as shown in FIGS. 2l(*a*) and 2l(*b*), while those for the latter integral gain may be depicted as shown in FIGS. 22(*a*) and 22(*b*). Namely, $\Delta I$ is given as the sum of $\{\Delta I\}_P$ based on a short-term value of $\Delta V$ and $\{\Delta I\}_I$ based on an integrated value of $\Delta V$. It may hence be expressed as follows.

$$(\Delta I)_{R\to L}=\{(\Delta I)_{R\to L}\}_I+\{(\Delta I)_{R\to L}\}_P$$

$$(\Delta I)_{L\to R}=\{(\Delta I)_{L\to R}\}_I+\{(\Delta I)_{L\to R}\}_P$$

Functional relations (inclinations and dead zones) shown in these FIGS. 2l(*a*) and 2l(*b*) and FIGS. 22(*a*) and 22(*b*) are set in the ROM data.

After determination of $\Delta$Is in the above manner, these $\Delta$Is are added respectively to standard values $I_{RLo}$ and $I_{LRo}$ of $I_{RL}$ and $I_{LR}$ in Step e24, thereby determining new $I_{RL}$ and $I_{LR}$.

In the next Step e25, it is judged whether $I_{RL}$ is greater than $I_H$ (upper limit: this value is set in the ROM data). If the answer is "NO", it is judged in Step e27 whether $I_{RL}$ is smaller than $I_L$ (lower limit: this value is set in the ROM data; $I_{RL}<I_L$).

If the answer is "YES" in Step e25, $I_H$ is set as $I_{RL}$ in Step e26. If the answer is "YES" in Step e27, $I_L$ is set as $I_{RL}$ in Step e28.

If the answer is "NO" in Step e27, after the processings of Steps e26,e28, it is judged in the next Step e29 whether $I_{LR}$ is greater than $I_H$ (upper limit: this value is set in the ROM data). If the answer is "NO", it is judged in Step e3l whether $I_{LR}$ is smaller than $I_L$ (lower limit: this value is set in the ROM data; $I_{LR}<I_L$).

If the answer is "YES" in Step e29, $I_H$ is set as $I_{LR}$ in Step e30. Further, if the answer is "YES" in Step e3l, $I_L$ is set as $I_{LR}$ in Step e32 and the routine then returns.

Incidentally, the individual upper limits compared in Steps e25,e29 may be the same or different. Further, the lower limits compared in Steps e27,e3l may also be the same or different.

Further, the integral gains $I_{RL}$ and $I_{LR}$ are both backed up by the battery.

When $I_{RL}$ and $I_{LR}$ are corrected on the basis of the output $V_r$ of the rearward $O_2$ sensor and the air/fuel ratio is rendered richer, $I_{RL}$ is rendered smaller and at the same time, $I_{LR}$ is rendered greater as illustrated in FIGS. 27(*a*) through 27(*c*). For rendering the air/fuel ratio leaner, $I_{RL}$ is rendered greater and at the same time, $I_{LR}$ is rendered smaller as illustrated in FIGS. 28(*a*) through 28(*c*).

As has been described above, the output $V_r$ of the rearward $O_2$ sensor 18 is measured during the air/fuel ratio feedback control at constant time intervals (or whenever the output $V_f$ of the forward $O_2$ sensor 17 crosses the standard value $V_{fc}$) and the correction of the integral gain is effected to make its moving average equal to $V_{rc}$. The third embodiment of this invention can therefore bring about substantially the same effects and advantages as each of the preceding embodiments and moreover, can perform the air/fuel ratio control with still higher reliability and accuracy.

Figure 18:
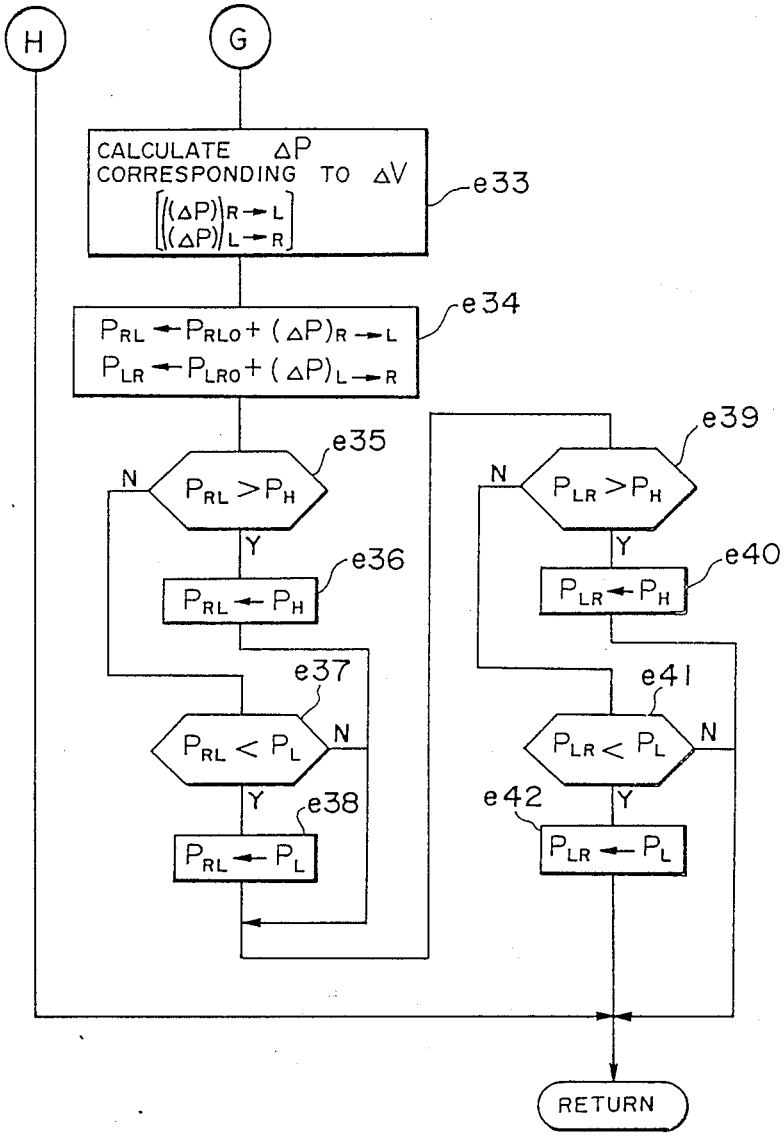

The corrections of the proportional gains $P_{RL}$,$P_{LR}$ for the air/fuel ratio feed back control will next be described. As illustrated in FIG. 18, ΔP corresponding to ΔV obtained in Step e11 of FIG. 15 is determined in Step e13.

Figure 23A:
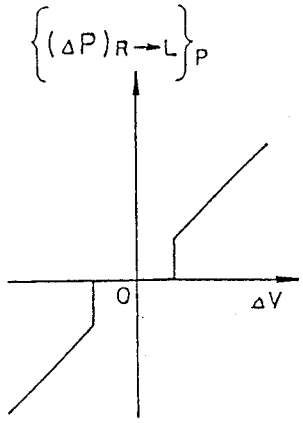
Figure 23B:
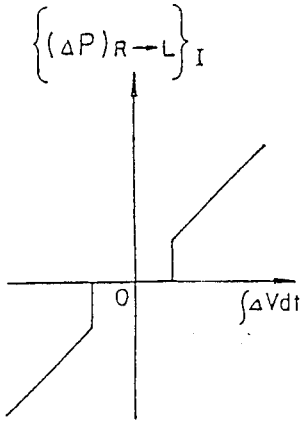
Figure 24A:
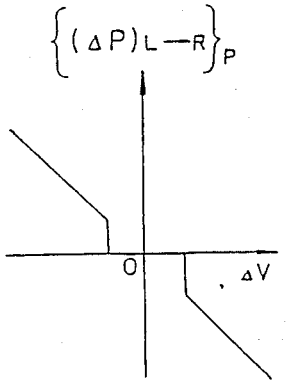
Figure 24B:
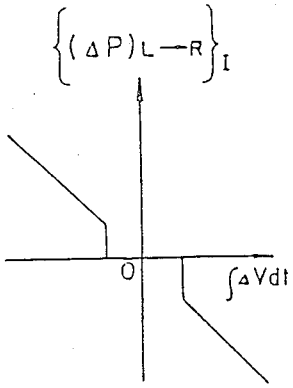

By the way, there are two kinds of proportional gains as ΔP, one being a proportional gain for the change of the air/fuel ratio from the rich side to the lean side and the other being a proportional gain for the change of the air/fuel ratio from the lean side to the rich side. Correction characteristics for the former proportional gain may be illustrated as shown in FIGS. 23(*a*) and 23(*b*), while those for the latter proportional gain may be depicted as shown in FIGS. 24(*a*) and 24(*b*). Namely, ΔP is given as the sum of $\{\Delta P\}_P$ based on a short-term value of ΔV and $\{\Delta P\}_I$ based on an integrated value of ΔV. It may hence be expressed as follows.

$$(\Delta P)_{R\to L}=\{(\Delta P)_{R\to L}\}_I+\{(\Delta P)_{R\to L}\}_p$$

$$(\Delta P)_{L\to R}=\{(\Delta P)_{L\to R}\}_I+\{(\Delta P)_{L\to R}\}_P$$

Functional relations (inclinations and dead zones) shown in these FIGS. 23(*a*) and 23(*b*) and FIGS. 24(*a*) and 24(*b*) are set in the ROM data.

After determination of ΔPs in the above manner, these ΔPs are added respectively to standard values $P_{RLo}$ and $P_{LRo}$ of $P_{RL}$ and $P_{LR}$ in Step e34, thereby determining new $P_{RL}$ and $P_{LR}$.

In the next Step e35, it is judged whether $P_{RL}$ is greater than $P_H$ (upper limit: this value is set in the ROM data). If the answer is "NO", it is judged in Step e37 whether $P_{RL}$ is smaller than $P_L$ (lower limit: this value is set in the ROM data; $P_{RL}<P_L$).

If the answer is "YES" in Step e35, $P_H$ is set as $P_{RL}$ in Step e36. If the answer is "YES" in Step e37, $P_L$ is set as $P_{RL}$ in Step e38.

If the answer is "NO" in Step e37, after the processings of Steps e36,e38, it is judged in the next Step e39 whether $P_{LR}$ is greater than $P_H$ (upper limit: this value is set in the ROM data; $P_{LR}>P_H$). If the answer is "NO", it is judged in Step e4l whether $P_{LR}$ is smaller than $P_L$ (lower limit: this value is set in the ROM data; $P_{LR}<P_L$).

If the answer is "YES" in Step e39, $P_H$ is set as $P_{LR}$ in Step e40. Further, if the answer is "YES" in Step e4l, $P_L$ is set as $P_{LR}$ in Step e42 and the routine then returns.

Incidentally, the individual upper limits compared in Steps e35,e39 may be the same or different. Further, the lower limits compared in Steps e37,e4l may also be the same or different.

Further, the proportional gains $P_{RL}$ and $P_{LR}$ are both backed up by the battery.

When $P_{RL}$ and $P_{LR}$ are corrected on the basis of the output $V_r$ of the rearward $O_2$ sensor and the air/fuel ratio is rendered richer, $P_{RL}$ is rendered smaller and at the same time, $P_{LR}$ is rendered greater as illustrated in FIGS. 29(*a*) through 29(*c*). For rendering the air/fuel ratio leaner, $P_{RL}$ is rendered greater and at the same time, $P_{LR}$ is rendered smaller as illustrated in FIGS. 28(*a*) through 28(*c*).

As has been described above, the output $V_r$ of the rearward $O_2$ sensor 18 is measured during the air/fuel ratio feedback control at constant time intervals (or whenever the output $V_f$ of the forward $O_2$ sensor 17 crosses the standard value $V_{fc}$) and the correction of the proportional gain is effected to make its moving average equal to $V_{rc}$. The third embodiment of this invention can therefore bring about substantially the same effects and advantages as each of the preceding embodiments and moreover, can perform the air/fuel ratio control with still higher reliability and accuracy.

In the third embodiment described above, only one or some of the response delay times, integral gains and proportional gains may be corrected in such a way that the moving average of the output $V_r$ of the rearward $O_2$ sensor 18 becomes equal to $V_{rc}$.

The air/fuel ratio control system according to the fourth embodiment of this invention, which is suitable for use with an internal combustion engine, will next be described with reference to FIGS. 32–53.

In the air/fuel ratio control system of the fourth embodiment, the output $V_r$ of the rearward $O_2$ sensor 18 is measured during the air/fuel ratio feedback control and one or more of the response delay times DLYRL,-DLYLR, proportional gains $P_{RL}$,$P_{LR}$ and integral gains $I_{RL}$,$I_{LR}$ are corrected on the basis of the output $V_r$. In addition, the rich/lean-judging standard value $V_{fc}$ (hereinafter called "O2RLL" in this embodiment) is also corrected in this embodiment.

In the air/fuel ratio feedback control making use of the $O_2$ sensors, the fourth embodiment also compares the output $V_f$ from the forward $O_2$ sensor 17 with the predetermined standard value O2RLL (an intermediate value between the high-level output of the forward $O_2$ sensor 17 and the low-level output thereof being chosen as the standard value O2RLL and said standard value O2RLL serving as the so-called rich/lean judgement voltage) and renders the air-fuel mixture richer when O2RLL$>V_f$ but makes it leaner when O2RLL$<V_f$.

Figure 32:
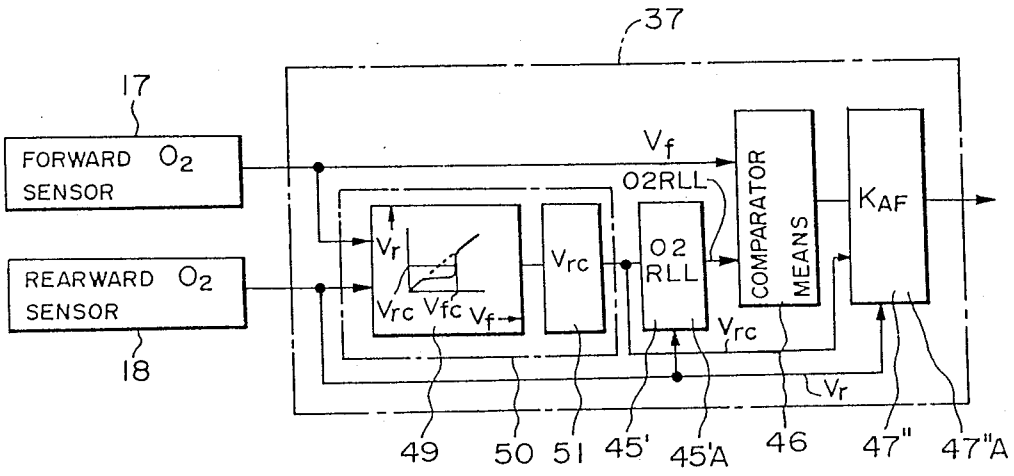
Figure 33A:
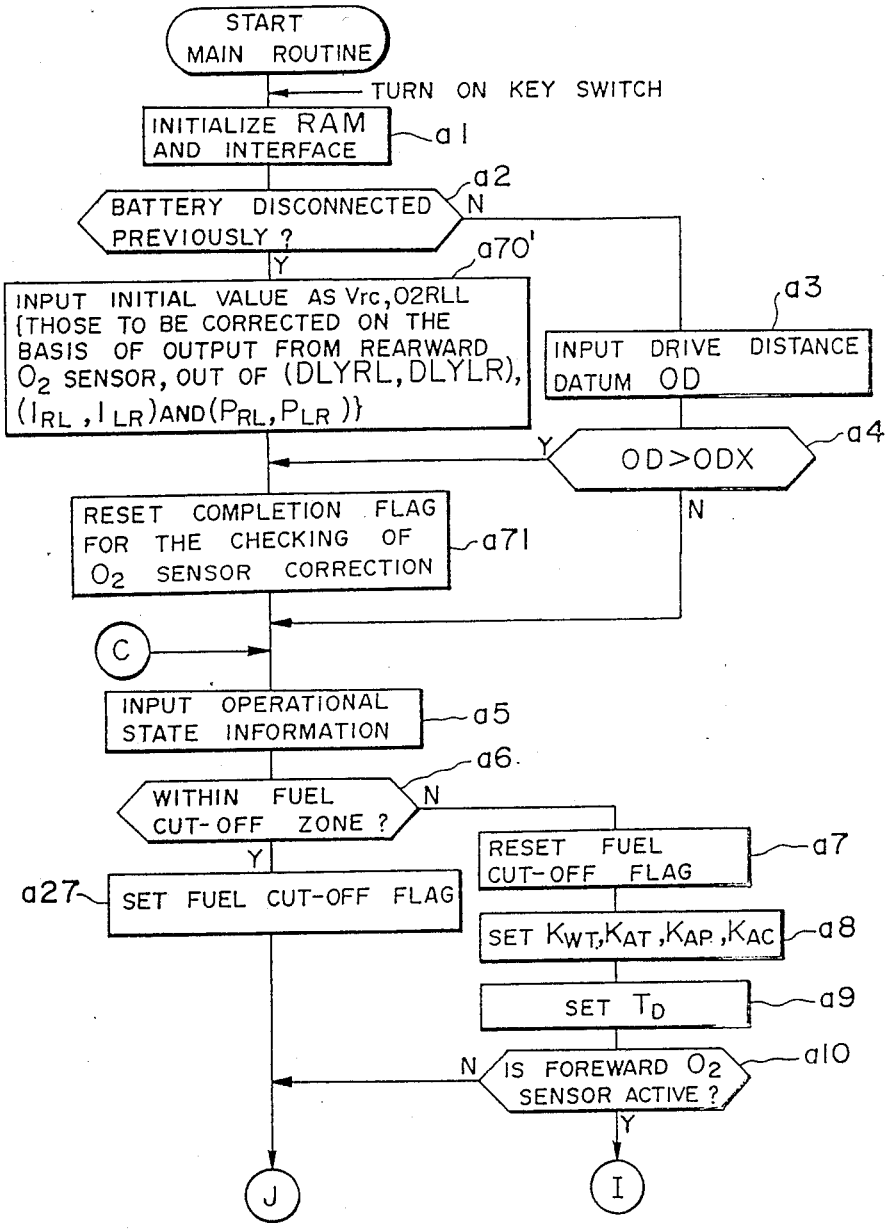
Figure 33B:
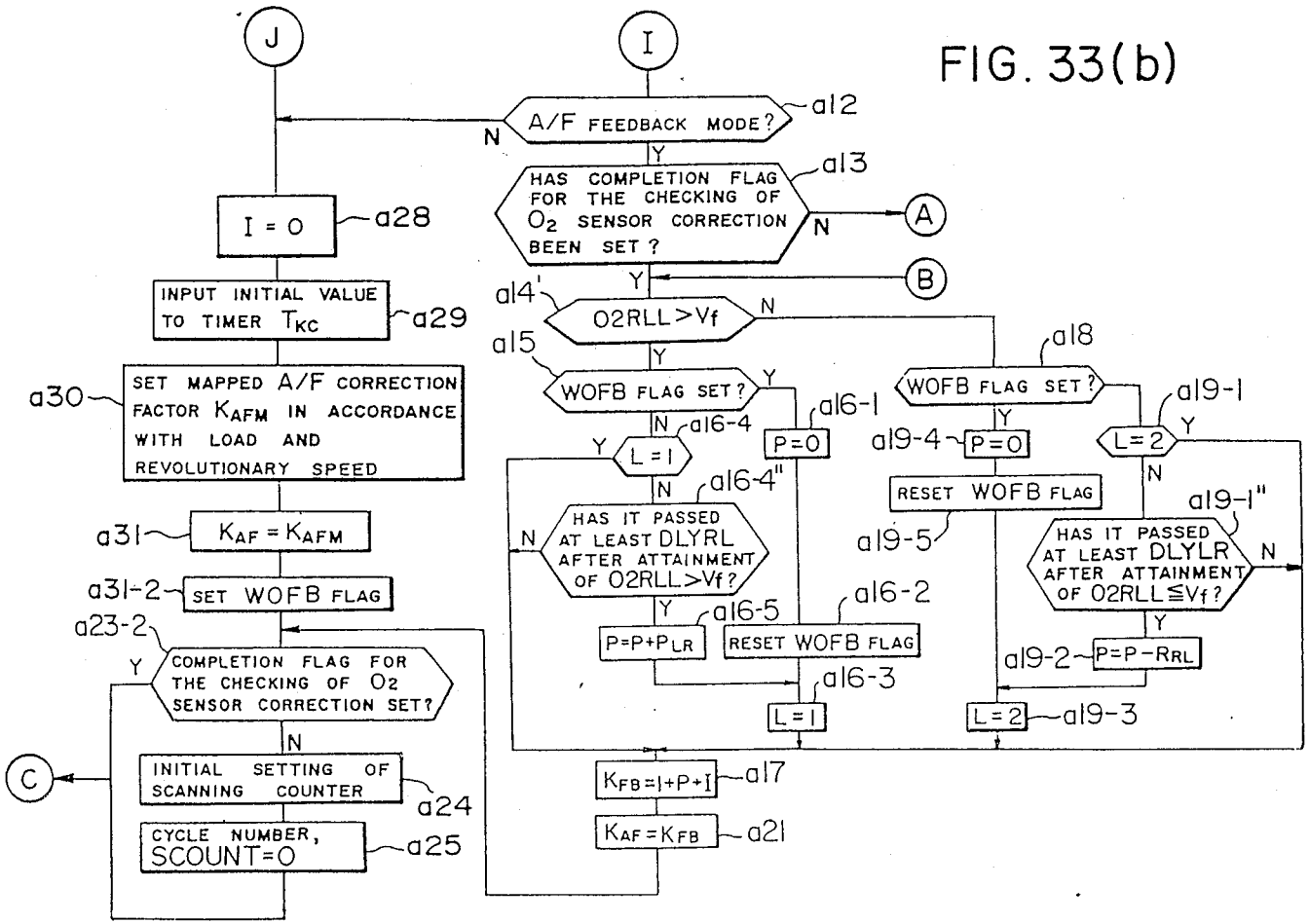
Figure 33C:
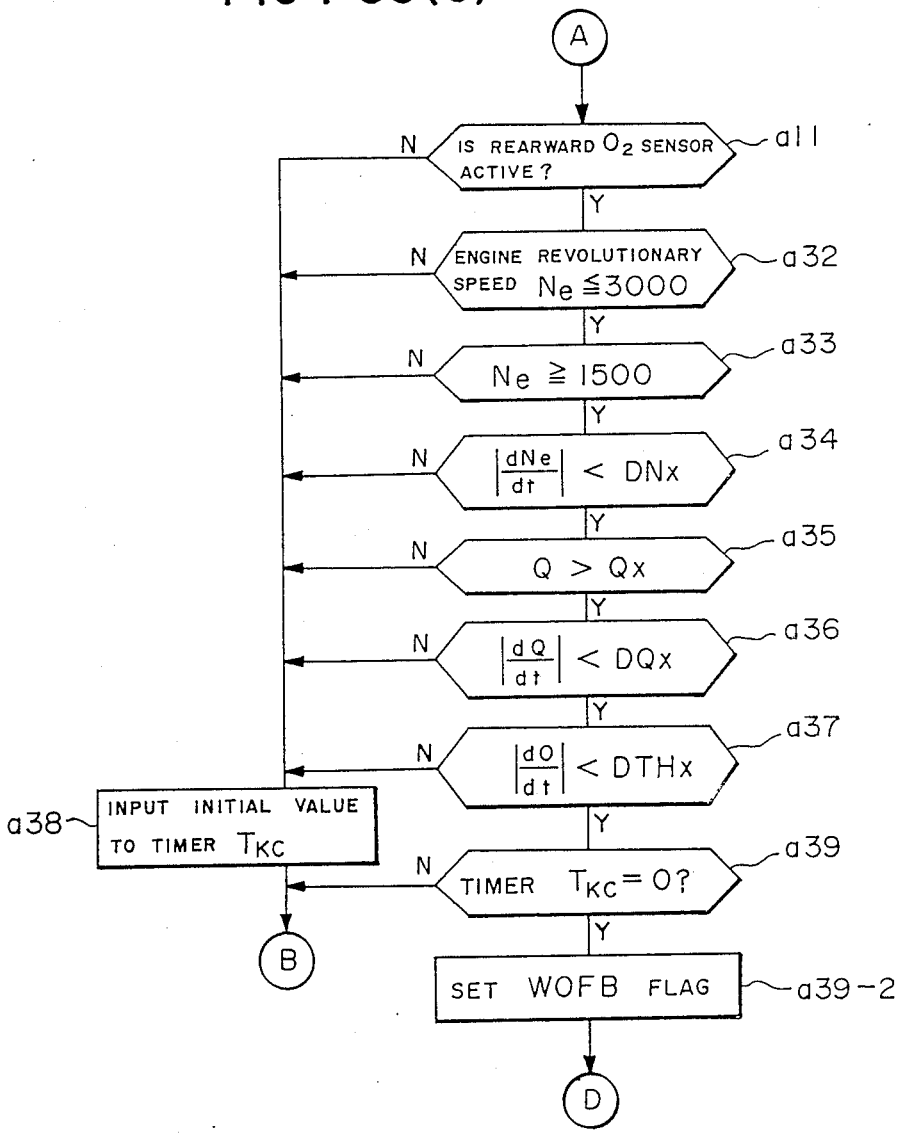
Figure 33E:
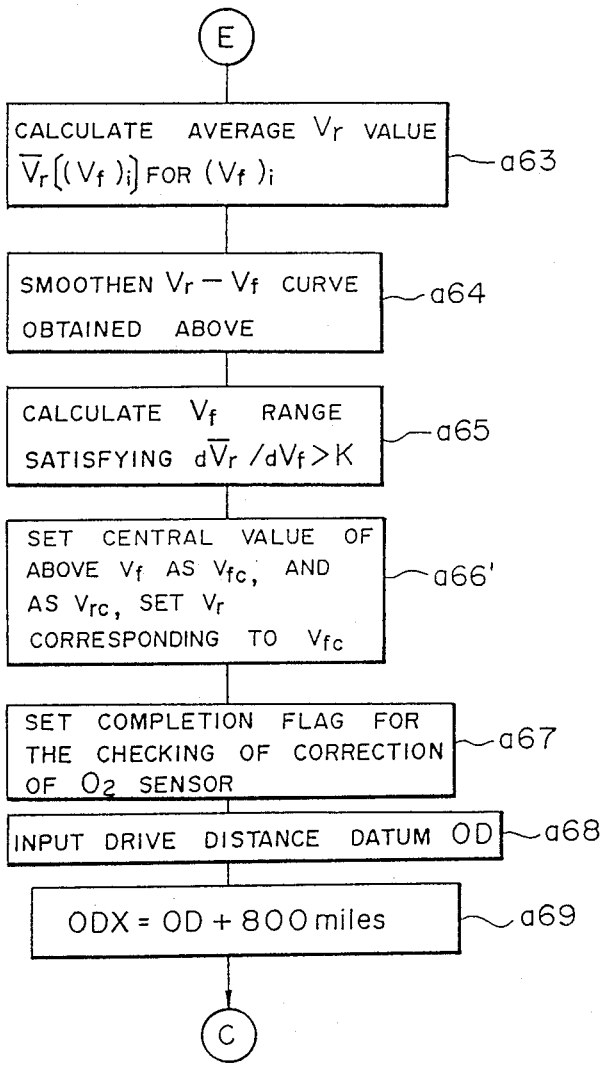
Figure 33D:
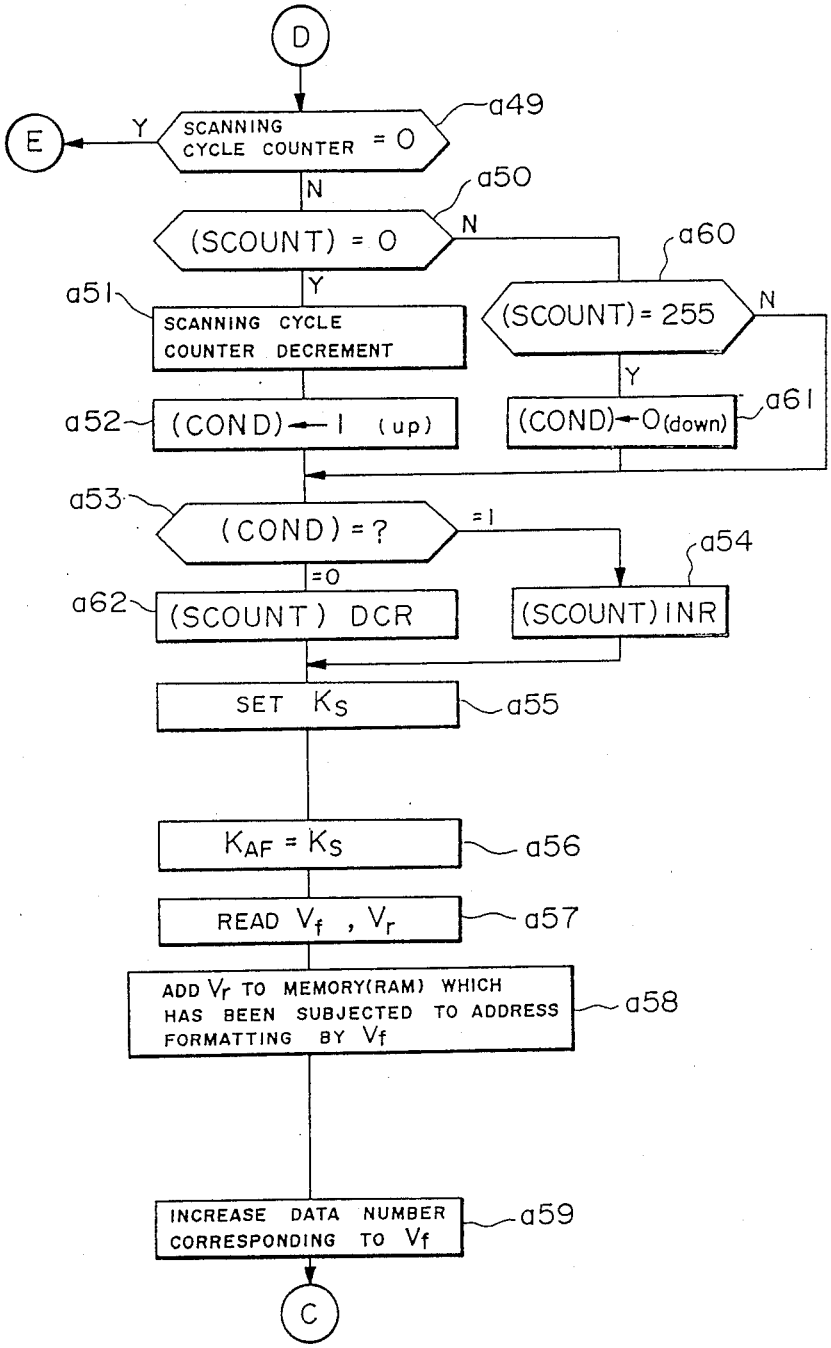

Accordingly, the $O_2$ sensor feedback correction means 37 has, as depicted in FIG. 32, a rich/lean judgement voltage setting means 45' for setting the standard value O2RLL, the comparator means 46 for comparing the output $V_f$ from the forward $O_2$ sensor 17 with the standard value 02RLL from the rich/lean judgement voltage setting means 45', and the correction factor determination means 47'' for determining the air/fuel ratio correction factor $K_{AF}$ in accordance with comparison results from the comparator means 46. The present air/fuel ratio control system is also equipped with the standard value changing means 50 for allowing to change the standard value $V_{rc}$ for the rearward $O_2$ sensor on the basis of the outputs $V_f$ and $V_r$ from the forward $O_2$ sensor 17 and rearward $O_2$ sensor 18, for example, for every predetermined drive distance (every predetermined operation time).

The correction factor determination means 50 includes a characteristic computing means 49 for computing characteristics between the outputs of the forward $O_2$ sensor 17 and rearward $O_2$ sensor 18, such as those illustrated in FIG. 8(*b*). A standard value $V_{rc}$ for the rearward $O_2$ sensor 18, which has been determined by the characteristic computing means 49, substitutes as a new standard value $V_{rc}$ for the previous one. A standard value setting means 51 has this function of renewal.

Further, a standard value $V_{rc}$ signal for the rearward $O_2$ sensor from the standard value setting means 51 is inputted to the rich/lean judgement voltage setting means 45' and correction factor determination means 47''. These rich/lean judgement voltage setting means 45' and correction factor determination means 47'' also function respectively as air/fuel ratio control correction means 45'A,47''A for effecting a correction to the air/fuel ratio control which is performed by the air/fuel control means on the basis of the results of a comparison between the standard value $V_{rc}$ for the rearward $O_2$ sensor 18 and the output $V_r$ from the rearward $O_2$ sensor 18. Namely, the air/fuel ratio control correction means 45'A in the rich/lean judgement voltage correction means 45' can correct the rich/lean-judging standard value O2RLL on the basis of the deviation $\Delta V$ between the standard value $V_{rc}$ for the rearward $O_2$ sensor and an output $V_r$ of the rearward $O_2$ sensor 18 measured during the air/fuel feedback control. On the other hand, the air/fuel ratio control correction means 47''A can correct any of the response delay times DLYRL,DLYLR, proportional gains $P_{RL}$,$P_{LR}$ and integral gains $I_{RL}$,$I_{LR}$ on the basis of the deviation $\Delta V$ between the standard value $V_{rc}$ for the rearward $O_2$ sensor and an output $V_r$ of the rearward $O_2$ sensor 18 measured during the air/fuel feedback control.

Incidentally, the above-described $V_f$-$V_r$ characteristics and the rich/lean judgement voltage O2RLL, response delay times DLYRL,DLYLR, proportional gains $P_{RL}$,$P_{LR}$ and integral gains $I_{RL}$,$I_{LR}$ corrected in accordance with the standard value $V_{rc}$ or the output $V_r$ of the rearward $O_2$ sensor 18 are stored in the BURAM 33.

The main routine for changing and renewing the rich/lean-judging standard value $V_{rc}$ for every predetermined drive distance or after every history of battery disconnection may be illustrated as shown in FIGS. 33(*a*) through 33(*e*). Since these flow charts are substantially the same as those depicted in FIGS. 14(*a*) through 14(*e*), the same processings as those in FIGS. 14(*a*) through 14(*e*) are identified by like step numbers and their description is omitted herein. Incidentally, the standard value rewriting distance DOX is backed up by the battery. In FIGS. 33(*a*) through 33(*e*), steps different from those shown in FIGS. 14(*a*) through 14(*e*) are Steps a14', a16-4'', a19-1'' and a70' in FIGS. 33(*a*) and 33(*b*).

Firstly, in Step a14', the standard value to be compared with the output $V_f$ of the forward $O_2$ sensor 17 is O2RLL as described above. In Step a16-4'' and Step a19-1'', it is also O2RLL in correspondence to Step a14'. In the air/fuel ratio feedback control making use of the $O_2$ sensors, the output $V_f$ from the forward $O_2$ sensor 17 and the desired standard value O2RLL (rich/lean judgement voltage) are therefore compared. The air-fuel ratio is rendered richer when O2RLL$>V_f$ but is made leaner when O2RLL$<V_f$.

In Step a70' first of all, initial values are inputted with respect to the rich/lean-judging standard value O2RLL, besides $V_{rc}$ and (those to be corrected on the basis of the output of the rearward $O_2$ sensor out of (DLYRL,DLYLR), ($I_{RL}$,$I_{LR}$) and ($P_{RL}$,$P_{LR}$)). Here, the standard value O2RLL may be set at about 0.6 volt by way of example.

A description will next be made of a method for correcting the response delay times DLYRL,DLYLR, proportional gains $P_{RL}$,PLR, integral gains $I_{RL}$,$I_{LR}$ and rich/lean-judging standard value O2RLL on the basis of the output $V_r$ of the rearward $O_2$ sensor and the standard value $V_{rc}$.

Figure 34:
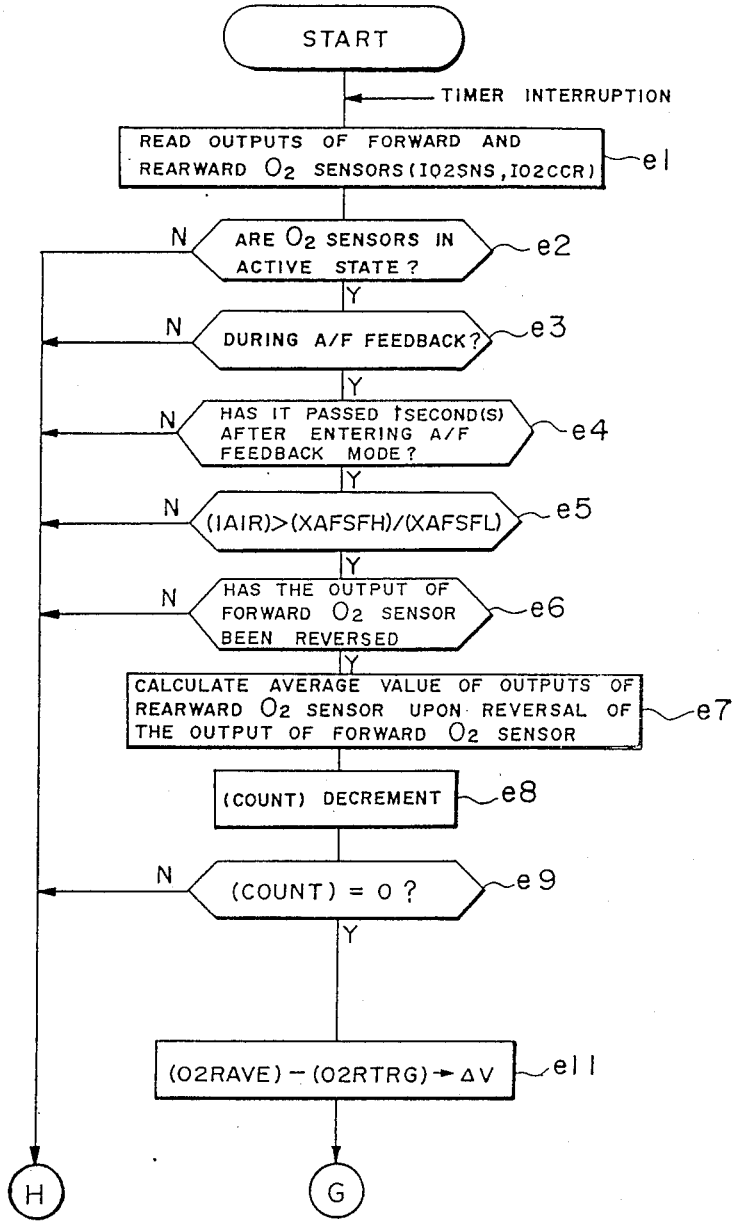

Firstly, from the target output voltage value O2RTRG (which corresponds to $V_{rc}$) of the rearward $O_2$ sensor 18 and the average output value O2RAVE of the rearward $O_2$ sensor 18 at the time of rich/lean reversal of the forward $O_2$ sensor 17, namely, from the standard value $V_{rc}$ for the rearward $O_2$ sensor and the output $V_r$ of the rearward $O_2$ sensor, the deviation $\Delta V$ between these values is determined. A flow chart for determining the deviation $\Delta$ is similar to that illustrated in FIG. 15 and may be shown as depicted in FIG. 34.

When the deviation $\Delta V$ has been determined as described above, the response delay times, integral gains and proportional gains are corrected by using $\Delta X$.

Since variations of the output $V_r$ of the rearward $O_2$ sensor 18 are slow during the air/fuel ratio feedback control, it is not preferable to use the output $V_r$ directly for the air/fuel ratio feedback control. The output $V_r$ is however produced with substantially the same delay when the fuel/gas ratio changes from the lean side to the rich side and from the rich side to the lean side. It is hence useful for such corrections of the response delay times, integral gains, proportional gains and rich/lean-judging standard value as described above.

Figure 35:
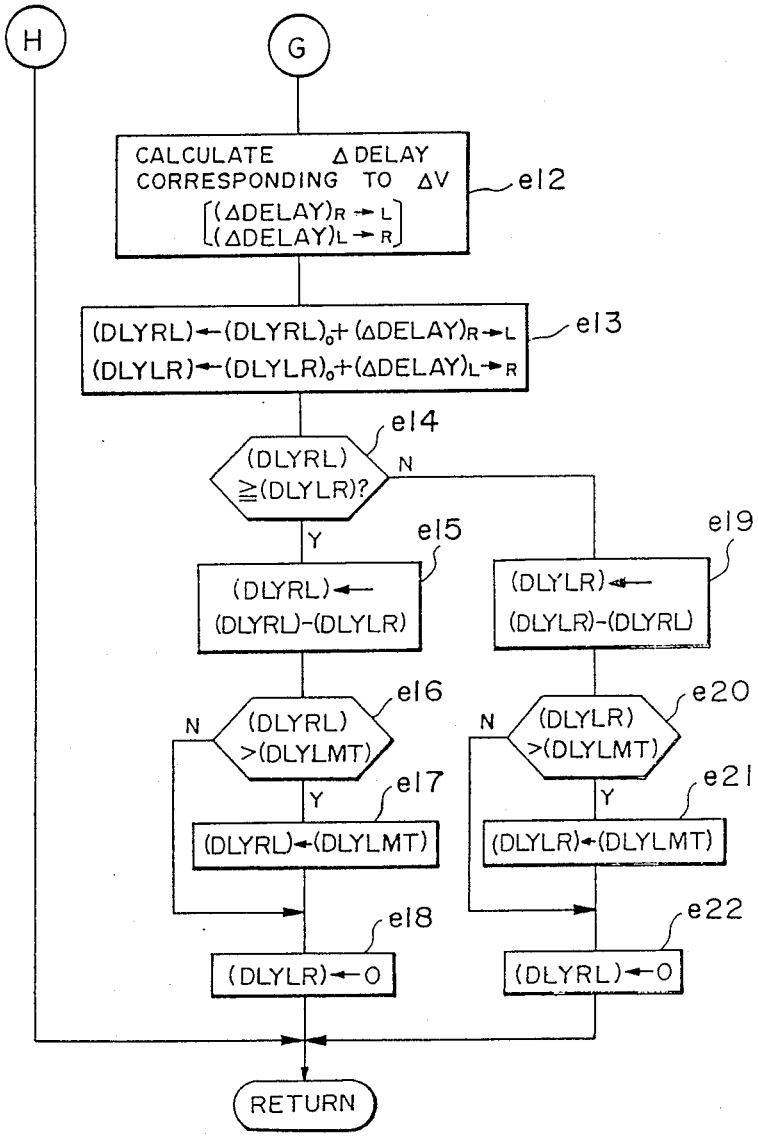

A flow chart for the correction of the response delay times DLYRL,RLYLR is similar to that described above with reference to FIG. 16 and may be illustrated as shown in FIG. 35.

Figure 39A:
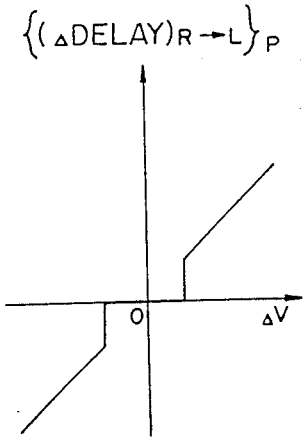
Figure 39B:
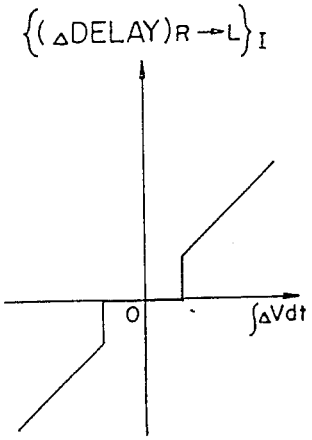
Figure 40A:
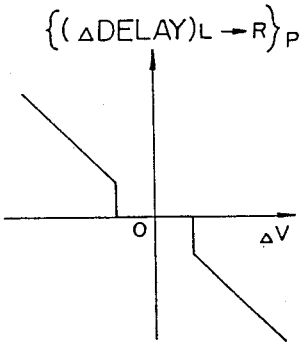
Figure 40B:
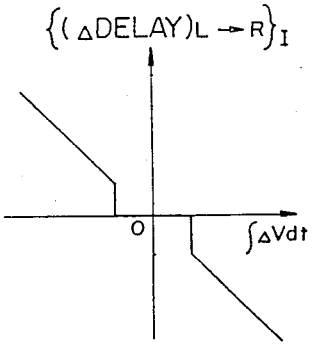

By the way, there are two kinds of delays as $\Delta$DELAY determined in accordance with $\Delta V$ in Step e12 of FIG. 35, one being a delay that takes place when the air/fuel ratio changes from the rich side to the lean side and the other being a delay that occurs when the air/fuel ratio changes from the lean side to the rich side. Correction characteristics for the former delay are similar to those shown in FIGS. 19(*a*) and 19(*b*) and may be illustrated as shown in FIGS. 39(*a*) and 39(*b*), while those for the latter delay are similar to those depicted in FIGS. 20(*a*) and 20(*b*) and may be illustrated as shown in FIGS. 40(*a*) and 40(*b*). Functional relations (inclinations and dead zones) shown in these FIGS. 39(*a*) and 39(*b*) and FIGS. 40(*a*) and 40(*b*) are set in the ROM data.

When DLYRL and DLYLR are corrected on the basis of the output of the rearward $O_2$ sensor and the air/fuel ratio is rendered richer, DLYLR is added as shown in FIGS. 46(*a*) through 46(*c*) likewise FIGS. 25(*a*) through 25(*c*). For rendering the air/fuel ratio leaner, DLYRL is added as illustrated in FIGS. 47(*a*) through 47(*c*) likewise FIGS. 26(*a*) through 26(*c*).

As has been described above, the output $V_r$ of the rearward $O_2$ sensor 18 is measured during the air/fuel ratio feedback control at constant time intervals (or whenever the output $V_f$ of the forward $O_2$ sensor 17 crosses the standard value $V_{fc}$) and the correction of the response delay time is effected to make its moving average equal to $V_{rc}$, whereby the air/fuel ratio control is corrected. The air/fuel ratio control can therefore be performed high reliability and accuracy.

Figure 36:
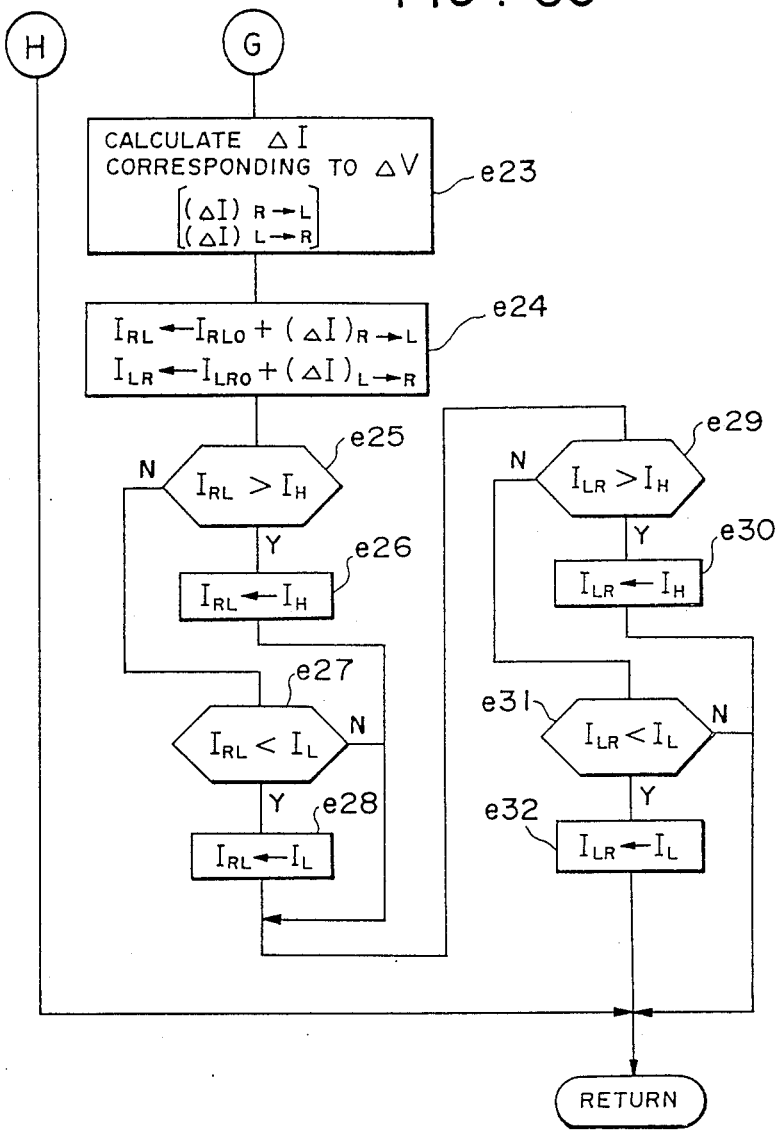

Next, a flow chart for the correction of the integral gains $I_{RL}$,$I_{LR}$ for the air/fuel ratio feedback control is similar to that described before with reference to FIG. 17 and may be illustrated as shown in FIG. 36.

Figure 41A:
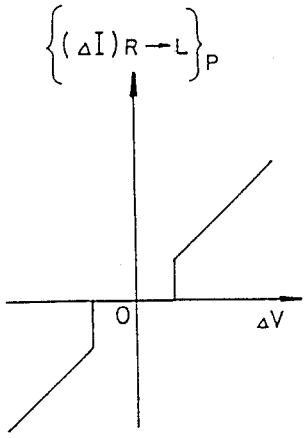
Figure 41B:
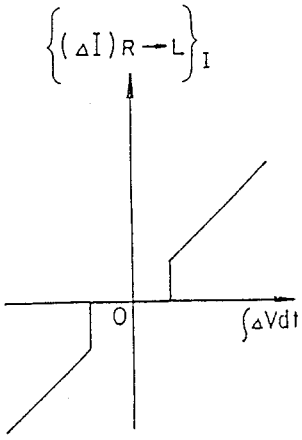
Figure 42A:
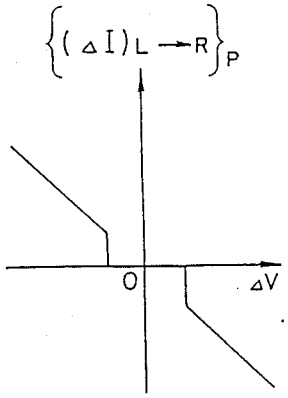
Figure 42B:
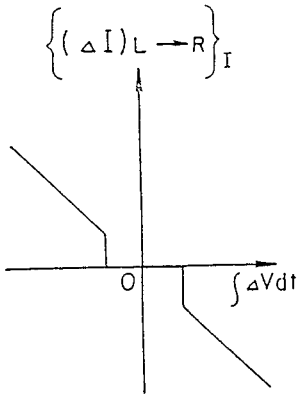

By the way, there are two kinds of integral gains as $\Delta I$ obtained in accordance with $\Delta V$ in Step e23 of FIG. 36, one being an integral gain for the change of the air/fuel ratio from the rich side to the lean side and the other being an integral gain for the change of the air/fuel ratio from the lean side to the rich side. Correction characteristics for the former delay are similar to those shown in FIGS. 21(*a*) and 21(*b*) and may be illustrated as shown in FIGS. 41(*a*) and 41(*b*), while those for the latter delay are similar to those depicted in FIGS. 22(*a*) and 22(*b*) and may be illustrated as shown in FIGS. 42(*a*) and 42(*b*). Functional relations (inclinations and dead zones) shown in these FIGS. 41(*a*) and 41(*b*) and FIGS. 42(*a*) and 42(*b*) are also set in the ROM data.

When $I_{RL}$ and $I_{LR}$ are corrected on the basis of the output of the rearward $O_2$ sensor and the air/fuel ratio is rendered richer, $I_{RL}$ is rendered smaller and at the same time, $I_{LR}$ is rendered greater as illustrated in FIGS. 48(*a*) through 48(*c*) likewise FIGS. 27(*a*) through 27(*c*). For rendering the air/fuel ratio leaner, $I_{RL}$ is rendered greater and at the same time, $I_{LR}$ is rendered smaller as illustrated in FIGS. 49(*a*) through 49(*c*) likewise FIGS. 28(*a*) through 28(*c*).

As has been described above, the output $V_r$ of the rearward $O_2$ sensor 18 is measured during the air/fuel ratio feedback control at constant time intervals (or whenever the output $V_f$ of the forward $O_2$ sensor 17 crosses the standard value $V_{fc}$) and the correction of the integral gain is effected to make its moving average equal to $V_{rc}$, whereby the air/fuel ratio feedback control is corrected. Here again, it is possible to bring about substantially the same effects and advantages as the aforementioned correction of the response delay times.

Figure 37:
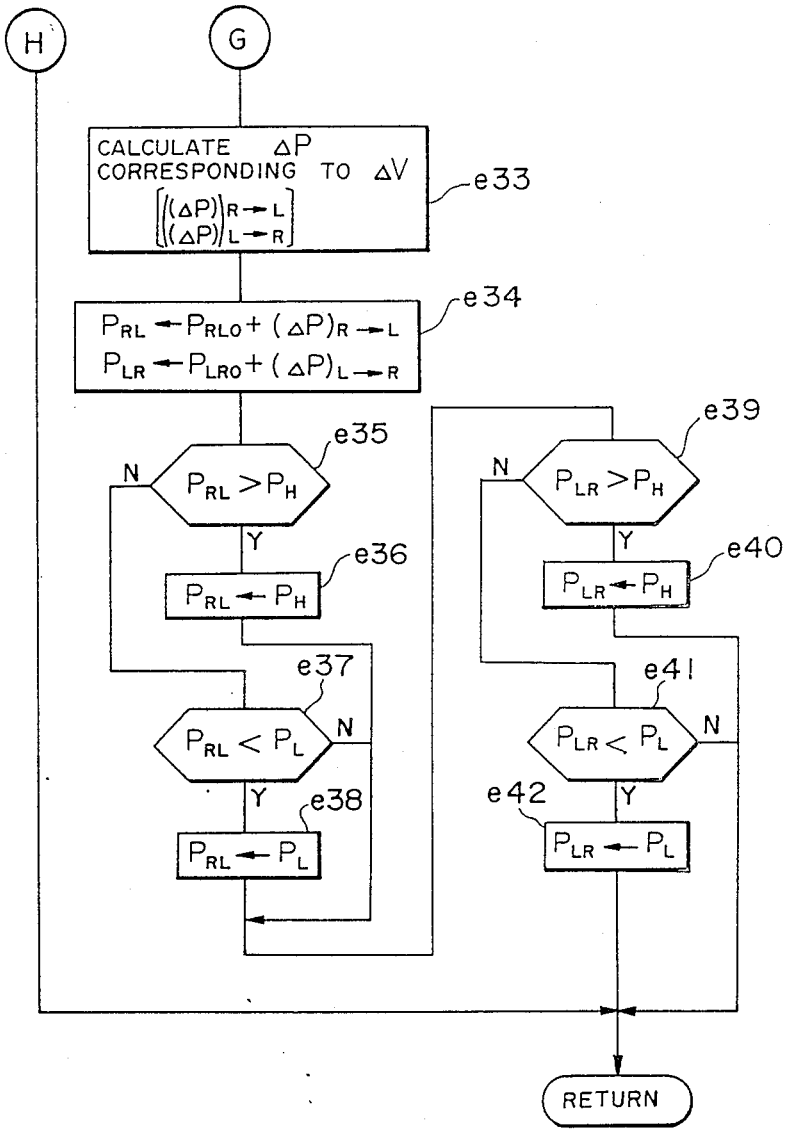

Next, a flow chart for the corrections of the proportional gains $P_{RL}$,$P_{LR}$ for the air/fuel ratio feed back control is similar to that described above with reference to FIG. 18 and ma be illustrated as shown in FIG. 37.

Figure 43A:
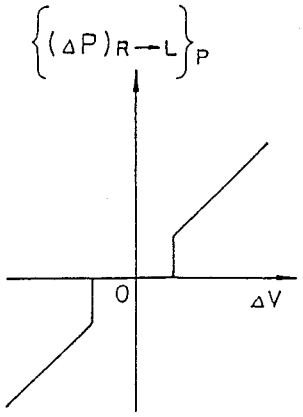
Figure 43B:
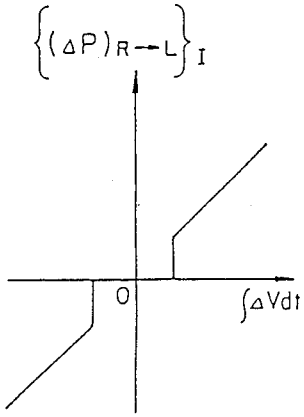
Figure 44A:
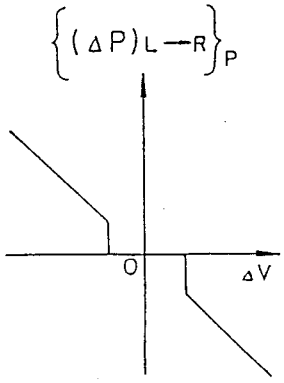
Figure 44B:
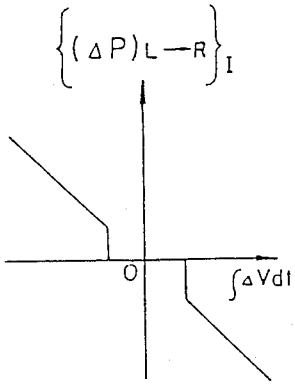

By the way, there are two kinds of proportional gains as $\Delta P$, one being a proportional gain for the change of the air/fuel ratio from the rich side to the lean side and the other being a proportional gain for the change of the air/fuel ratio from the lean side to the rich side. Correction characteristics for the former proportional gain are similar to those depicted in FIGS. 23(*a*) and 23(*b*) and may be illustrated as shown in FIGS. 43(*a*) and 43(*b*), while those for the latter proportional gain are similar to those depicted in FIGS. 24(*a*) and 24(*b*) and may be depicted as shown in FIGS. 44(*a*) and 44(*b*). Functional relations (inclinations and dead zones) shown in these FIGS. 43(*a*) and 43(*b*) and FIGS. 44(*a*) and 44(*b*) are also set in the ROM data.

When $P_{RL}$ and $P_{LR}$ are corrected on the basis of the output of the rearward $O_2$ sensor and the air/fuel ratio is rendered richer, $P_{RL}$ is rendered smaller and at the same time, $P_{LR}$ is rendered greater as illustrated in FIGS. 50(*a*) through 50(*c*) likewise FIGS. 29(*a*) through 29(*c*). For rendering the air/fuel ratio leaner, $I_{RL}$ is rendered greater and at the same time, $I_{LR}$ is rendered smaller as illustrated in FIGS. 51(*a*) through 51(*c*) likewise FIGS. 30(*a*) through 30(*c*).

As has been described above, the output $V_r$ of the rearward $O_2$ sensor 18 is measured during the air/fuel ratio feedback control at constant time intervals (or whenever the output $V_f$ of the forward $O_2$ sensor 17 crosses the standard value $V_{fc}$) and the correction of the proportional gain is effected to make its moving average equal to $V_{rc}$, whereby the air/fuel ratio feedback control is corrected. Here again, it is possible to bring about substantially the same effects and advantages as the aforementioned correction of the response delay times o integral gains.

Figure 38:
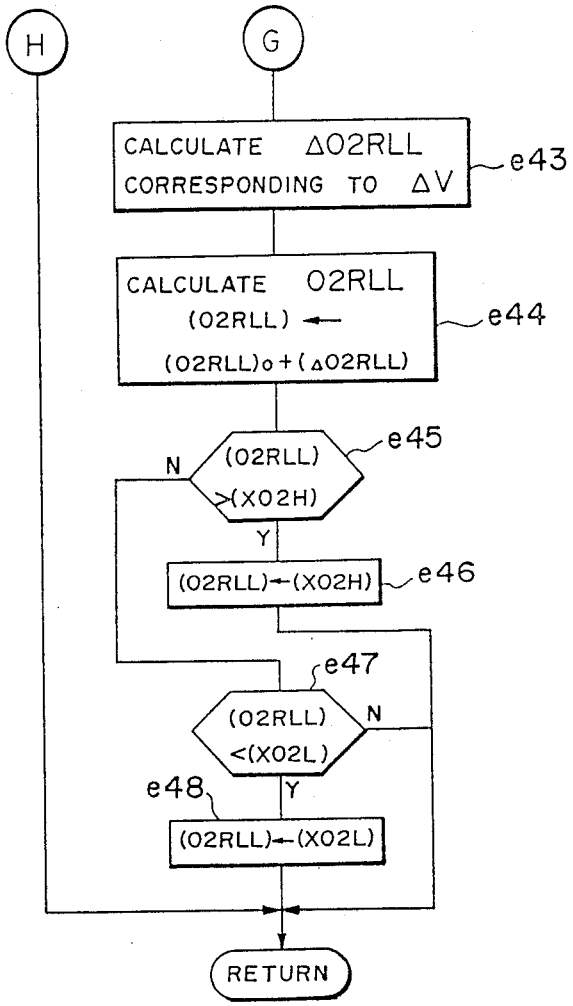

A description will next be made of the correction of the rich/lean-judging standard value O2RLL. First of all, as illustrated in FIG. 38, $\Delta$O2RLL corresponding to $\Delta V$ obtained in Step e11 of FIG. 34 is calculated in Step e43.

Figure 45A:
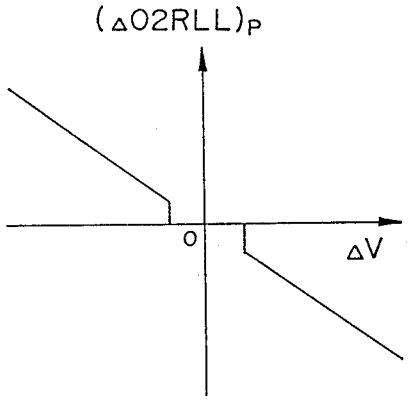
Figure 45B:
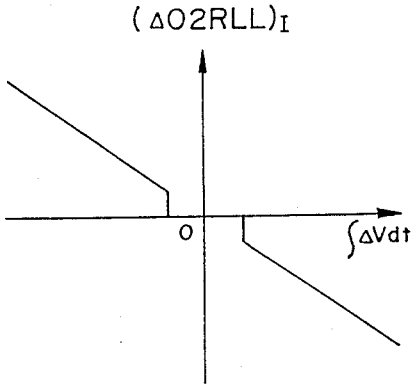

Correction characteristics for the $\Delta$O2RLL may be illustrated as shown in FIGS. 45(*a*) and 45(*b*).

Namely, $\Delta$O2RLL is given as the sum of $\{\Delta O2RLL\}_P$ based on a short-term value of $\Delta V$ and $\{\Delta O2RLL\}_I$ based on an integrated value of $\Delta V$. It may hence be expressed as follows.

$$\Delta O2RLL = (\Delta O2RLL)_I + (\Delta O2RLL)_P$$

Functional relations (inclinations and dead zones) shown in these FIGS. 45(*a*) and 45(*b*) are also set in the ROM data.

After determination of the $\Delta$O2RLLs in the above manner, the $\Delta$O2RLL is added to the standard value $(O2RLL)_o$ of O2RLL, thereby determining new O2RLL.

In the next Step e45, it is judged whether O2RLL is greater than XO2H (upper limit: this value is set in the ROM data; O2RLL>XO2H). If the answer is "NO", it is judged in Step e47 whether O2RLL is smaller than XO2L (lower limit: this value is set in the ROM data; O2RLL<XO2L).

If the answer is "YES" in Step e45, XO2H is set as O2RLL in Step e46. If the answer is "YES" in Step e47, XO2L is set as O2RLL in Step e48.

If the answer is "NO" in Step e47, after the processings of Steps e46,e48, the routine returns.

When O2RLL is corrected on the basis of the output $V_r$ of the rearward $O_2$ sensor and the air/fuel ratio is rendered richer, O2RLL is rendered greater as illustrated in FIGS. 52(*a*) through 52(*c*). For rendering the air/fuel ratio leaner, O2RLL is rendered smaller as shown in FIGS. 53(*a*) through 53(*c*).

As has been described above, the output $V_r$ of the rearward $O_2$ sensor 18 is measured during the air/fuel ratio feedback control at constant time intervals (or whenever the output $V_f$ of the forward $O_2$ sensor 17 crosses the standard value $V_{fc}$) and the correction of the rich/lean-judging standard value is effected to make its moving average equal to $V_{rc}$, whereby the air/fuel ratio is corrected. It is hence possible to bring about substantially the same effects and advantages as the above-described correction of the response delay times, integral gains or proportional gains.

In the fourth embodiment described above, only one or some of the response delay times, integral gains and proportional gains may be corrected in such a way that the moving average of the output $V_r$ of the rearward $O_2$ sensor 18 becomes equal to $V_{rc}$.

Figure 54:
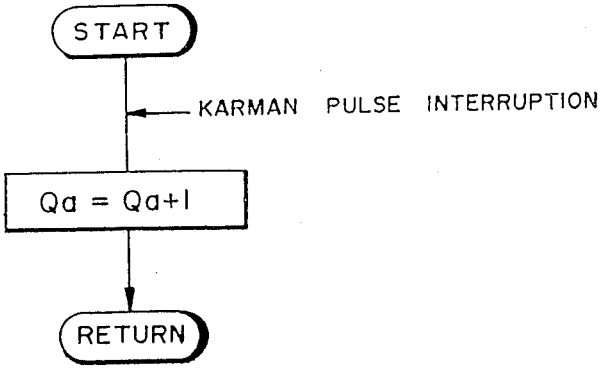
FIGS. 54 is a flow chart showing modifications of the third and fourth embodiments.
Figure 55:
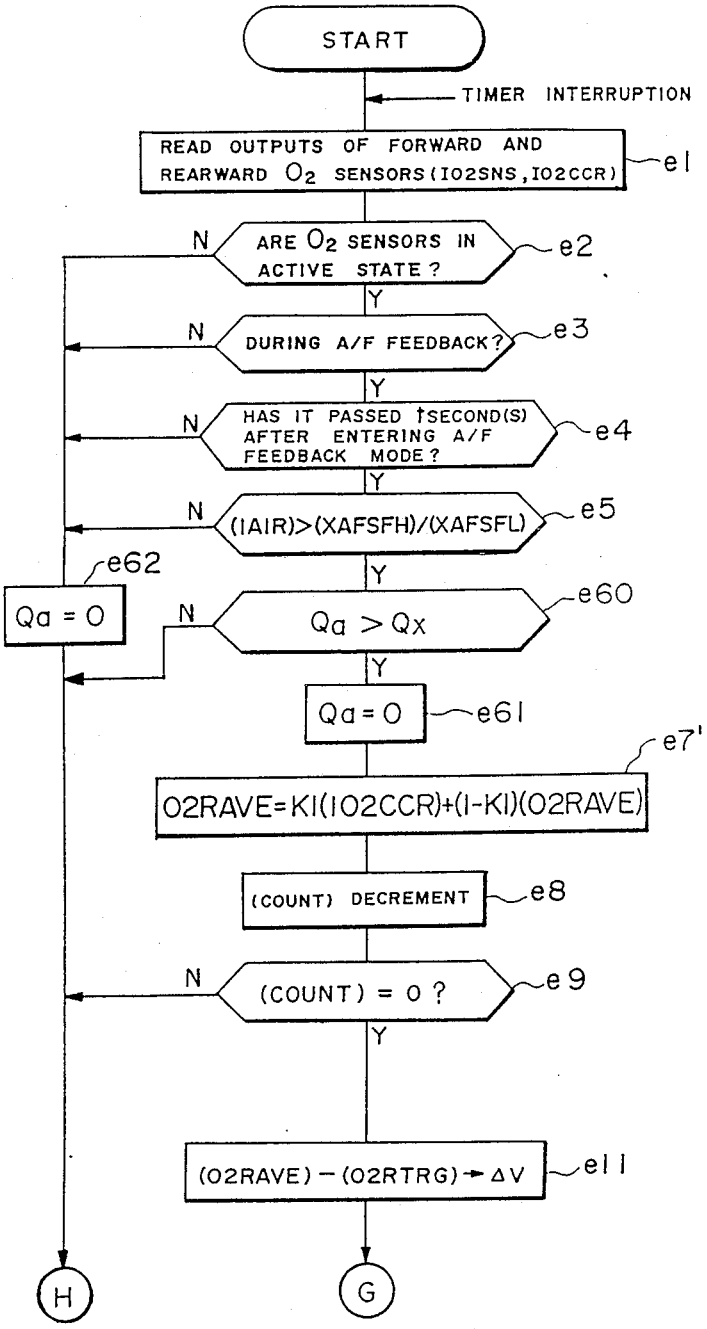
FIG. 55 is a flow chart showing modifications of the third and fourth embodiments.

In the third and fourth embodiments described above, the average output value O2RAVE of the rearward $O_2$ sensor was renewed in Step e6 and Step e7 of the flow charts of FIGS. 15 and 34 whenever the output of the forward $O_2$ sensor was reversed. This renewal may however be performed whenever the quantity of intake air reaches a predetermined value (namely, the cumulative value of data on the quantity of intake air reaches the predetermined value).

Where discrete pulses of a frequency corresponding to an intake air quantity are inputted to the ECU 23 from the airflow sensor (Karman vortex flow meter) 11 as shown in FIG. 2, the flow chart of FIGS. 54 and 55 may be used instead of those shown in FIGS. 15 and 34. Namely, in a routine which is performed whenever a pulse synchronous with the production of a Karman vortex reaches as illustrated in FIG. 54, an additional step is provided to cumulate the number of such pulses. In Step e60 of the timer interruption routine shown in FIG. 55, it is also judged whether the cumulated value of the pulses has exceeded a predetermined value $Q_x$. If this is the case, after the cumulative value datum $Q_a$ is reset in Step e6l, the average output value of the rearward $O_2$ sensor is renewed like Step e7 described above.

If a judgement of "NO" is made in any one of Steps e2–e5 of FIG. 55, the cumulative value datum $Q_a$ is reset to 0 in Step e62.

Regarding the symbols for the steps and the like in FIG. 55, those identified by the same symbols as those employed in FIGS. 15 and 34 indicate the same steps and the like. Incidentally, Step e5 may be omitted in the flow chart of FIG. 55.

The air/fuel ratio control system according to the fifth embodiment of this invention, which is suitable for use with an internal combustion engine, will next be described.

In the fifth embodiment, the output $V_r$ of the rearward $O_2$ sensor 18 is measured during the air/fuel ratio feedback control and another feedback correction factor $K_{FB2}$ different from the above-described feedback correction factor $K_{FB}$ is obtained on the basis of the output $V_r$. Namely, the correction factor $K_{FB2}$ is obtained by a map or computation in accordance with $\Delta V$ determined in FIG. 15, 34 or 55 (see FIG. 57).

Figure 56A:
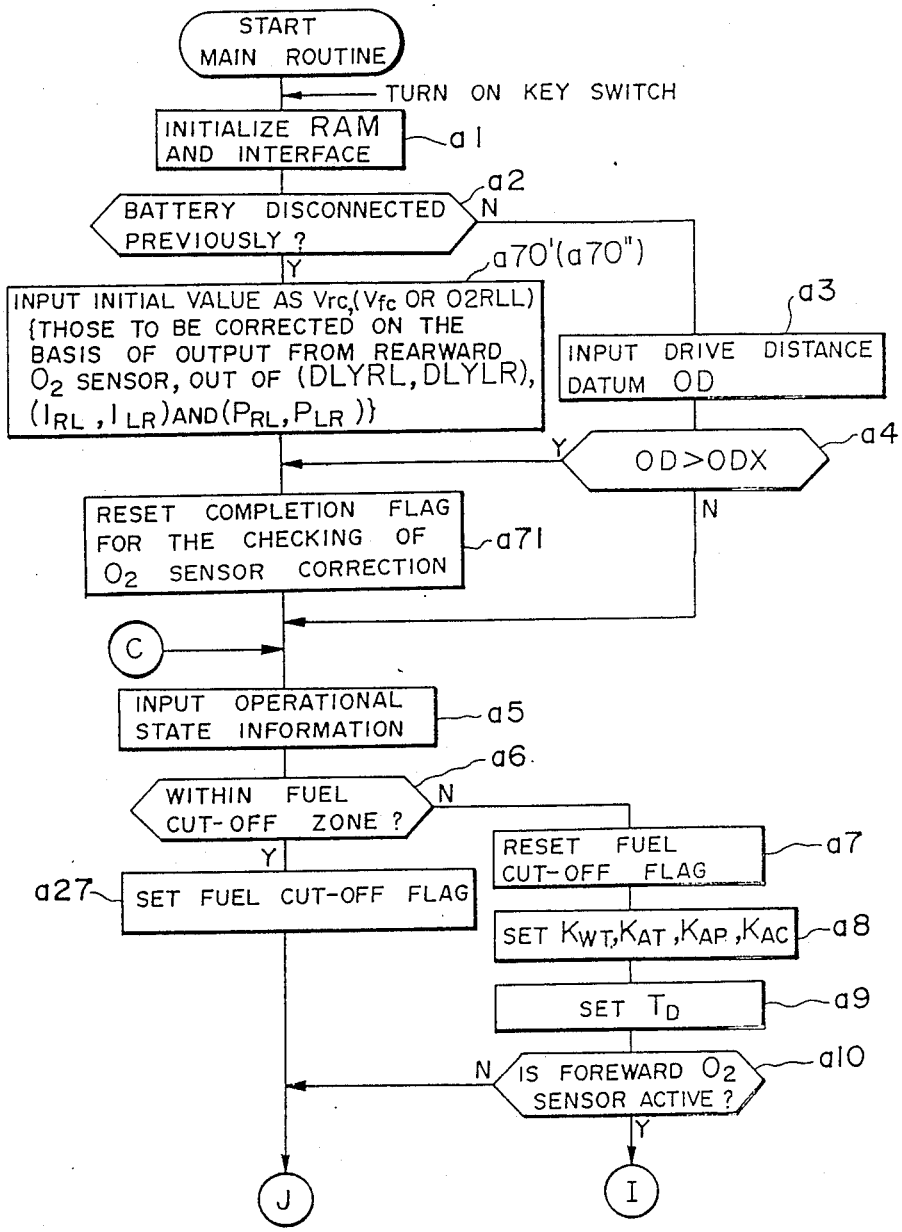
Figure 56B:
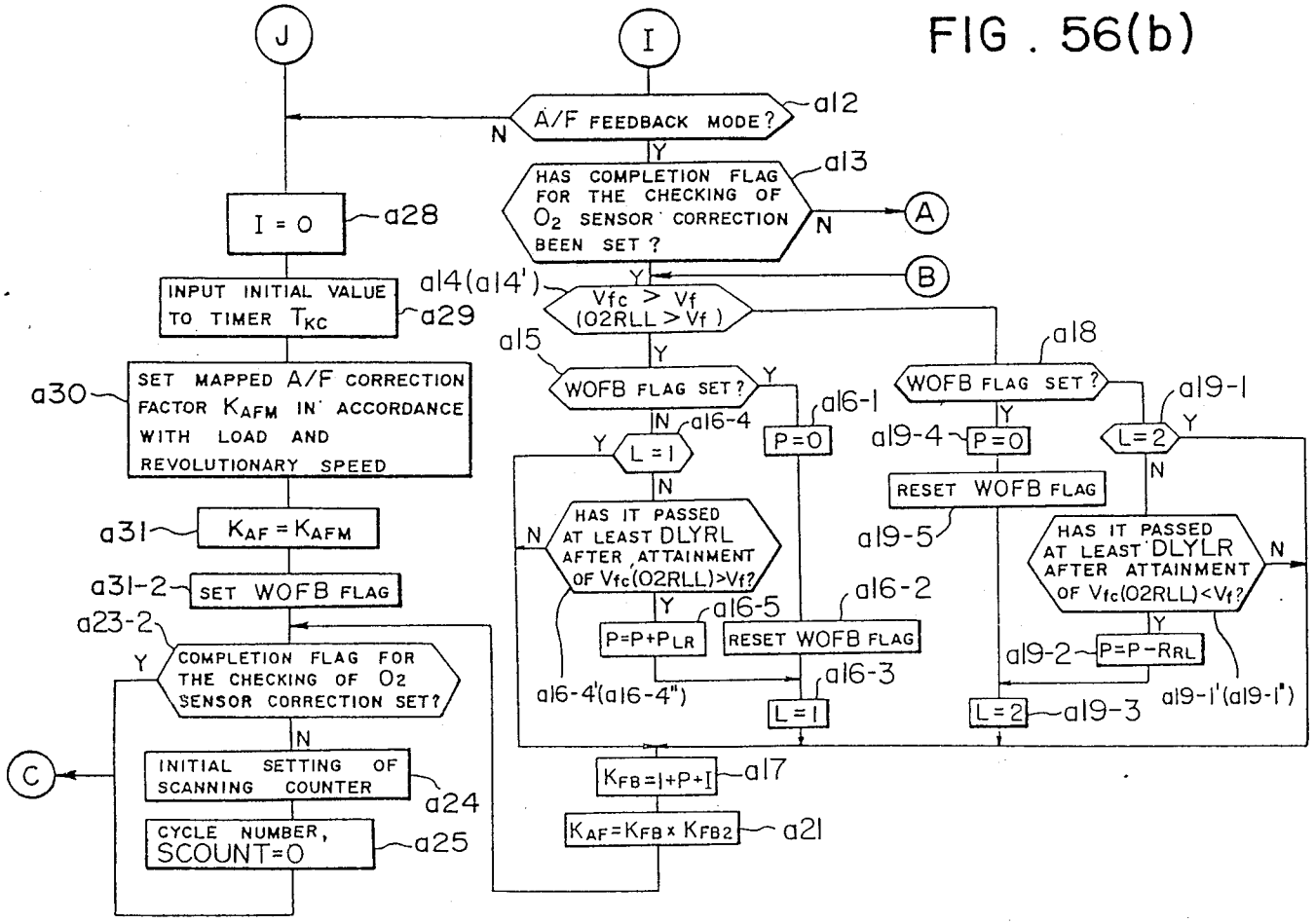
Figure 57:
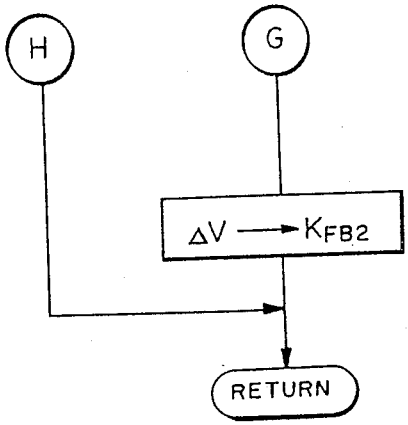
FIG. 57 is a flow chart for determining a correction factor on the basis of any one of the deviations determined in FIGS. 15, 34 and 55 respectively.

In this case, the correction factor $K_{FB}$ determined in Step a17 of FIG. 56(*b*) is multiplied with the correction factor $K_{FB2}$, which has been obtained in FIG. 57, in Step a2l of FIG. 56(*b*) so as to use the resulting product as $K_{FB}$.

The other parts of the main flow are identical to their corresponding parts illustrated in FIGS. 14(*a*), and 14(*c*) through 14(*e*) or FIGS. 33(*a*), 33(*c*) through 33(*e*).

In this manner, it is also possible to obtain substantially the same effects and advantages as those obtained in each of the preceding embodiments.

The air/fuel ratio control system according to the sixth embodiment of this invention, which is suitable for use with an internal combustion engine, will next be described.

In the sixth embodiment, a secondary air feed passage 60 is connected to a point upstream of the catalytic converter 9 and an electromagnetic control valve 61 is interposed in the secondary air feed passage 60. The output $V_r$ of the rearward $O_2$ sensor 18 and the standard value $V_{rc}$ are compared. In accordance with results of this comparison, the opening rate or duty ratio of the control value 61 is changed to adjust the feed quantity of secondary air so that the air/fuel ratio is controlled. Here, the standard value $V_{rc}$ for the rearward $O_2$ sensor 18 is corrected on the basis of the output of the forward $O_2$ sensor 17 and the output of the rearward $O_2$ sensor 18.

Namely, while changing the feed quantity of secondary air intentionally, the state of the output of each of the forward $O_2$ sensor 17 and rearward $O_2$ sensor 18 is sampled so that a correlation diagram such as that illustrated in FIG. 8(*c*) [which corresponds to FIG. 8(*b*)] is obtained. From the diagram, the standard value for the rearward $O_2$ sensor is obtained.

Figure 58:
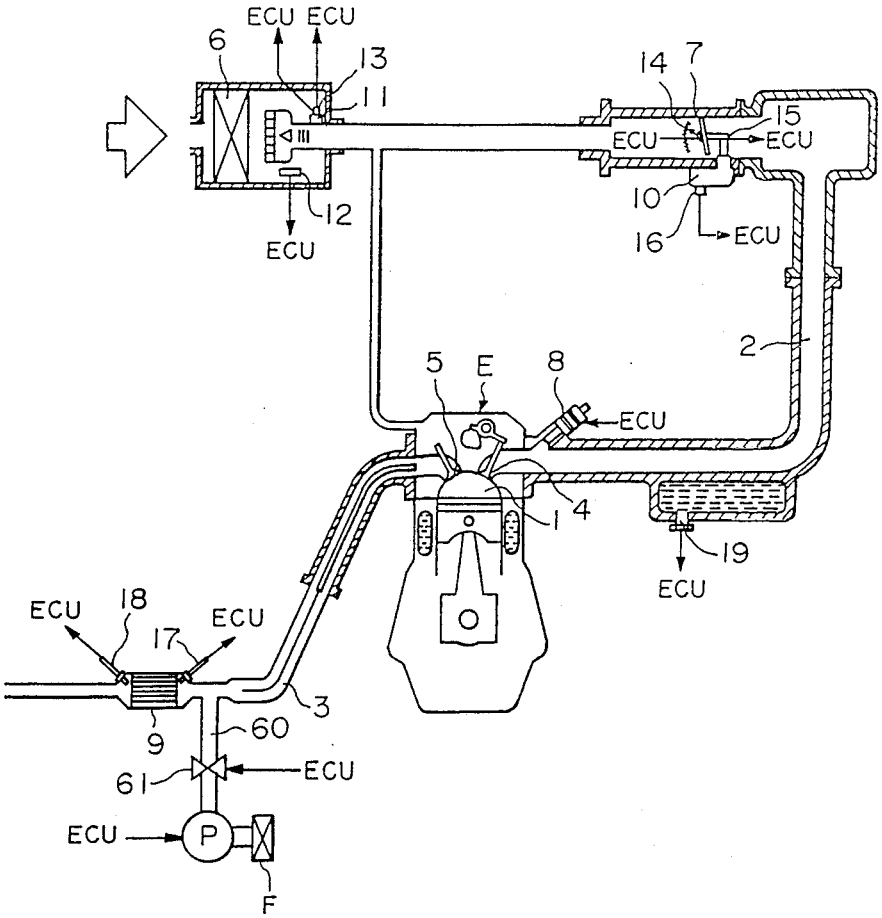
FIG. 58 is a schematic illustration showing an overall engine system equipped with an air/fuel ratio control system according to a sixth embodiment of this invention.

In FIG. 58, letter P indicates a motor-operated pump and letter F designates an air filter.

The processing in Step a23 of the main routine in the second embodiment described before may be performed in accordance with the following equation:

$$Kc = kKc + (1-k)K_{FB}$$

where $0 \leqq k \leqq 1$ or $0 < k < 1$.

Similar to the second embodiment, a flow for determining $K_c$ may be added to the first embodiment described before.

The response delay times DLYLR,DLYRL may also be taken into consideration in the first embodiment described before. For example, processings corresponding to Step a16-4' and Step a19-1' of FIG. 1l(*b*) are added to FIG. 4(*b*) in this case.

In each of the above embodiments, the role of the forward $O_2$ sensor 17 may be carried out by the rearward $O_2$ sensor and that of the rearward $O_2$ sensor may be done by the forward $O_2$ sensor 17.

It is also possible to use the forward $O_2$ sensor 17 as a fail-safe means (back-up) for the rearward $O_2$ sensor 18 and the rearward $O_2$ sensor 18 as a fail-safe means (back-up) for the forward $O_2$ sensor 17.

Further, the present invention can be applied to any system which performs the feedback control by one or more $O_2$ sensors. Needless to say, this invention can be applied not only to engine systems of the MPI system but also to engine systems of the SPI system.

We claim:

1. An air/fuel ratio control system for an internal combustion engine, comprising:

a first oxygen density sensor arranged on an upstream side of a catalytic converter so as to detect the density of oxygen in exhaust gas, said catalytic converter being provided in an exhaust system of the internal combustion engine and adapted to clean the exhaust gas;

a second oxygen density sensor arranged inside the catalytic converter or on a downstream side of the catalytic converter so as to detect the density of oxygen in the exhaust gas;

an air/fuel ratio control means for controlling the air/fuel ratio of the internal combustion engine on the basis of results of comparison between a detection value from one of the first and second oxygen density sensors and a predetermined standard value; and a standard-value changing means for changing the standard value on the basis of outputs from the first and second oxygen density sensors.

2. The system as claimed in claim 1, wherein said standard-value changing means changes the air/fuel ratio between a rich side and a lean side relative to a stoichiometric air/fuel ratio, detects outputs from the first and second oxygen density sensors at each air/fuel ratio upon changing the air/fuel ratio, and then changes the standard value on the basis of a difference in output between the first oxygen density sensor and second oxygen density sensor.

3. The system as claimed in claim 2, wherein said standard-value changing means changes the standard value at intervals of a predetermined period of operation time.

4. The system as claimed in claim 1, wherein said standard-value changing means changes the air/fuel ratio between a rich side and a lean side relative to a stoichiometric air/fuel ratio, detects outputs from the first and second oxygen density sensors at each air/fuel ratio upon changing the air/fuel ratio, and changes and renews the standard value by a median of outputs from said one oxygen density sensor in a range where a corresponding output characteristic curve obtained as a result of the detection has an inclination greater than a predetermined inclination.

5. An air/fuel ratio control system for an internal combustion engine, comprising:

a first oxygen density sensor arranged on an upstream side of a catalytic converter so as to detect the density of oxygen in exhaust gas, said catalytic converter being provided in an exhaust system of the internal combustion engine and adapted to clean the exhaust gas;

a second oxygen density sensor arranged inside the catalytic converter or on a downstream side of the catalytic converter so as to detect the density of oxygen in the exhaust gas;

an air/fuel ratio control means for controlling the air/fuel ratio of the internal combustion engine on the basis of results of comparison between a detection value from one of the first and second oxygen density sensors and a predetermined standard value;

a second standard-value setting means for setting a second standard value for the other oxygen density sensor on the basis of outputs from the first and second oxygen density sensors; and an air/fuel ratio control correction means for effecting a correction to the air/fuel ratio control, which is to be performed by said air/fuel ratio control means, on the basis of results of comparison between the second standard value set by said second standard-value setting means and an output from the other oxygen density sensor.

6. The system as claimed in claim 5, wherein said second standard-value changing means changes the air/fuel ratio between a rich side and a lean side relative to a stoichiometric air/fuel ratio, detects outputs from the first and second oxygen density sensors at each air/fuel ratio upon changing the air/fuel ratio, and changes and renews the second standard value by a value pertaining to an output of the other oxygen density sensor, said output corresponding to the median of outputs from said one oxygen density sensor in a range where a corresponding output characteristic curve obtained as a result of the detection has an inclination greater than a predetermined inclination.

7. The system as claimed in claim 6, wherein said second standard-value changing means changes the second standard value at intervals of a predetermined period of operation time.

8. The system as claimed in claim 5, wherein said air/fuel ratio control correction means effects a correction to any one of at least response delay time, proportional gain and integral gain on the basis of results of comparison between the second standard value and an output from the other oxygen density sensor.

9. The system as claimed in claim 5, wherein said air/fuel ratio control correction means effects a correction to the standard value on the basis of results of comparison between the second standard value and an output from the other oxygen density sensor.

10. The system as claimed in claim 5, wherein said air/fuel ratio control correction means uses the average value of outputs from the other oxygen density sensor as the output from the other oxygen density sensor, and the average value of the outputs is renewed whenever the output value of said one oxygen density sensor is reversed.

11. The system as claimed in claim 10, wherein when the number of reversals of the output value from said one oxygen density sensor has exceeded a predetermined value, a correction is effected to the air/fuel control by said air/fuel control means on the basis of results of comparison between the second standard value and the average value of the outputs from the other oxygen density sensor.

12. The system as claimed in claim 5, wherein said air/fuel ratio control correction means uses the average value of outputs from the other oxygen density sensor as the output from the other oxygen density sensor, and the average value of the outputs is renewed whenever the quantity of intake air of the internal combustion engine exceeds a first predetermined value.

13. The system as claimed in claim 12, wherein when the number of occasions where the quantity of the intake air of the internal combustion engine exceeded a predetermined value has exceeded a second predetermined value, a correction is effected to the air/fuel ratio control by said air/fuel ratio control means on the basis of results of comparison between the second standard value and the average value of the outputs from the other oxygen density sensor.

14. An air/fuel ratio control system for an internal combustion engine, comprising:

a first oxygen density sensor arranged on an upstream side of a catalytic converter so as to detect the density of oxygen in exhaust gas, said catalytic converter being provided in an exhaust system of the internal combustion engine and adapted to clean the exhaust gas;

a second oxygen density sensor arranged inside the catalytic converter or on a downstream side of the catalytic converter so as to detect the density of oxygen in the exhaust gas;

an air/fuel ratio control means for controlling the air/fuel ratio of the internal combustion engine on the basis of results of comparison between a detection value from one of the first and second oxygen density sensors and a predetermined standard value;

a standard-value changing means for changing the standard value on the basis of outputs from the first and second oxygen density sensors;

a second standard-value setting means for setting a second standard value for the other oxygen density sensor on the basis of outputs from the first and second oxygen density sensors; and an air/fuel ratio control correction means for effecting a correction to the air/fuel ratio control, which is to be performed by said air/fuel ratio control means, on the basis of results of comparison between the second standard value set by said second standard-value setting means and an output from the other oxygen density sensor.

* * * * *